US009404333B2

(12) United States Patent
Patel

(10) Patent No.: US 9,404,333 B2
(45) Date of Patent: Aug. 2, 2016

(54) DUAL BARRIER OPEN WATER WELL COMPLETION SYSTEMS

(71) Applicant: Schlumberger Technology Corporation, Sugar Land, TX (US)

(72) Inventor: Dinesh R. Patel, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 14/418,052

(22) PCT Filed: Jul. 30, 2013

(86) PCT No.: PCT/US2013/052709

§ 371 (c)(1),
(2) Date: Jan. 28, 2015

(87) PCT Pub. No.: WO2014/022384

PCT Pub. Date: Feb. 6, 2014

(65) Prior Publication Data

US 2015/0204155 A1 Jul. 23, 2015

Related U.S. Application Data

(60) Provisional application No. 61/700,523, filed on Sep. 13, 2012, provisional application No. 61/691,671, filed on Aug. 21, 2012, provisional application No. 61/677,804, filed on Jul. 31, 2012.

(51) Int. Cl.

| | |
|---|---|
| ***E21B 33/035*** | (2006.01) |
| ***E21B 34/06*** | (2006.01) |
| ***E21B 33/12*** | (2006.01) |

(Continued)

(52) U.S. Cl.

CPC ..... *E21B 33/0355* (2013.01); *E21B 33/064* (2013.01); *E21B 33/12* (2013.01); *E21B 33/124* (2013.01); *E21B 34/04* (2013.01); *E21B 34/06* (2013.01); *E21B 43/04* (2013.01); *E21B 47/06* (2013.01); *E21B 47/122* (2013.01)

(58) Field of Classification Search

CPC ..... E21B 33/064; E21B 47/06; E21B 43/101; E21B 33/043; E21B 33/124; E21B 43/04; E21B 33/0355; E21B 33/12; E21B 34/04; E21B 34/06

See application file for complete search history.

(56) References Cited

U.S. PATENT DOCUMENTS

| | | | | |
|---|---|---|---|---|
| 5,350,018 | A * | 9/1994 | Sorem et al. | 166/250.07 |
| 5,979,553 | A | 11/1999 | Brink | |
| 6,328,111 | B1 | 12/2001 | Bearden et al. | |
| 7,121,345 | B2 | 10/2006 | Bartlett | |
| 7,438,135 | B2 * | 10/2008 | Page et al. | 166/387 |
| 7,841,412 | B2 | 11/2010 | Jasset et al. | |
| 8,225,863 | B2 | 7/2012 | Hammer et al. | |
| 8,985,215 | B2 * | 3/2015 | Tips et al. | 166/313 |

(Continued)

FOREIGN PATENT DOCUMENTS

WO WO 2014182396 A1 * 11/2014 ..... E21B 34/04

OTHER PUBLICATIONS

International Search Report Application No. PCT/US2013/057209 dated Nov. 11, 2013.

*Primary Examiner* — James G Sayre
(74) *Attorney, Agent, or Firm* — David J. Groesbeck

(57) ABSTRACT

A well completion system in accordance with one or more embodiments includes a shallow set barrier installed in an upper completion section of a well, a deep set barrier installed in a lower section of the well, a first sensor disposed to gauge a pressure in a first area between the deep set barrier and the shallow set barrier and a communication device to communicate the gauged pressure. The lower section may be located below a production completion when it is installed in the upper completion section.

15 Claims, 43 Drawing Sheets

(51) Int. Cl.

| | |
|---|---|
| ***E21B 34/04*** | (2006.01) |
| ***E21B 33/064*** | (2006.01) |
| ***E21B 33/124*** | (2006.01) |
| ***E21B 43/04*** | (2006.01) |
| ***E21B 47/06*** | (2012.01) |
| ***E21B 47/12*** | (2012.01) |

(56) References Cited

U.S. PATENT DOCUMENTS

| | | | |
|---|---|---|---|
| 2002/0000322 | A1 | 1/2002 | Bartlett et al. |
| 2006/0237189 | A1 | 10/2006 | Page et al. |
| 2008/0029273 | A1 | 2/2008 | Pia |

* cited by examiner

DUAL BARRIER OPEN WATER WELL COMPLETION SYSTEMS

BACKGROUND

This section provides background information to facilitate a better understanding of the various aspects of the disclosure. It should be understood that the statements in this section of this document are to be read in this light, and not as admissions of prior art.

In order to provide well control and maintain well integrity, it is desired to maintain two independently verified barriers in place at all times during the construction or suspension of the well. Well construction operations include all activities from the time the well is drilled until the well is completed and ready for production by installing a production control device, such as a Christmas tree.

Multiple wells may be drilled into a particular geological formation or hydrocarbon reservoir. The multiple wells may be drilled and completed in stages and therefore one or more of the wells may be suspend for a period of time. The suspended well can be re-entered at a later date and completed at a later date.

SUMMARY

A well completion system in accordance with one or more embodiments includes a shallow set barrier installed in an upper section of a well, a deep set barrier installed in a lower section of the well, a first sensor disposed to gauge a pressure in a first area between the deep set barrier and the shallow set barrier and a communication device to communicate the gauged pressure. The lower section may be located below a production completion when it is installed in the upper section. A method in accordance with an embodiment includes installing a deep set barrier valve in a lower section of a well, verifying integrity of the deep set barrier, installing a shallow set barrier in an upper completion section of the well, gauging the pressure in a first area between the shallow set barrier and the deep set barrier, suspending the well with the deep set barrier and the shallow set barrier in place, and gauging the pressure in the first area while the well is suspended. In accordance with some embodiments a well includes a subsea isolation device connected at the wellhead, an upper deep set barrier and a lower completion providing a lower deep set barrier, a gravel pack port formed through the lower completion, a device sealing the gravel pack port and sensors gauging pressure between the barriers.

The foregoing has outlined some of the features and technical advantages in order that the detailed description of the dual barrier open water completion system that follows may be better understood. Additional features and advantages of the dual barrier open water completion system will be described hereinafter which form the subject of the claims of the invention. This summary is not intended to identify key or essential features of the claimed subject matter, nor is it intended to be used as an aid in limiting the scope of claimed subject matter.

BRIEF DESCRIPTION OF THE DRAWINGS

Embodiments of dual barrier open water completion system are described with reference to the following figures. The same numbers are used throughout the figures to reference like features and components. It is emphasized that, in accordance with standard practice in the industry, various features are not necessarily drawn to scale. In fact, the dimensions of various features may be arbitrarily increased or reduced for clarity of discussion.

DETAILED DESCRIPTION

Figure 1:
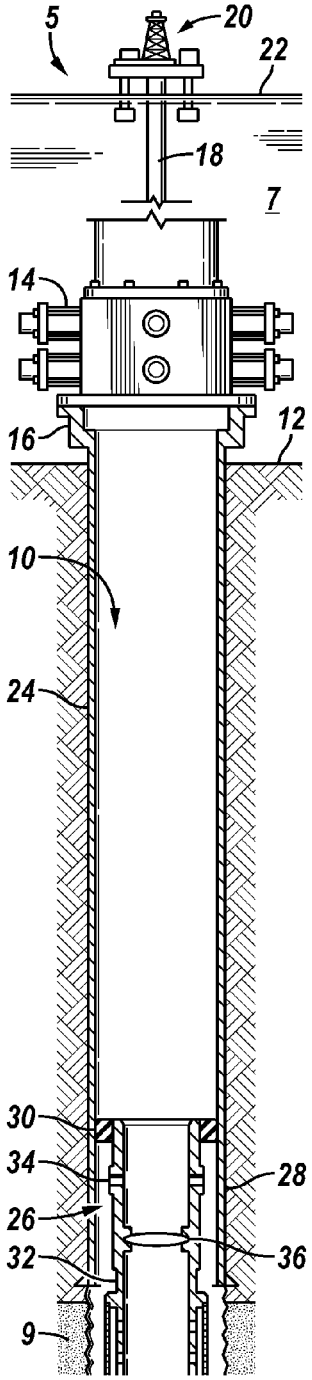
FIGS. 1-21 illustrate a dual barrier well completion system in accordance to one or more embodiments having a lower barrier that may be opened when running an intermediate completion and an upper completion.

It is to be understood that the following disclosure provides many different embodiments, or examples, for implementing different features of various embodiments. Specific examples of components and arrangements are described below to simplify the disclosure. These are, of course, merely examples and are not intended to be limiting. In addition, the disclosure may repeat reference numerals and/or letters in the various examples. This repetition is for the purpose of simplicity and clarity and does not in itself dictate a relationship between the various embodiments and/or configurations discussed.

In the specification and appended claims: the terms "connect," "connection," "connected," "in connection with," and "connecting" are used to mean "in direct connection with" or "in connection with via one or more elements"; and the term "set" is used to mean "one element" or "more than one element". Further, the terms "couple," "coupling," "coupled," "coupled together," and "coupled with" are used to mean "directly coupled together" or "coupled together via one or more elements". As used herein, the terms "up" and "down," "upper" and "lower," "upwardly" and downwardly," "upstream" and "downstream," "above" and "below," and other like terms indicating relative positions above or below a given point or element are used in this description to more clearly describe some embodiments of the disclosure. As used herein: the abbreviation "FIV" is understood to mean "formation isolation valve"; the abbreviation "POOH" is understood to mean "pulled out of the hole"; the abbreviation "RIH" is understood to mean "run in hole"; the abbreviation "GP" is understood to mean "gravel pack"; the abbreviation "SCSSV" is understood to mean "surface controlled subsurface safety valve"; the abbreviation "PCS" is understood to mean "port closure sleeve"; and "ICD" is understood to mean "inflow/outflow control device".

In some subsea wells a blow-out-preventer (BOP) and riser system are used at the well surface to maintain pressure and keep the hydrocarbon from the surrounding seawater. However, installation of the BOP and riser system is costly in that sea based surface equipment, such as platforms, are typically deployed in order to install the components. If these components are not deployed, then the well integrity relies largely on the completion barrier valves that are deployed as part of the completion system. In these cases, monitoring of the completion system downhole of the barrier valves can provide information as to the functionality of the barrier valves. In some embodiments, a completion system installed in an "open water" well may have two or three barrier valves, as well as a subsea isolation device installed at the wellhead. Subsea isolation devices may differ from blow out preventers in size and function, and may be installed from a non-platform surface asset such as a ship.

In some embodiments of an open water completion system, a lower barrier may not be monitored, and the lower barrier is open while running the intermediate completion section. A lower sand control completion may be run-in-hole, the lower completion including at least a gravel packing packer, a gravel packing port and a FIV type barrier valve. Next an intermediate completion may be run-in-hole, the intermediate completion including a dual trip saver type FIV, an intermediate packer, an open/close shifting tool, an open only shifting tool, and a straddle seal assembly. The intermediate completion mates with the lower completion, the open only shifting tool opening the lower completion barrier valve, and the straddle seal sealing the gravel packing port. The intermediate packer is set (e.g. with a drop ball), and the deployment tool is pulled out of hole, leaving the lower barrier valve open, and closing the upper or deep set barrier valve (i.e., dual trip saver FIV). At this point, the deep set barrier valve is the only separation between the well and the open water.

A shallow set plug assembly may be installed at a location uphole from the deep set barrier valve, for instance, at a location closer to the wellhead. The shallow set barrier assembly may include: a pressure sensor or gauge, suitable to measure pressure in the area between the deep set barrier valve and the shallow set barrier; a communication means (e.g. an inductive coupler or an electrical wet connect, or wireless transmitter) and a barrier (plug or FIV). Once the shallow set barrier is in place, the well is separated from the open water by the deep set barrier and the shallow set barrier. The pressure between the two barriers may be measured or gauged by the pressure gauge. Any fluctuation in pressure over time could be indicative of a leak in the deep set barrier valve. Once the shallow set barrier is in place, the well may be suspended for a period of time (e.g. 6 months, 1 year) until further completion components (e.g. Christmas tree assembly) are installed. During this suspension time pressure may be monitored in several ways. When the communication means comprises an inductive coupler assembly (e.g. a female coupler coupled to the pressure gauge), a male inductive coupler portion may be periodically lowered and engaged with the female inductive coupler portion to provide energy and communication with the pressure gauge. A pressure reading may then be taken and compared to the initial pressure reading. Likewise, an electrical wet connect would allow for the periodic engagement from surface (e.g. a ship) of a tool deployed by coiled tubing, wireline, etc., which engages with the shallow set barrier valve communication means to determine pressure information. In some embodiments, the communication means might include an acoustic or wireless data transmission module that is battery powered and installed. The wireless data transmission may communicate periodically with a surface asset, such as a ship or a surface receiver. As suspension periods of wells are commonly about 1 year in length, battery life for the wireless transmitter should not be a limiting factor. The initial suspension period would be the time between the installation of the lower and upper completion segments. While pressure gauges were discussed herein, one of skill in the art will recognize that other gauges (flow, temperature, etc.) may also be deployed.

When the upper completion is to be installed, the pressure readings between the shallow set and deep set barriers would be examined for evidence of leaks or other problems. Barring that, the shallow set barrier may be removed and the upper completion run-in-hole and installed. Various embodiments, as disclosed herein, are possible wherein a completion system includes barrier valves and maintains well pressure without the use of a blowout preventer.

Referring to FIGS. 1-22 an open water completion system is described in which dual barrier monitoring systems and methods in accordance to one or more embodiments are implemented. In accordance with an embodiment, a lower barrier 36 of a lower completion 26 may be open while running an intermediate completion 38 and the production completion 86. The lower barrier may or may not be monitored. FIG. 1 illustrates an open water completion system, generally denoted by the numeral 5, having a subsea well or wellbore 10 drilled from a seabed 12 to an earthen formation 9. A blowout preventer (BOP) stack 14 has been landed on a wellhead 16 in the depicted well. BOP stack 14 commonly includes one or more sets of each of pipe rams to close on pipe, blind rams to close over an open wellbore, and shear rams to cut the pipe passing through the BOP stack. A marine riser 18 extends from BOP stack 14 to a surface rig 20 located at water surface 22. Surface rig 20 is illustrated in FIG. 1 as a platform and marine riser 18 may extend for example one-thousand feet or more through water 7. In accordance with some embodiments, BOP stack 14 may be located at the top of marine riser 18 and a subsea isolation device may be installed at wellhead 16. Casing 24, i.e., a casing string, extends downward from wellhead 16 toward the formation. The A-annulus will be formed in casing 24 when the production tubing is installed.

FIG. 1 illustrates a lower completion 26 that has been run into the hole (RIH) and landed in a lower section 28 of casing 24 distal from wellhead 16. The lower section 28 of the casing may be located below the lower most end of the upper, or production completion when it is installed. Lower completion 26 is illustrated as a sand control completion including a gravel packing packer 30, tubular 32 (i.e., casing, liner), gravel pack port 34, and a formation isolation valve (FIV) type of barrier valve 36. Gravel pack may be circulated down well 10 and through gravel pack port 34.

Figure 2:
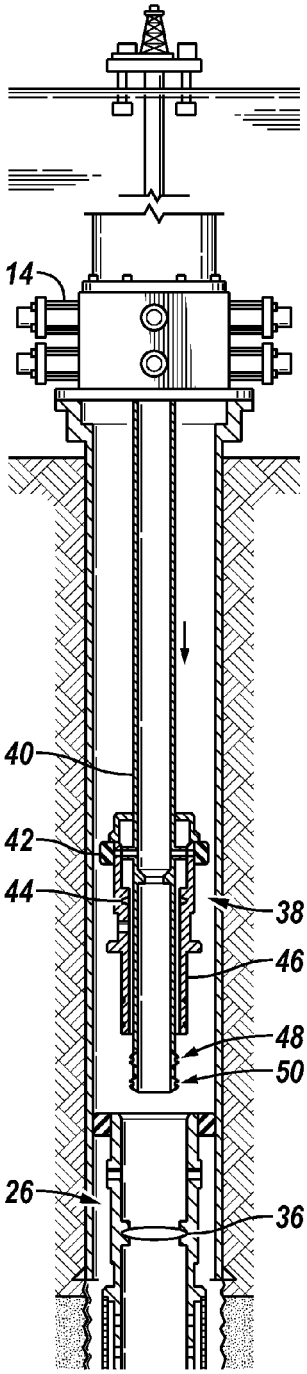
Figure 3:
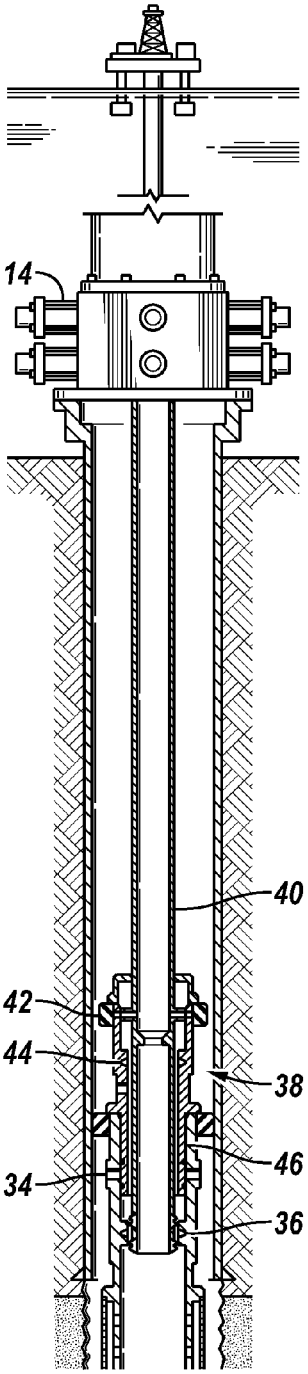
Figure 4:
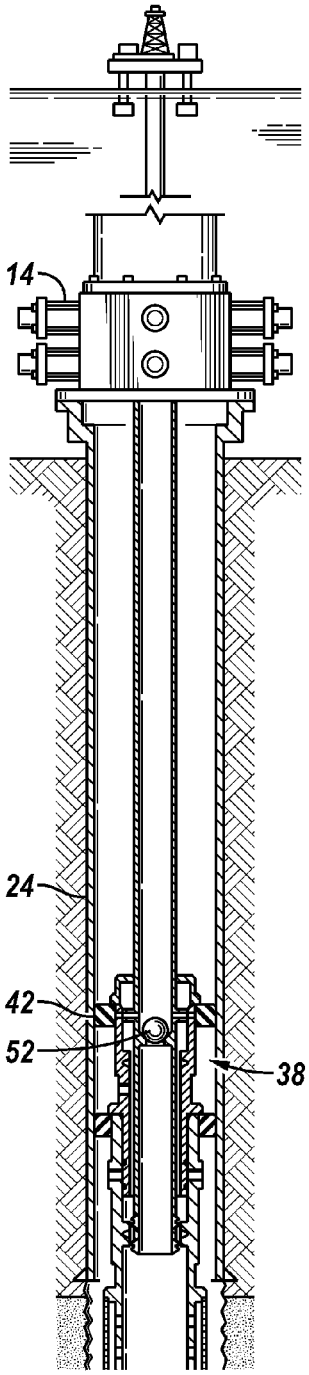

In FIG. 2 an intermediate completion 38 is RIH on a deployment tool 40. In this example, intermediate completion 38 includes an intermediate packer 42, a formation isolation valve (FIV) type barrier valve 44 (FIG. 5), and a straddle seal assembly 46. FIV barrier valve 44 may be a dual trip saver valve wherein the valve may be opened two times in response to applied pressure in the well without requiring a shifting tool to open the valve. The illustrated deployment tool 40, for example tubing, includes an open-close shifting tool 48 and an open only shifting tool 50.

Figure 5:
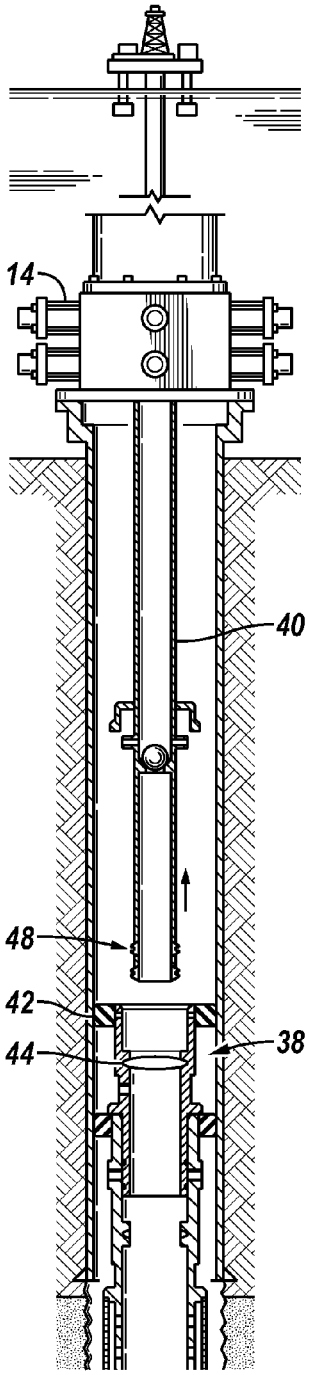

Referring in particular to FIGS. 2 to 5, intermediate completion 38 is illustrated mated with lower completion 26 with straddle seal assembly 46 sealing gravel packing port 34 and open only shifting tool 50 opening (FIG. 3) lower completion FIV barrier valve 36. A ball 52 is dropped (FIG. 4) and intermediate packer 42 is set to engage casing 24. Deployment tool 40 is illustrated in FIG. 5 being pulled out of the hole (POOH) and intermediate FIV barrier valve 44 closed by open-close shifting tool 48.

Figure 6:
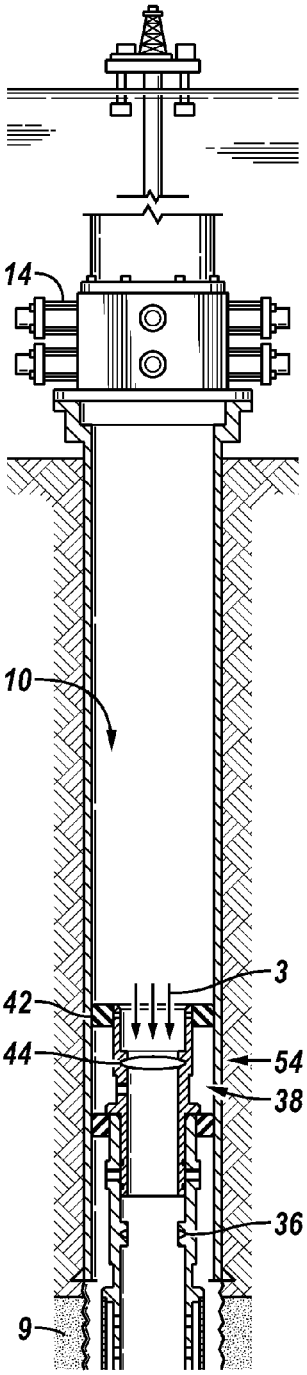

FIG. 6 illustrates lower barrier valve 36 open and intermediate barrier valve 44 closed. Intermediate packer 42 and closed intermediate valve 44 provide a deep set barrier 54. Deep set barrier 54 may be pressure tested, illustrated by the arrow 3, to ensure seal integrity. At this stage, deep set barrier 54 is the only separation in well 10 between formation 9 and the open water if the seabed isolation device, BOP stack 14 in this example, is removed.

Figure 7:
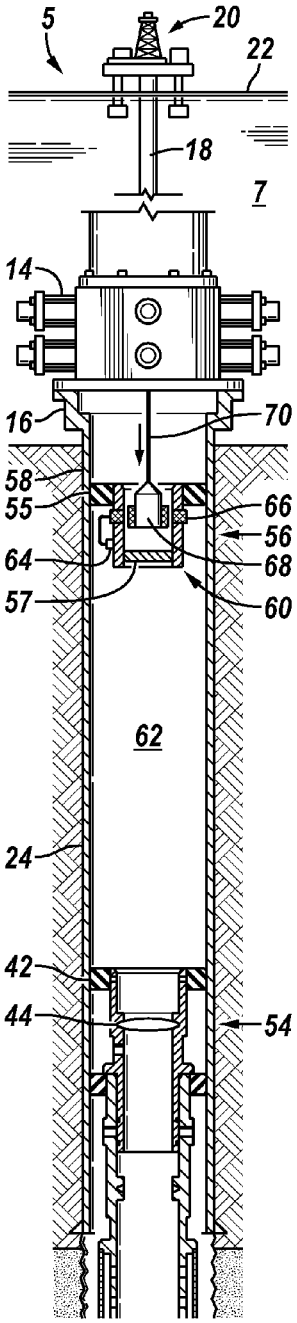

FIG. 7 illustrates a shallow set barrier 56 landed in casing 24. Shallow set barrier 56 is landed at a location uphole from deep set barrier 54 closer to wellhead 16. For example, shallow set barrier 56 is set in a section 58 of well 10 in which the production completion may be landed. In FIGS. 7-9 and 12, shallow set barrier 56 includes a packer 55 and plug 57. Shallow set barrier 56 may be formed by other devices, such as and without limitation a valve such as a mechanical formation isolation type valve. With reference to FIGS. 10 and 11, shallow set barrier 56 is illustrated as a mechanical type of formation isolation valve 59 coupled with a packer 55.

The open water completion system 5 includes a monitoring system 60 to at least measure and monitor pressure in the area 62 between the shallow set barrier 56 and deep set barrier 54. Monitoring system 60 includes a sensor 64 coupled with a communication device 66, for example and without limitation an induction coupler or wet connect. Sensor 64 measures or gauges at least pressure and may gauge characteristics in addition to pressure, for example temperature and flow rate. In this example, monitoring system 60 is incorporated in shallow set barrier 56 with sensor 64 in communication with the area 62 between the deep set barrier 54 and the shallow set barrier 56.

In FIG. 7 a communication coupler 68 is illustrated RIH from water surface 22 on a deployment 70 and operationally coupled with communication device 66 thereby connecting sensor 64 with surface controls, for example rig 20. Deployment 70 may be, for example, wireline, digital slick line, or tubing. Any fluctuation in pressure over time could be indicative of a leak in deep set barrier 54. In accordance to embodiments, deep set barrier 54 and shallow set barrier 56 are independently testable, for example by pressure testing, and independently monitored.

Figure 8:
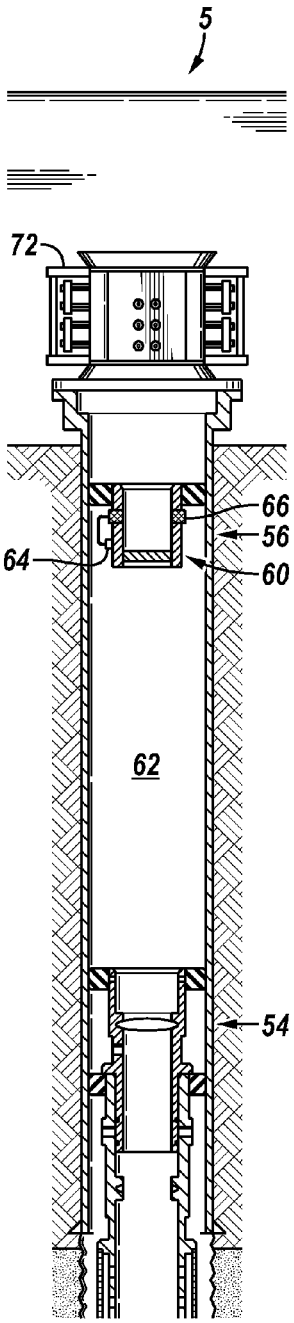

Once the two barriers 54, 56 are set, well 10 may be suspended for a period of time, for example six months or more, until additional completion components (e.g. Christmas tree) are installed. FIG. 8 illustrates dual barriers 54, 56 in place and well 10 suspended. BOP stack 14 and marine riser 18 illustrated in FIG. 7 may be disconnected from well 10. A subsea or seabed isolation device (SID) 72, as shown in FIG. 8, may be connected to wellhead 16 in place of a BOP stack. A subsea isolation device may be similar to a subsea BOP stack but lacking for example the shear rams or another type of isolation device such as lower riser package. As will be understood by those skilled in the art with benefit of this disclosure, a subsea isolation device may not be utilized while the well is suspended.

Figure 9:
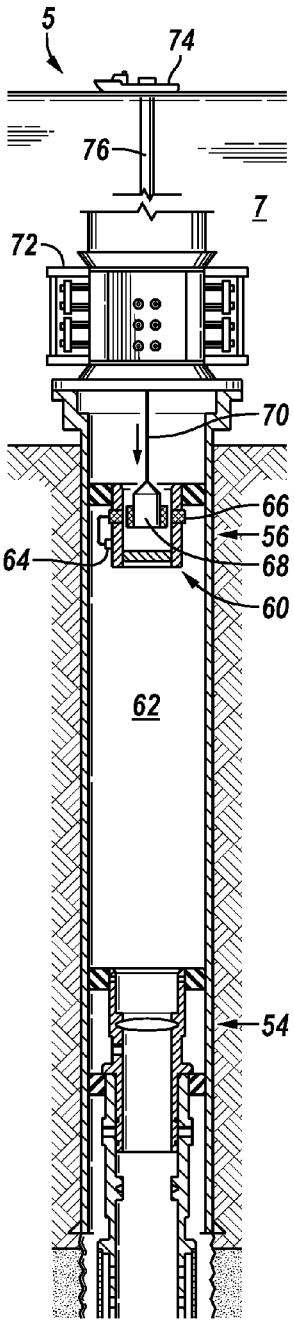
Figure 10:
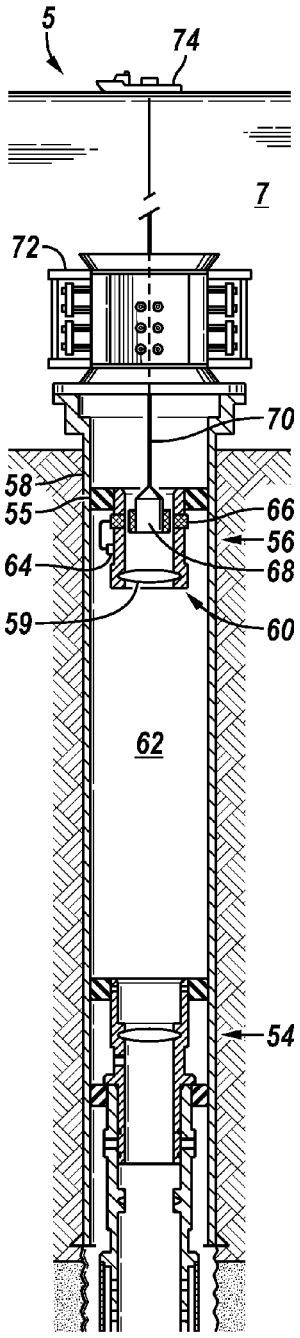
Figure 11:
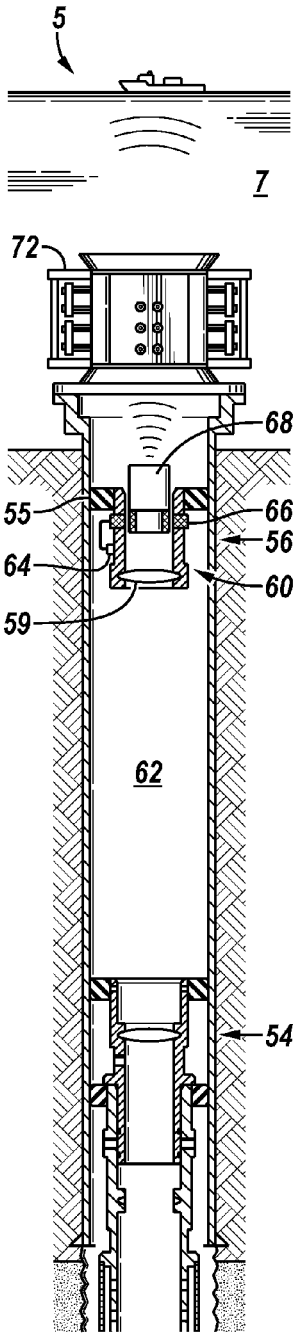

FIGS. 9 to 13 illustrate examples of continuous and periodic monitoring of dual barrier open completions 5 while the well is suspended. Non-limiting examples of wired communication and monitoring is depicted in FIGS. 9 and 10. FIG. 9 illustrates a communication coupler 68 deployed for example from a surface vessel (e.g. ship) 74 on a deployment 70 (e.g. tubing, wireline, digital slick line). Communication coupler 68 is shown in FIG. 9 deployed through a riser 76 which may be an intervention or open water type of riser as opposed to a marine riser as utilized during drilling operations. Communication coupler 68 is illustrated in FIG. 10 deployed through open water 7 and coupling monitoring system 60 with a surface receiver, for example vessel 74. As will be understood by those skilled in the art with benefit of this disclosure, control and communication systems (electronics, hydraulics) may be provided at the seabed, for example via station 108 illustrated in FIG. 20.

Figure 12:
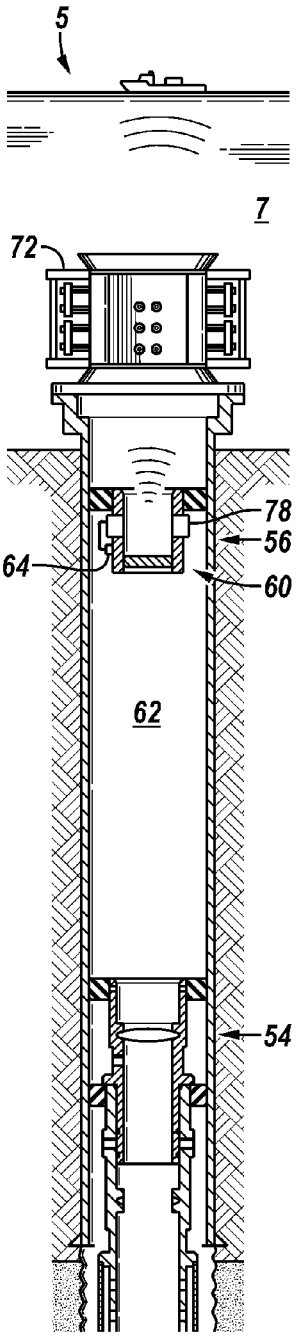

Non-limiting examples of wireless monitoring of dual barrier open water completions 5 are illustrated in FIGS. 11 and 12. Communication coupler 68 is depicted in FIG. 11 as a wireless data communication module which may include a battery and wireless acoustic data transmission electronics. In FIG. 12, monitoring system 60 includes an acoustic communication module 78 operationally coupled with sensor 64 to transmit data, for example acoustically, to surface vessel 74. Communication module 78 may include for example an electrical source (e.g. battery), and electronics for transmitting and receiving data.

Figure 13:
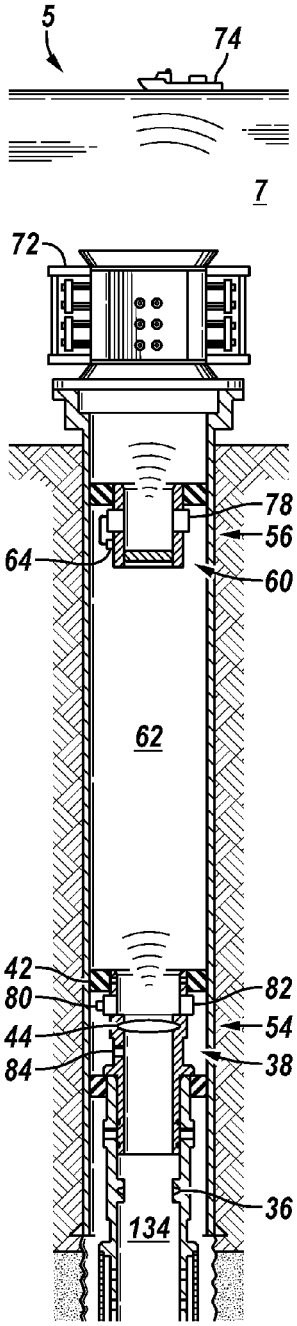
Figure 20:
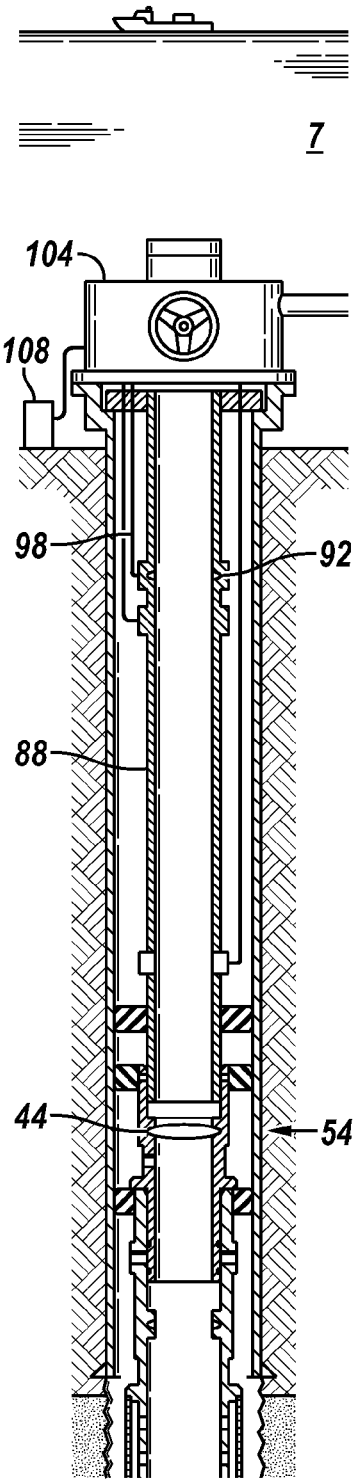
Figure 21:
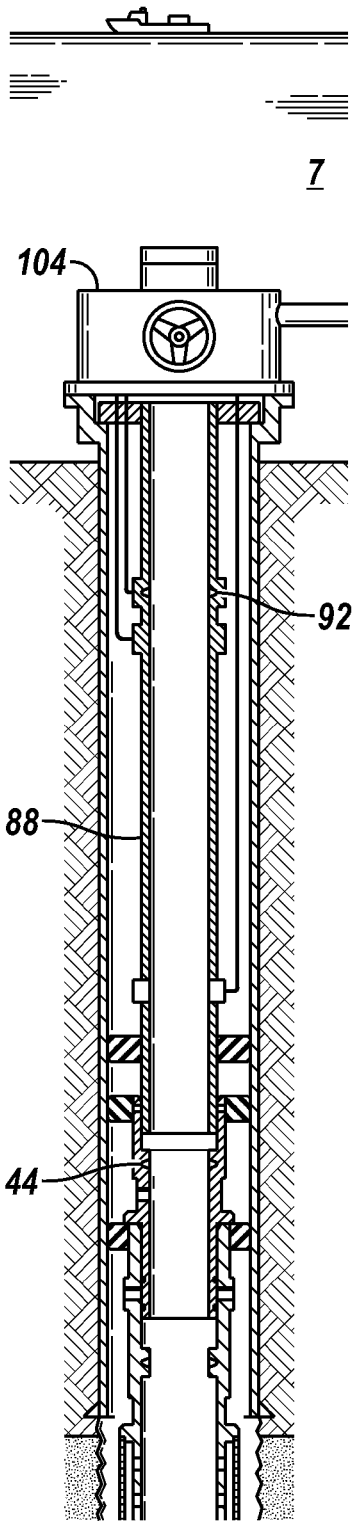

FIG. 13 illustrates an example of monitoring pressure in area 62 between deep set barrier 54 and shallow set barrier 56 and monitoring the pressure below deep set barrier 54. Intermediate completion 38 includes a sensor 80 operationally connected to a communication device 82. Sensor 80 is in communication with the pressure below packer 42 and barrier valve 44, for example via a port 84, to sense the pressure below deep set barrier 54. Sensor 80 may gauge characteristics or parameters, for example temperature and flow rate, in addition to gauging pressure. Lower barrier valve 36 is open in FIG. 13 providing communication with the area 134. When barrier valve 36 is closed, sensor 80 monitors the area 118 (e.g. FIG. 118) between the closed barrier valves 44, 36. Again, pressure sensor 80 may sense or measure characteristics in addition to pressure, for example temperature and flow rate. Communication device 82 may transmit data from pressure sensor 80 to monitoring system 60. For example, communication device 82 may transmit through acoustic wireless data transfer or by tube wave in casing fluid column to shallow set communication device 78 which receives and may transmit the data to a surface receiver, for example vessel 74 or a seabed station 108 (FIG. 20). In accordance to some embodiments, communication device 82 may be for example an induction coupler or electrical wet connect for wired communication to a shallow set receiver and or a surface receiver.

Figure 14:
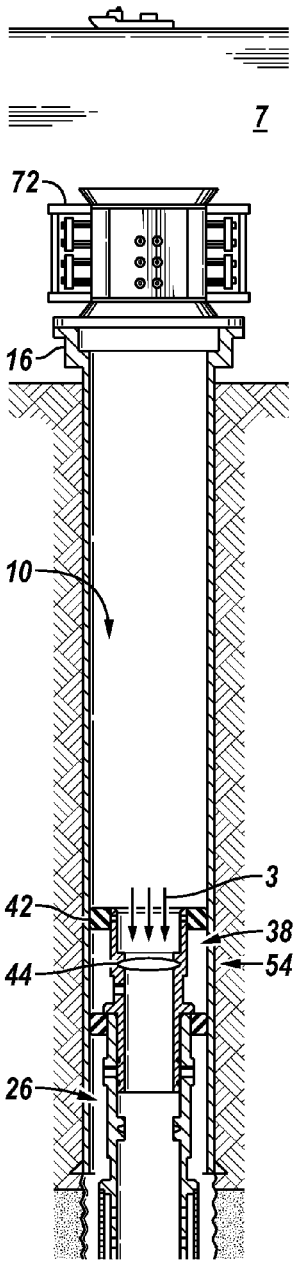

Referring now to FIGS. 14 to 22, a method of completing the well with a production completion without having the need to install a BOP stack after the well was suspended is described. Referring back to FIGS. 7-13, shallow set barrier 56 is shown located in the upper section 58 of the well in which a production completion will be installed. To complete the well with the production completion, shallow set barrier 56 (FIG. 13) is retrieved from the well as shown in FIG. 14. A surface isolation device 72 is shown installed at wellhead 16 with only one subsurface barrier, deep set barrier 54, in place. Deep set barrier 54 may be pressured tested as illustrated by the arrow 3 in FIG. 14.

Figure 15:
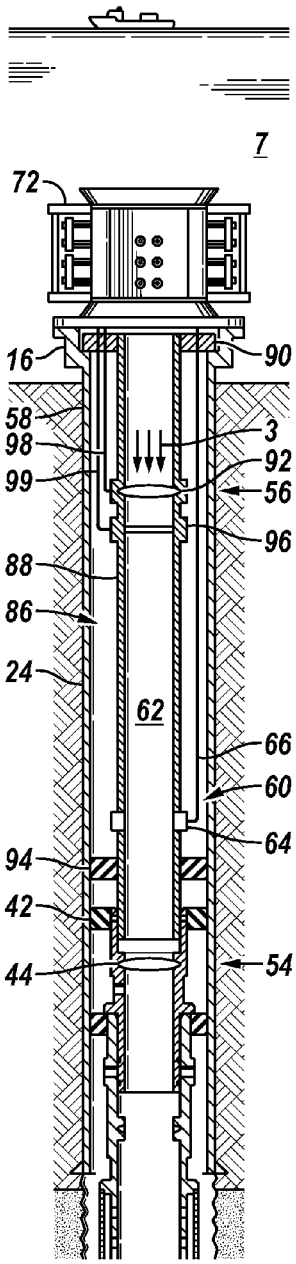

An upper completion 86, also referred to as a production completion, is RIH and landed as illustrated for example in FIG. 15 providing a deep set barrier 54 and a shallow set barrier 56. Upper completion 86 can be RIH through SID 72, for example, through open water 7, or through an open water or intervention type riser. Upper completion 86 includes, for example, tubing 88 suspended from a tubing hanger 90 landed at wellhead 16, and a barrier valve 92 and a production packer 94. Shallow set barrier 56 is formed by barrier valve 92 and production packer 94 and is located in the upper section 58 of the well and can be tested independent of deep set barrier 54. Barrier valve 92 is illustrated in FIG. 15 as a surface controlled formation isolation valve (SFIV). Production packer 94 may be located at a lower end of tubing 88 and landed above the intermediate completion and deep set barrier 54. Upper completion 86 includes a surface controlled subsurface safety valve (SCSSV) 96 located proximate barrier valve 92 in FIG. 15. Monitoring system 60 may be incorporated with upper completion 86. For example, sensor 64 may be integrated with tubing 88 to monitor pressure in the area 62, e.g. tubing bore, between deep set barrier 54 and shallow set barrier 56. Sensor 64 may sense pressure in tubing 88 bore and or the tubing-casing annulus. Sensor 64 may be connected to the surface receiver via communication device 66 illustrated as a cable in FIG. 15. Barrier valve 92 and shallow set barrier 56 can be pressure tested as illustrated by the arrow 3 in FIG. 15, providing an integrity test independent of the testing of deep set barrier 54.

Barrier valve 92 may be operated to an open position via a control line 98 from a controller (e.g. electronic, hydraulic), generally represented by vessel 74 and station 108 in FIG. 20. As will be understood by those skilled in the art with benefit of this disclosure, the surface controller (e.g. vessel 74) may be located at water surface 22, the seabed or at a remote operated vehicle (ROV). Control line 98 may extend to water surface 22 for example along a marine riser 18 (FIG. 1) or an open-water or intervention riser 76 (FIG. 7). Similarly, subsurface safety valve 96 includes a control line 99.

Figure 16:
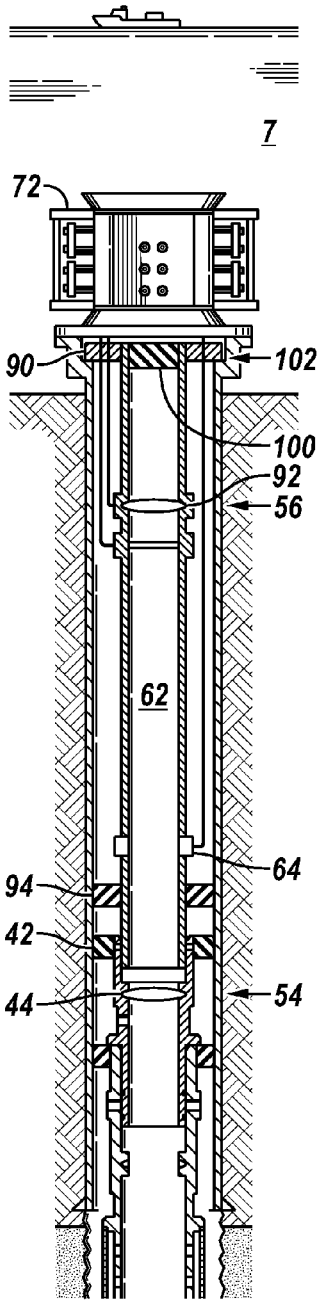
Figure 17:
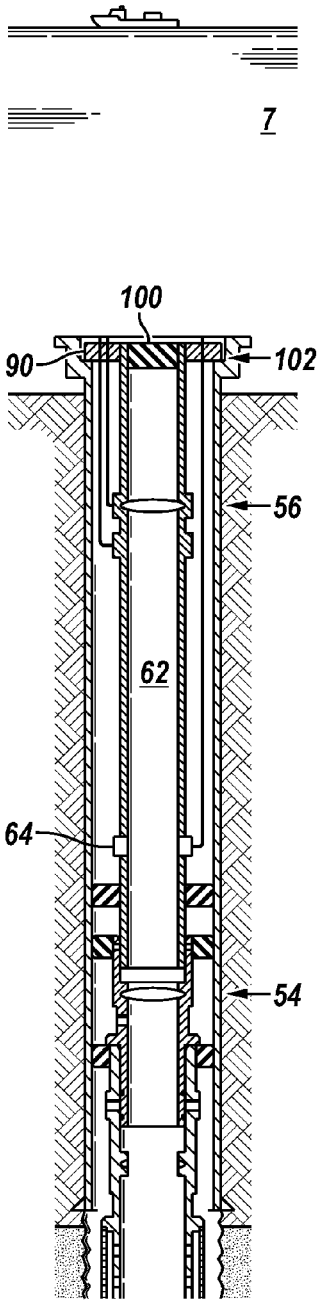

After verifying the integrity of shallow set barrier 56, a suspension plug 100 shown in FIG. 16 is landed in tubing hanger 90 forming an additional barrier 102. Subsea isolation device 72 may then be retrieved suspending the well as illustrated in FIG. 17. FIG. 17 illustrates the well with three barriers, deep set barrier 54, shallow set barrier 56 and additional shallow set barrier 102 and without a BOP stack or subsurface isolation device connected with wellhead 16.

Figure 18:
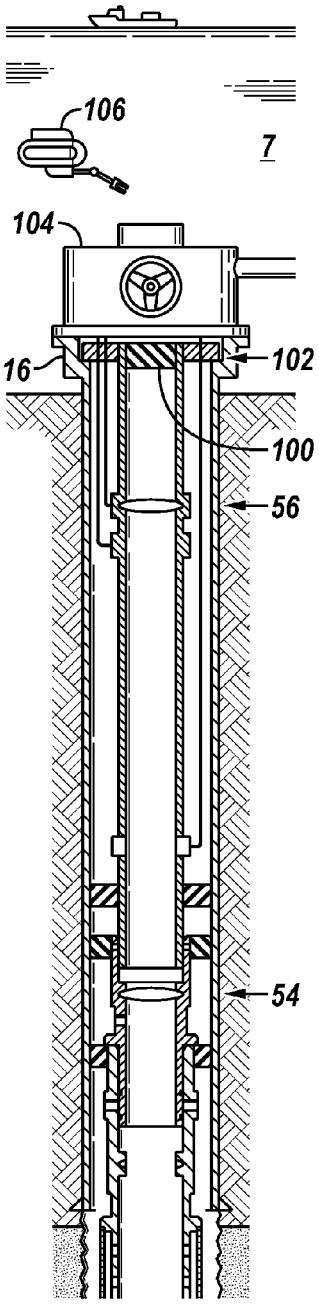
Figure 19:
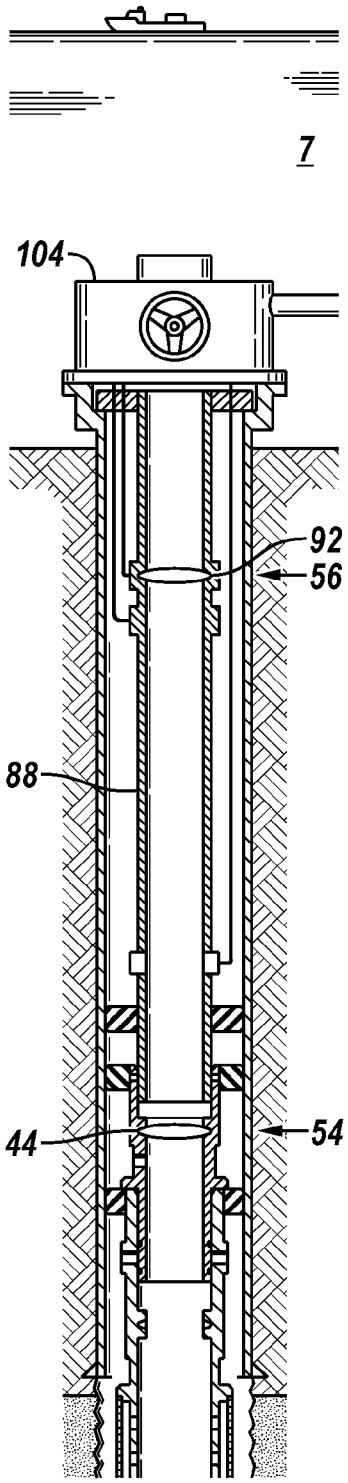
Figure 22:
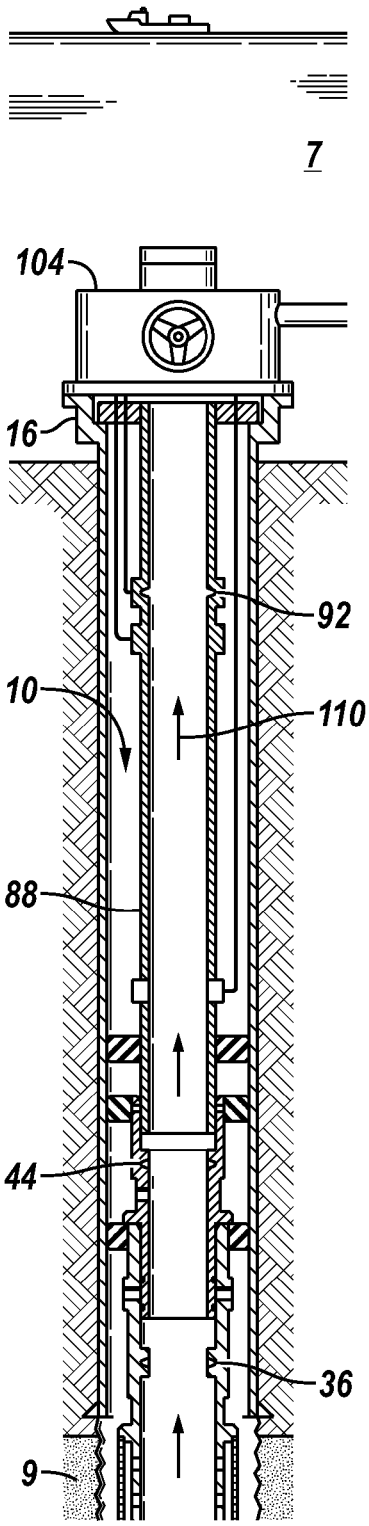

FIG. 18 illustrates a Christmas tree 104 (i.e., production tree, valve tree) landed and connected to wellhead 16. Tree 104 may be landed through open water 7 for example with assistance of a remote operated vehicle (ROV) 106. After tree 104 has been installed, suspension plug 100 is retrieved as shown in FIG. 19. In FIG. 20, barrier valve 92 is opened via pressure applied via control line 98 for example from a station 108 located at seabed 12. Tubing 88 pressure is applied in FIG. 21 opening barrier valve 44. As previously described, barrier valve 44 may be a dual trip saver FIV valve and a second tubing pressure signal may be applied if the first tubing pressure signal does not open barrier valve 44. FIG. 22 illustrates well 10 on production and producing fluid 110 from formation 9.

Referring now to FIGS. 23-42, an open water completion system is described in which dual barrier monitoring systems and methods in accordance to one or more embodiments are implemented. In accordance with an embodiment, a lower barrier valve 36 may be closed while running an intermediate completion 38 and while running the production completion 86. The lower barrier valve may be opened when setting the production completion.

Figure 23:
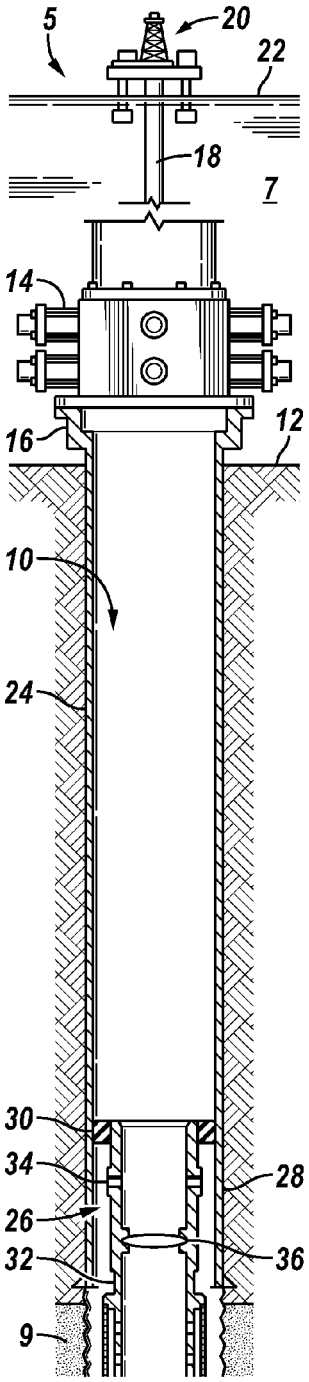
FIGS. 23-42 illustrate a dual barrier well completion system in accordance to one or more embodiments having a lower barrier that may be closed while running an intermediate and opened when setting the production completion.

FIG. 23 illustrates an open water completion system, generally denoted by the numeral 5, having a subsea well or wellbore 10 drilled from a seabed 12 to an earthen formation 9. A blowout preventer (BOP) stack 14 has been landed on a wellhead 16 in the depicted well. BOP stack 14 commonly includes one or more sets of each of pipe rams to close on pipe, blind rams to close over an open wellbore, and shear rams to cut the pipe passing through the BOP stack. A marine riser 18 extends from BOP stack 14 to a surface rig 20 located at water surface 22. Surface rig 20 is illustrated in FIG. 23 as a platform and marine riser 18 may extend for example one-thousand feet or more through water 7. In accordance with some embodiments, BOP stack 14 may be located at the top of marine riser 18 and a subsea isolation device may be installed at wellhead 16. The A-annulus will be formed in casing 24 when the production tubing is installed.

FIG. 23 illustrates a lower completion 26 that has been run into the hole (RIH) and landed in a lower section 28 of casing 24 distal from wellhead 16. Lower completion 26 is illustrated as a sand control completion including a gravel packing packer 30, tubular 32 (i.e., casing, liner), gravel pack port 34, and a formation isolation valve (FIV) type of barrier valve 36.

Figure 24:
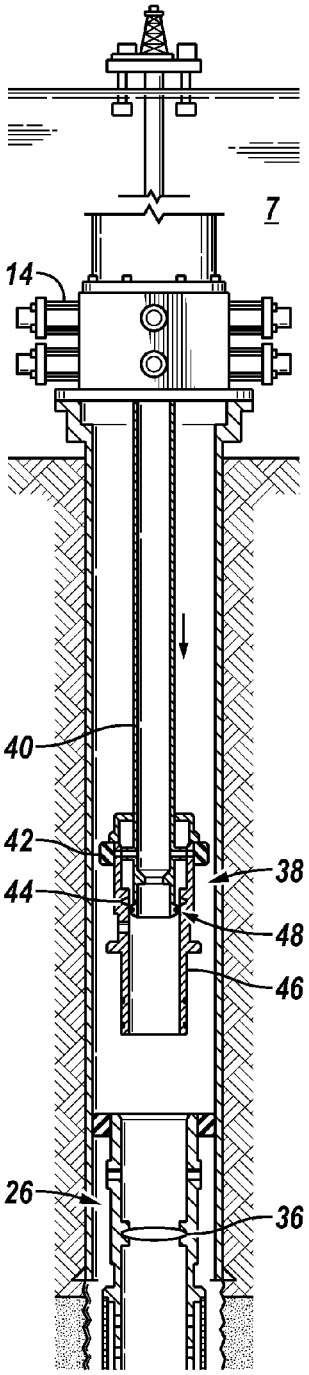
Figure 25:
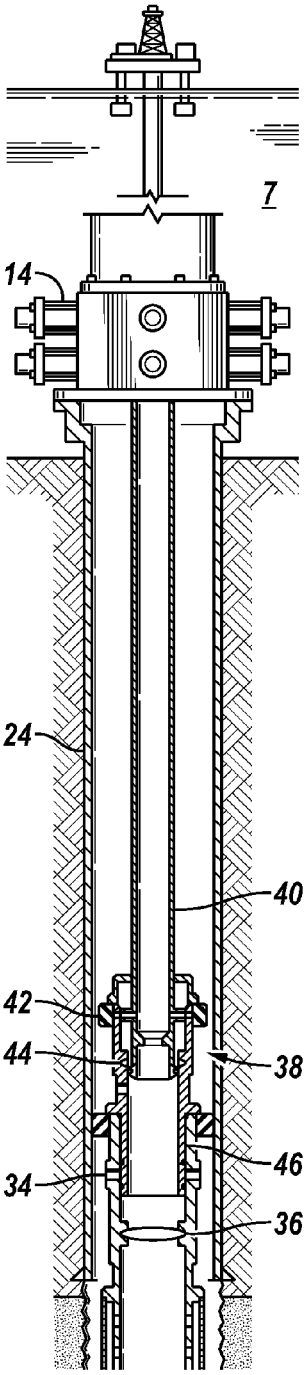
Figure 26:
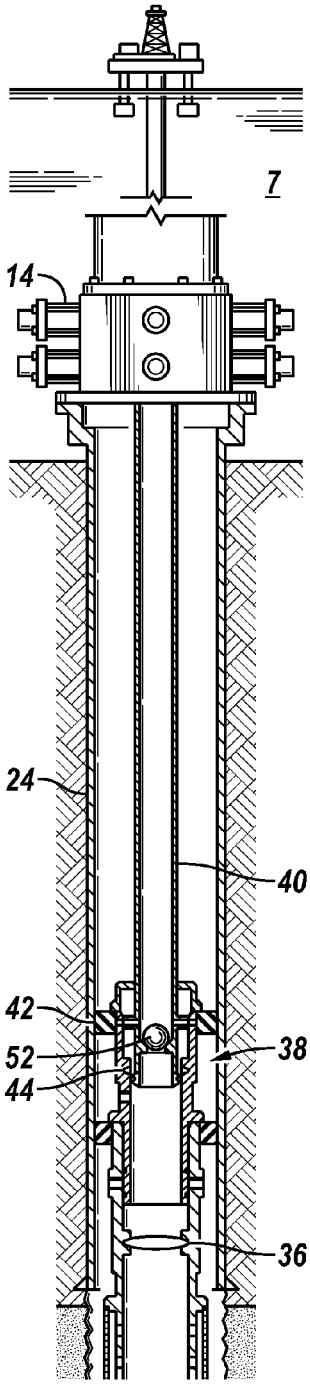

In FIG. 24 an intermediate completion 38 is RIH on a deployment tool 40. In this example, intermediate completion 38 includes an intermediate packer 42, a formation isolation valve (FIV) type barrier valve 44 (FIG. 27), and a straddle seal assembly 46. FIV barrier valve 44 may be a dual trip saver valve wherein the valve may be opened two times in response to applied pressure in the well without requiring a shifting tool to open the valve. The illustrated deployment tool 40, for example tubing, includes an open-close shifting tool 48. Deployment tool 40 may not include an open-only shifting tool as depicted for example in FIG. 2.

Figure 27:
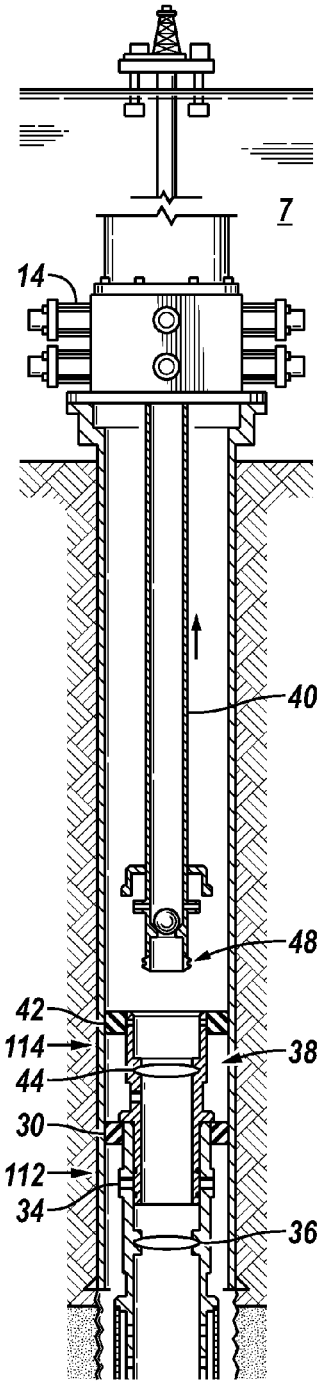
Figure 28:
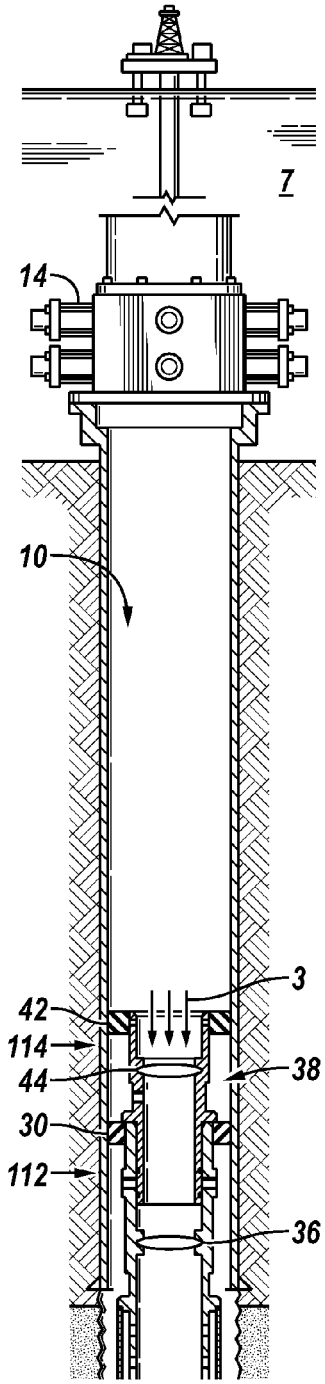

Referring in particular to FIGS. 24 to 27, intermediate completion 38 is RIH and mated with lower completion 26 with straddle seal assembly 46 sealing gravel packing port 34. Lower barrier valve 36 remains closed. A ball 52 is dropped (FIG. 26) and intermediate packer 42 is set to engage casing 24. Deployment tool 40 is illustrated in FIG. 27 being pulled out of the hole (POOH) and intermediate FIV barrier valve 44 closed by open-close shifting tool 48. Two barriers are closed and in place in FIG. 27. With port 34 sealed, packer 30 and barrier valve 36 form a lower deep set barrier 112 and barrier valve 44 and intermediate packer 42 form a second, upper, deep set barrier 114. FIG. 28 illustrates deep set barrier 114, e.g. barrier valve 44, being pressure tested, illustrated by the arrow 3, to ensure seal integrity. The integrity of lower barrier valve 36 can be verified, for example by pressure testing, prior to closing barrier valve 44.

Figure 29:
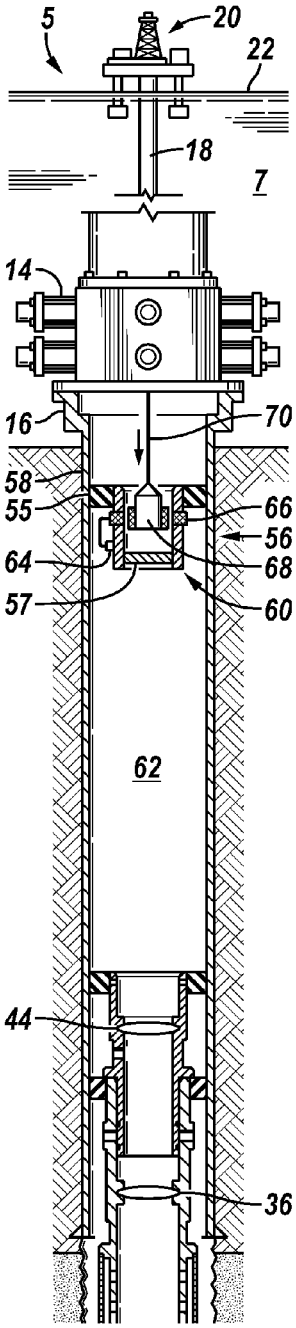

FIG. 29 illustrates a shallow set barrier 56 landed in casing 24. For example, shallow set barrier 56 is set in the section 58 of the well in which the production completion may later be installed. Shallow set barrier 56 is illustrated including a packer 55 and plug 57. Shallow set barrier 56 may be formed by other devices, such as and without limitation a valve such as a mechanical formation isolation type valve.

The open water completion system 5 includes a monitoring system 60 to at least measure, i.e., gauge, and monitor pressure in area 62 between shallow set barrier 56 and the deep set barriers. Monitoring system 60 includes a sensor 64 coupled with a communication device 66, for example and without limitation an induction coupler or wet connect. Sensor 64 measures at least pressure and may gauge characteristics in addition to pressure, for example temperature and flow rate. In this example, monitoring system 60 is incorporated in shallow set barrier 56 with sensor 64 in communication with the area 62 between barrier 114 and the shallow set barrier 56.

In FIG. 29 a communication coupler 68 is illustrated RIH from water surface 22 on a deployment 70 and operationally coupled with communication device 66 thereby connecting sensor 64 with surface controls, for example rig 20. Deployment 70 may be, for example, wireline or tubing. Any fluctuation in pressure over time could be indicative of a leak in the barriers. In accordance to embodiments the barriers are independently testable, for example by pressure testing, and independently monitored.

Figure 30:
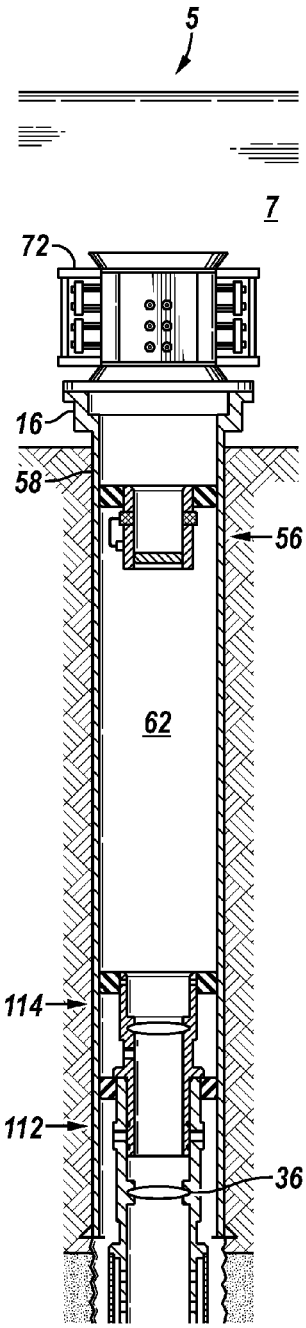

Once two independently verifiable barriers are in place the well may be suspended for a period of time, for example six months or more, until additional completion components (e.g. Christmas tree) are installed. FIG. 30 illustrates three barriers 112, 114 and shallow set barrier 56 in place. BOP stack 14 and marine riser 18 illustrated in FIG. 29 may be disconnected and removed from wellhead 16. A subsea or seabed isolation device (SID) 72, as shown in FIG. 30, may be connected to wellhead 16 in place of a BOP stack. A subsea isolation device may be similar to a subsea BOP stack but lacking for example the shear rams or another type of isolation device such s lower riser package. As will be understood by those skilled in the art with benefit of this disclosure, the subsea isolation device and BOP stack may be removed while the well is suspended in accordance with embodiments disclosed herein.

Figure 31:
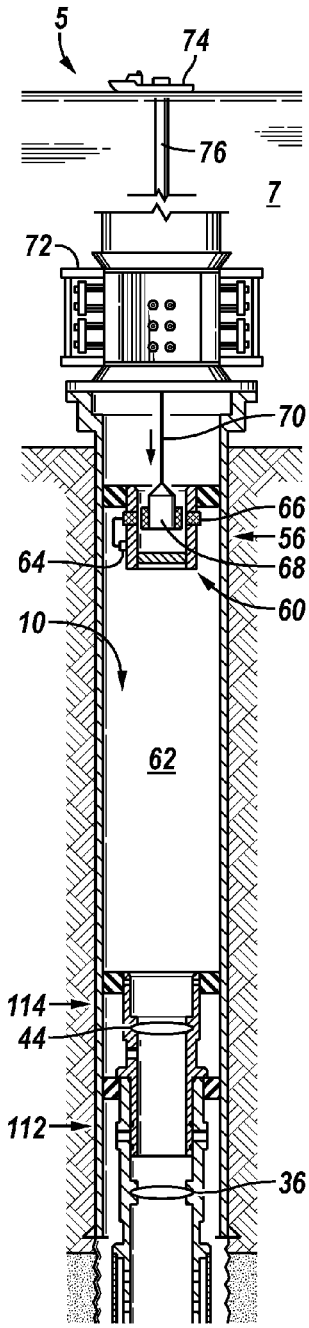
Figure 32:
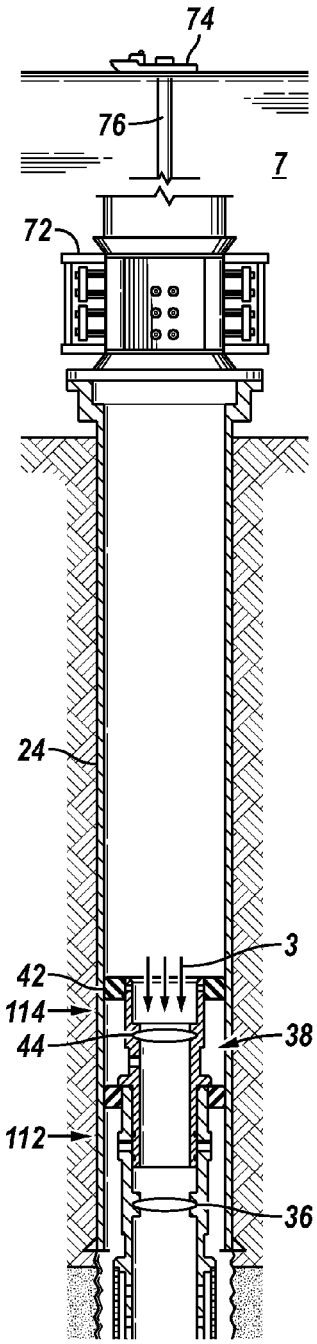

After the well has been suspended for a period of time the pressure in area 62 is checked to determine if there is a leak and verify the integrity of the barriers. For example, in FIG. 31 a surface vessel 74 is moved on site and a communication coupler 68 is deployed on a deployment 70 (e.g. tubing, wireline) into the well and connected with monitoring system 60. Communication coupler 68 is shown in FIG. 31 deployed through a riser 76 which may be an intervention or open water type of riser as opposed to a marine riser as utilized during drilling operations. At least the pressure in area 62 between shallow set barrier 56 and barrier 114 is checked to determine if there is a leak. Shallow set barrier 56 is retrieved after checking and confirming the integrity of the deep set barrier 114. Deep set barrier 114, i.e. barrier valve 44, is pressure tested as illustrated by the arrows 3 in FIG. 32.

Figure 33:
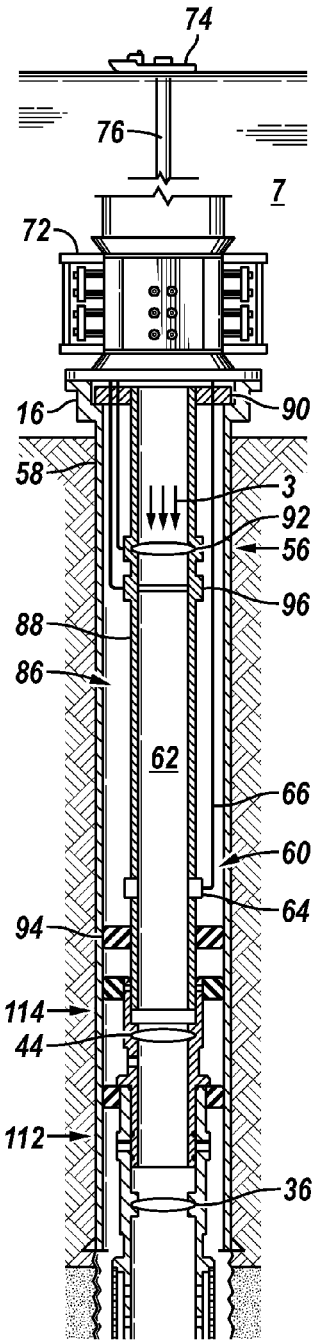

An upper completion 86, also referred to as a production completion, is RIH and landed as illustrated for example in FIG. 33 providing two deep set barriers 112, 114 and a shallow set barrier 56. Upper completion 86 can be RIH through SID 72, for example through an open water or intervention type riser 76 or through open water 7. Upper completion 86 includes, for example, tubing 88 suspended from a tubing hanger 90 landed at wellhead 16, a barrier valve 92 and a production packer 94. Shallow set barrier 56 is formed by barrier valve 92 and production packer 94 and/or tubing hanger 90 and is located in the upper section 58 of the well and can be tested independent of the deep set barriers. Barrier valve 92 is illustrated in FIG. 33 as a surface controlled formation isolation valve (SFIV). Production packer 94 may be located at a lower end of tubing 88 and landed above the deep set barriers. Upper completion 86 includes a surface controlled subsurface safety valve (SCSSV) 96 located proximate barrier valve 92 in FIG. 33 to block flow through tubing 88. Monitoring system 60 may be incorporated with upper completion 86. For example, sensor 64 may be integrated with tubing 88 to monitor pressure in the area 62 between deep set barrier 114 and shallow set barrier 56. Sensor 64 may sense pressure in tubing 88 bore and or the tubing-casing annulus. Sensor 64 may be connected to the surface receiver via communication device 66 illustrated as a cable in FIG. 33. Shallow set barrier 56 is pressure tested as illustrated by arrows 3 in FIG. 33.

Figure 34:
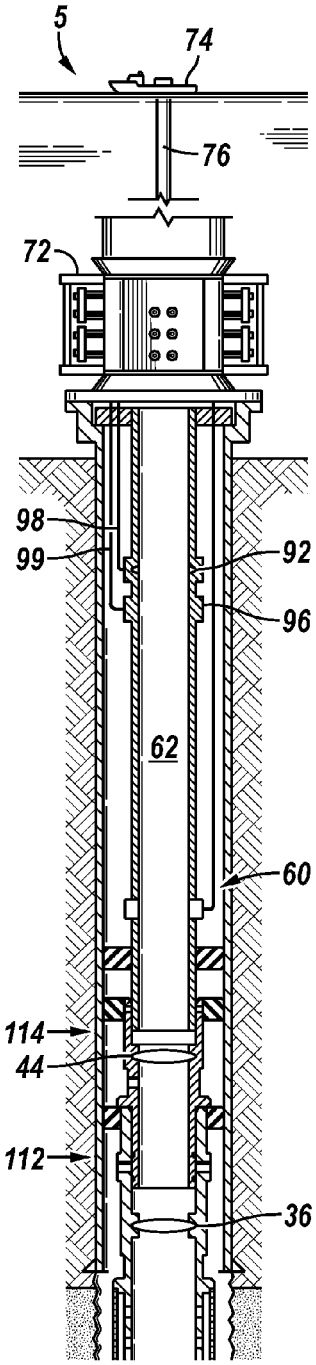
Figure 35:
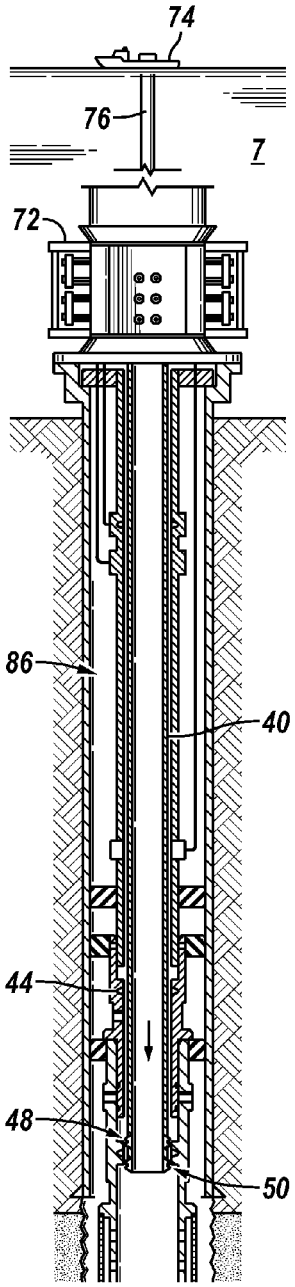

In FIG. 34 barrier valve 92 and subsurface safety valve 96 are opened. In FIG. 35 a deployment tool 40, for example coil tubing, having an open-close shifting tool 48 and an open only shifting tool 50 is RIH through upper completion 86 opening intermediate barrier valve 44 and lower barrier valve 36.

Figure 36:
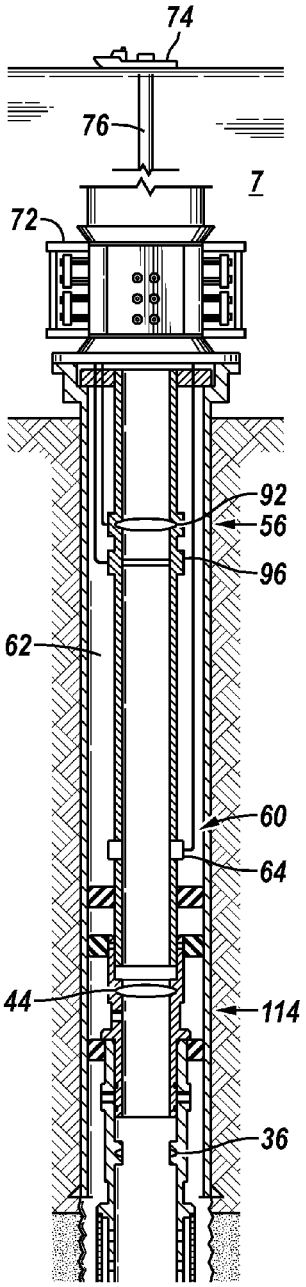

When deployment tool 40 is pulled out of the hole, open-close shifting tool 48 shifts intermediate barrier valve 44 back to the closed position as illustrated in FIG. 36. Upper completion barrier valve 92 is then actuated to the closed position and the well has two barriers in place. Subsurface safety valve 96 may be actuated to the closed position.

Figure 37:
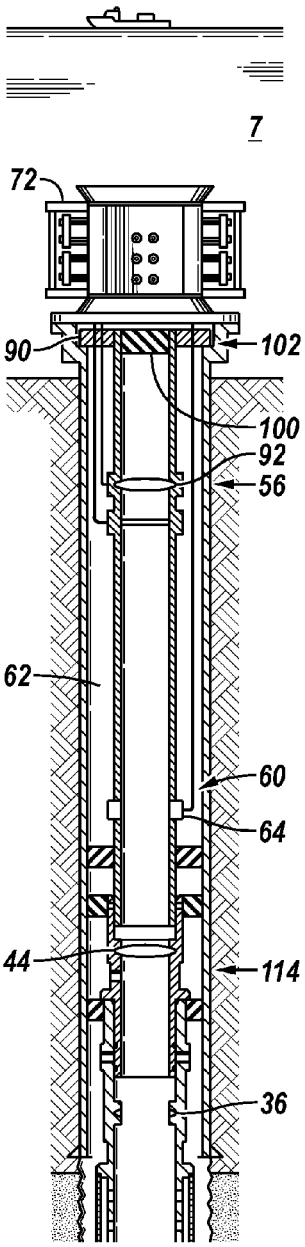

A suspension plug 100 may be landed in tubing hanger 90 as depicted in FIG. 37 providing an additional shallow set barrier 102. The well is suspended in FIG. 37 with three barriers in place. SID 72 may be removed and the well suspended, as previously described with reference to FIG. 17.

Figure 38:
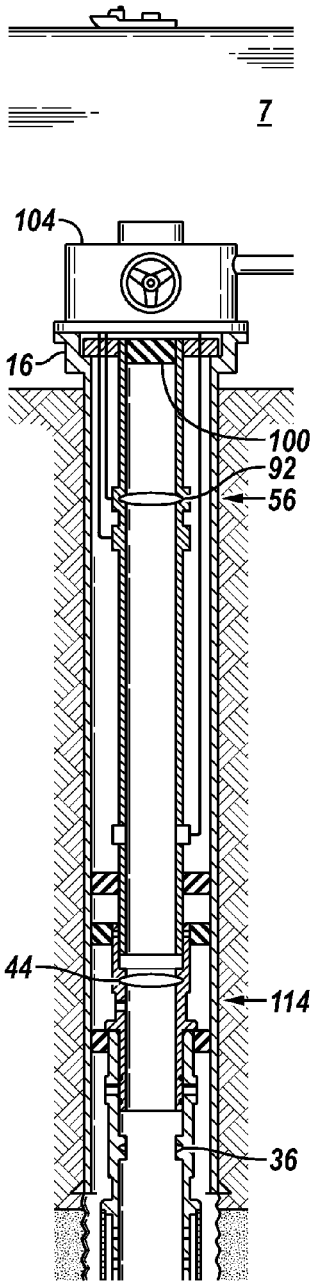
Figure 39:
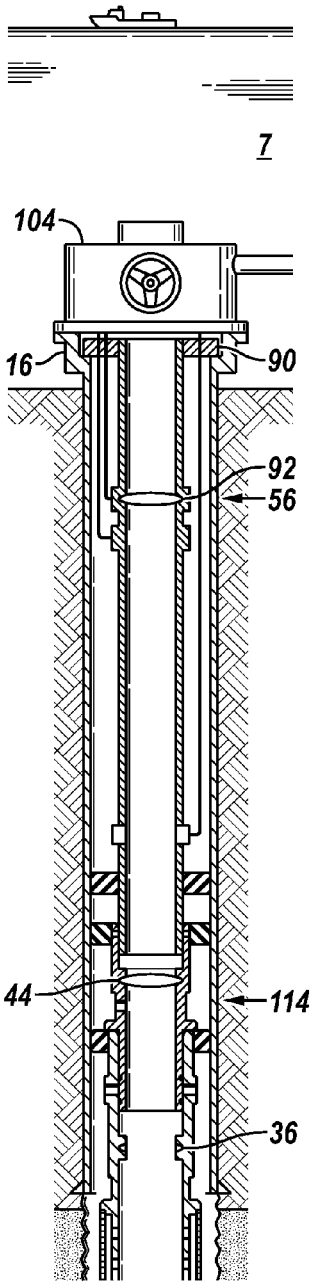
Figure 40:
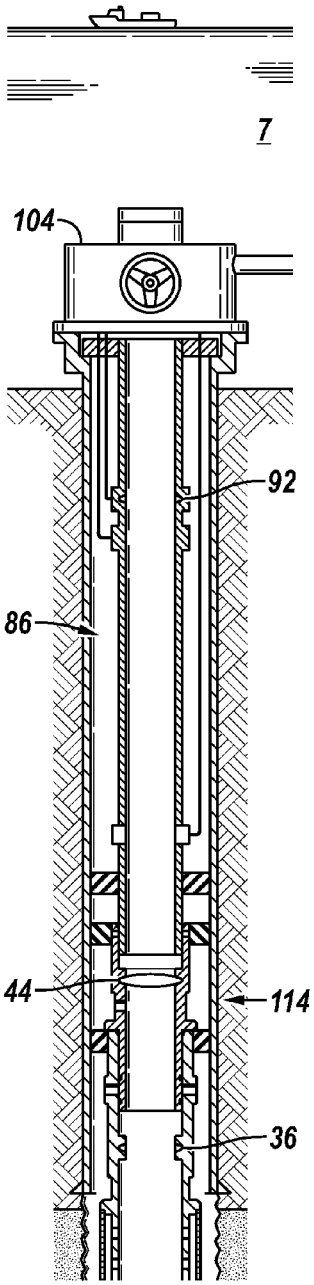
Figure 41:
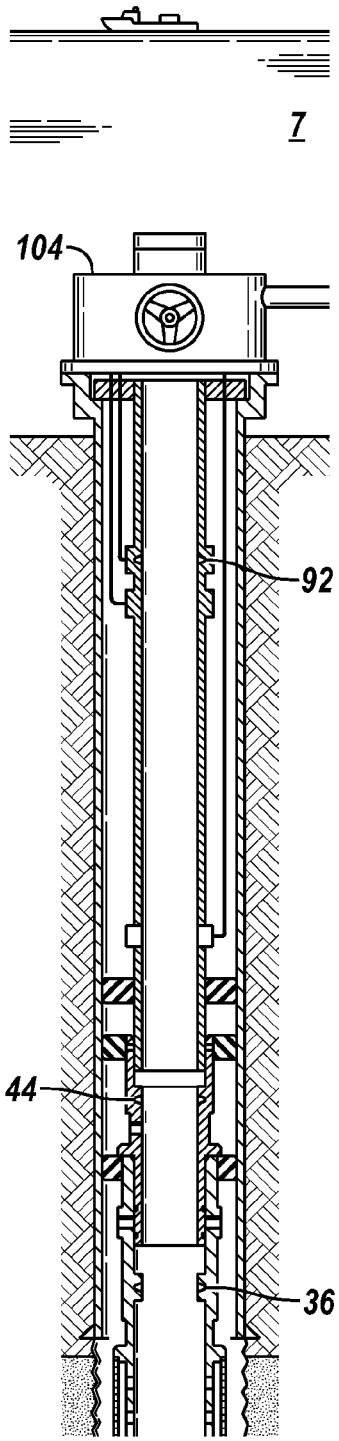
Figure 42:
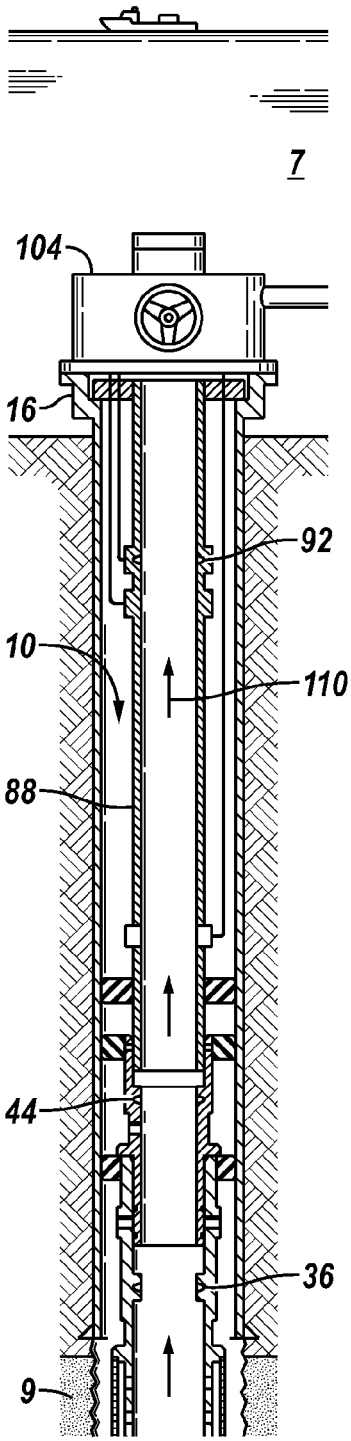

FIG. 38 illustrates a Christmas tree 104 landed on wellhead 16. Suspension plug 100 can then be retrieved as illustrated in FIG. 39. Upper completion barrier valve 92 is opened in FIG. 40. A tubing pressure signal can be applied opening intermediate barrier valve 44 as shown in FIG. 41. Barrier valve 44 may be a dual trip saver FIV permitting a second application of pressure to open the valve if the first attempt fails. FIG. 42 illustrates well 10 on production and producing fluid 110 from formation 9.

Referring now to FIGS. 43-55, an open water completion system is described in which dual barrier monitoring systems and methods in accordance to one or more embodiments are implemented. In accordance with an embodiment, a lower barrier is monitored and the lower barrier and the intermediate barrier may not be opened until after installation of a Christmas tree.

Figure 43:
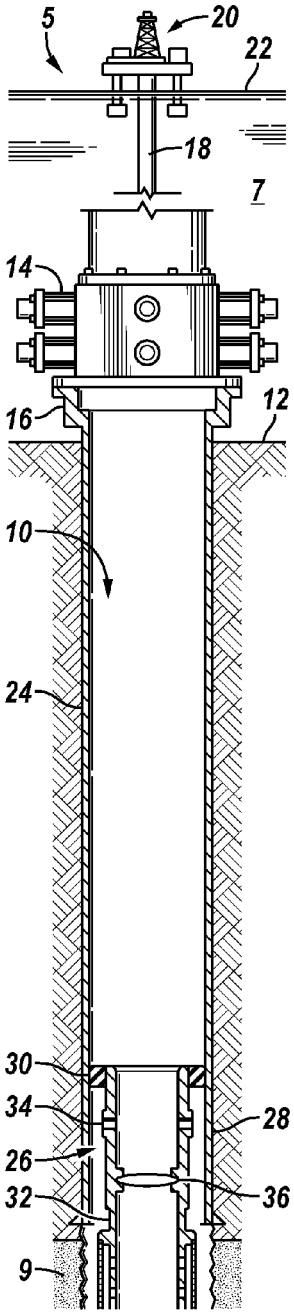
FIGS. 43-55 illustrate a dual barrier well completion system in accordance to one or more embodiments having a lower barrier that is monitored and the lower barrier may remain closed until after a Christmas tree is installed.

FIG. 43 illustrates an open water completion system, generally denoted by the numeral 5, having a subsea well or wellbore 10 drilled from a seabed 12 to an earthen formation 9. A blowout preventer (BOP) stack 14 has been landed on a wellhead 16 in the depicted well. BOP stack 14 commonly includes one or more sets of each of pipe rams to close on pipe, blind rams to close over an open wellbore, and shear rams to cut the pipe passing through the BOP stack. A marine riser 18 extends from BOP stack 14 to a surface rig 20 located at water surface 22. Surface rig 20 is illustrated in FIG. 43 as a platform and marine riser 18 may extend for example one-thousand feet or more through water 7. In accordance with some embodiments, BOP stack 14 may be located at the top of marine riser 18 and a subsea isolation device may be installed at wellhead 16. The A-annulus will be formed in casing 24 when the production tubing is installed.

FIG. 43 illustrates a lower completion 26 that has been run into the hole (RIH) and landed in a lower section 28 of casing 24 distal from wellhead 16. Lower completion 26 is illustrated as a sand control completion including a gravel pack packer 30, tubular 32 (i.e., casing, liner), gravel pack port 34, and a formation isolation valve (FIV) type of barrier valve 36. Barrier valve 36 and packer 30 form a lower deep set barrier 112 shown in FIG. 44.

Figure 44:
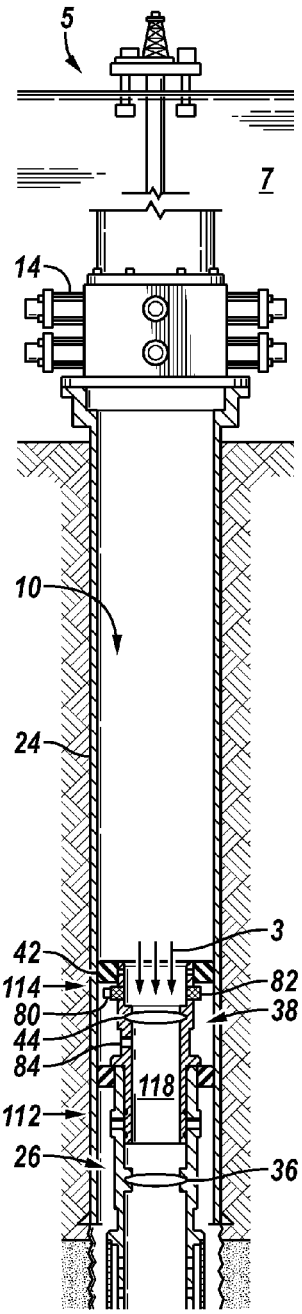

In FIG. 44 an intermediate completion 38 has been RIH and mated with lower completion 26 for example as described above with reference to FIGS. 24-27. An intermediate or upper deep set barrier 114 is formed by intermediate barrier valve 44 and packer 42. Lower deep set barrier 112 may be pressure tested prior to closing barrier valve 44.

A sensor 80 and communication device 82 are included in the intermediate completion 38 illustrated in FIG. 44. Sensor 80 is in monitoring communication with the area 118 between lower deep set barrier 112 and upper deep set barrier 114. Sensor 80 senses and monitors at least pressure and may measure additional characteristics including without limitation temperature and flow rate. Deep set sensor 80 is in communication with tubular bore portion of area 118 via port 84 in FIG. 44. Communication device 82 is coupled with sensor 80 and is illustrated as a wet connector or induction coupler. Upper deep set barrier 114 is pressure tested as illustrated by the arrow 3.

Figure 45:
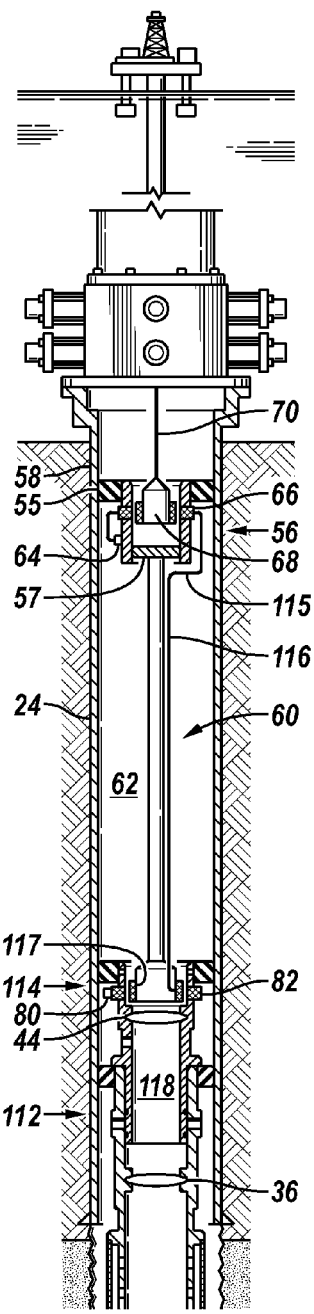

FIG. 45 illustrates a shallow set barrier 56 landed in casing 24. Shallow set barrier 56 is landed at a location uphole closer to wellhead 16 than the deep set barrier(s). For example, shallow set barrier 56 is set in the section 58 of the well in which the production completion may be landed. Shallow set barrier 56 is illustrated including a packer 55 and plug 57. Shallow set barrier 56 may be formed by other devices, such as and without limitation a valve such as a mechanical formation isolation type valve. Three barriers 56, 114, 112 are in place in FIG. 45.

The open water completion system 5 includes a monitoring system 60 to at least measure and monitor pressure in the area 62 between shallow set barrier 56 and deep set barrier 114 and to measure and monitor pressure in the area 118 below deep set barrier 114. Monitoring system 60 includes a shallow set sensor 64 and communication device 66 and deep set sensor 80 and communication device 82. Sensors 64 and 80 may monitor characteristics in addition to pressure, for example temperature and flow rate. In this embodiment, a wired connector 116 couples deep set sensor 80 to communication device 66. Wired connector 116 may be RIH with shallow set barrier 56. Wired connector 116 may be for example E-coil, digital slick line, or wireline having a top coupler 115 connected to communication device 66 and at a bottom coupler 117 connected to communication device 82. Wired connector 116 may include a structural support, for example a pipe. Communication device 82 may be a wireless type transmitter, for example as previously described with reference to FIG. 13.

In FIG. 45 a communication coupler 68 is illustrated RIH from water surface 22 on a deployment 70 and operationally coupled with shallow set communication device 66 thereby connecting sensor 64 and sensor 80 with the surface receiver and controls, for example rig 20. Deployment 70 may be, for example, wireline or tubing. Any fluctuation in pressure over time could be indicative of a leak in the barriers. In accordance to embodiments, the barriers are independently testable, for example by pressure testing, and independently monitored.

Once two independently verifiable barriers are in place the well may be suspended for a period of time, for example six months or more, until additional completion components (e.g. Christmas tree) are installed. Three barriers 56, 114, 112 are in-place in FIG. 45.

Figure 46:
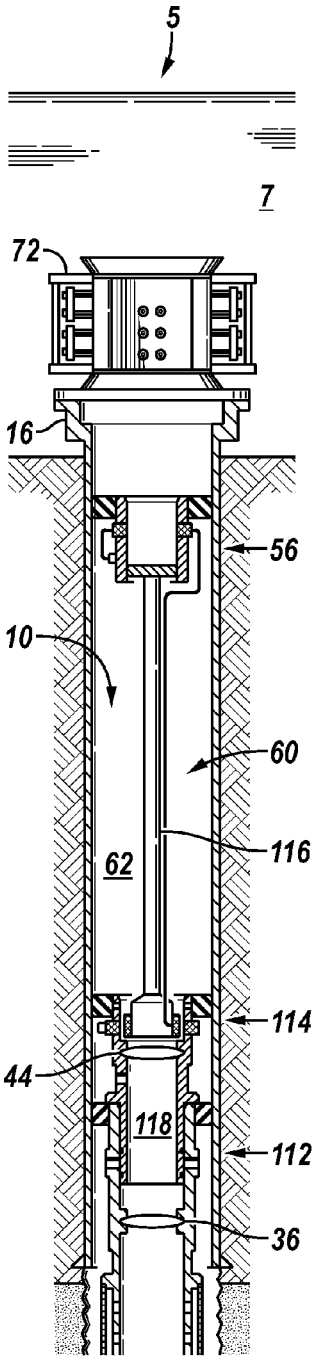

FIG. 46 illustrates the well 10 suspended and three barriers 112, 114, 56 in place. BOP stack 14 and marine riser 18 illustrated in FIG. 45 may be disconnected and removed from wellhead 16. A subsea or seabed isolation device (SID) 72, as shown in FIG. 46, may be connected to wellhead 16 in place of a BOP stack.

Figure 47:
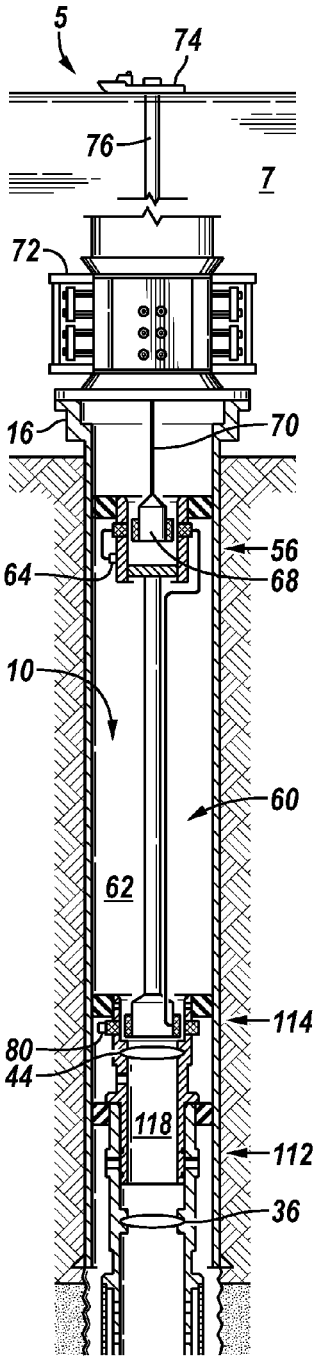
Figure 48:
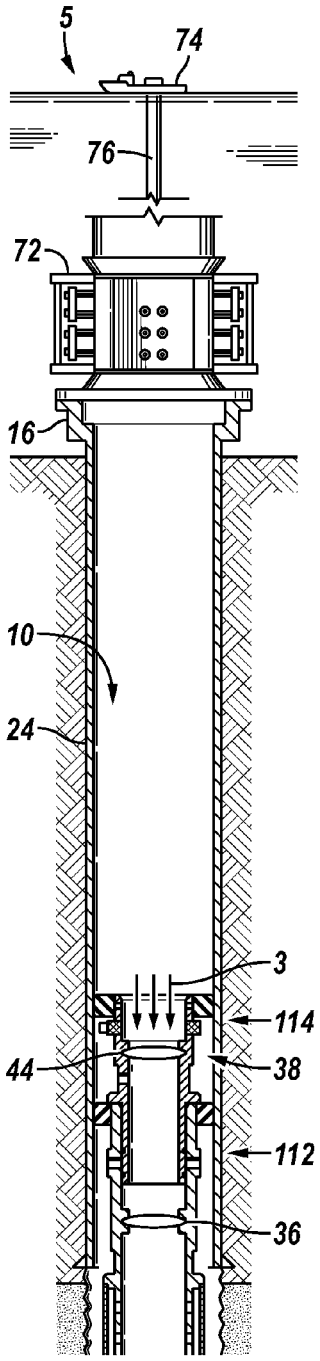

After the well has been suspended for a period of time, pressure in area 62 and 118 can be checked to determine if there is a leak. For example, in FIG. 47 a surface vessel 74 is moved on site and a communication coupler 68 is deployed on a deployment 70 (e.g. tubing, wireline) into the well and connected with monitoring system 60. Communication coupler 68 is shown in FIG. 47 deployed through a riser 76 which may be an intervention type or open water type of riser as opposed to a marine riser as utilized during drilling operations. At least the pressure in area 62 between shallow set barrier 56 and the deep set barrier(s) is checked to determine if there is a leak. The pressure in area 118 between the upper deep set barrier 114 and lower deep set barrier 112 can be checked via sensor 80. After checking the integrity of the barriers, shallow set barrier 56 is retrieved leaving two barriers 112, 114 in place as shown in FIG. 48. Upper deep set barrier 114, e.g. barrier valve 44, is pressure tested as shown by arrows 3.

Figure 49:
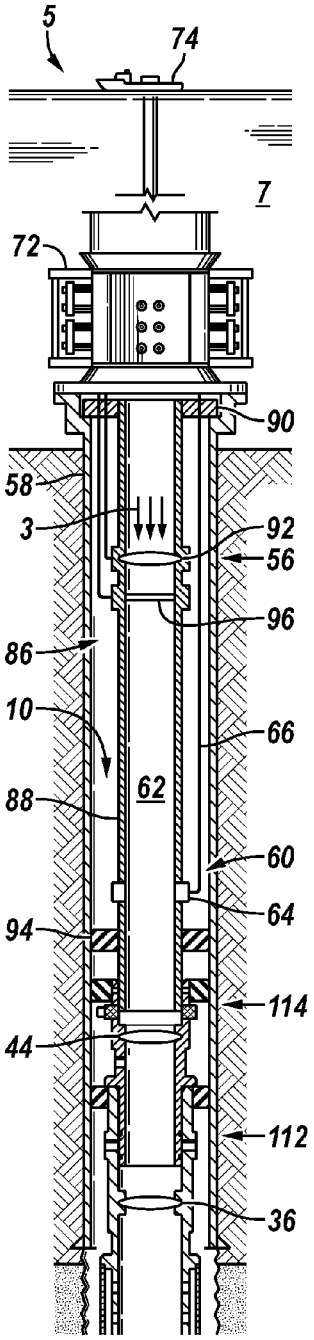

An upper completion 86, also referred to as a production completion, is RIH and landed as illustrated for example in FIG. 49 providing two deep set barriers 112, 114 and shallow set barrier 56. Upper completion 86 can be RIH through SID 72, for example through an open water or intervention type riser 76 or through open water 7. Upper completion 86 includes, for example, tubing 88 suspended from a tubing hanger 90 landed at wellhead 16, and a barrier valve 92, e.g. formation isolation valve, and a production packer 94. Shallow set barrier 56 is formed by barrier valve 92 and production packer 94 and is located in the upper section of the well and can be tested independent of the deep set barrier(s). Barrier valve 92 is illustrated in FIG. 49 as a surface controlled formation isolation valve (SFIV). Production packer 94 may be located at a lower end of tubing 88 and landed above the deep set barriers. Upper completion 86 includes a surface controlled subsurface safety valve (SCSSV) 96 located proximate barrier valve 92 in FIG. 49. Monitoring system 60 may be incorporated with upper completion 86. For example, sensor 64 may be integrated with tubing 88 to monitor pressure in the area 62 between deep set barrier 114 and shallow set barrier 56. Sensor 64 may sense pressure in tubing 88 bore and or the tubing-casing annulus. Sensor 64 may be connected to the surface receiver via communication device 66 illustrated as a cable in FIG. 49 and or wirelessly. Shallow set barrier 56 is illustrated being pressure tested by arrows 3.

Figure 50:
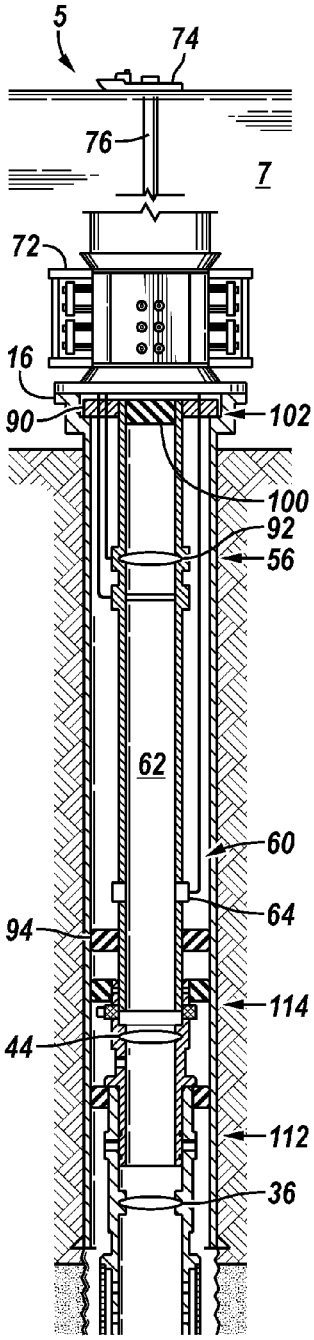
Figure 51:
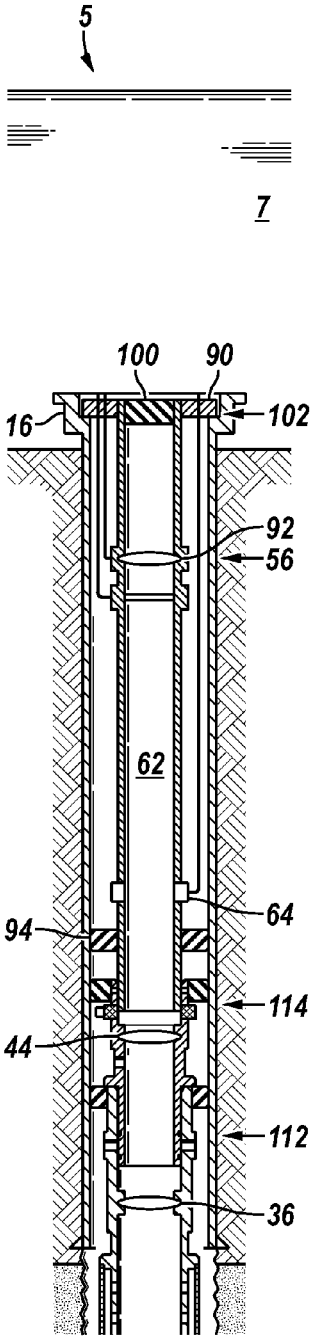

A suspension plug 100 may be landed in tubing hanger 90 as depicted in FIG. 50 providing an additional shallow set barrier 102. Four barriers 102, 56, 114, 112 are in place. SID 72 may be removed and the well suspended as illustrated for example in FIG. 51.

Figure 52:
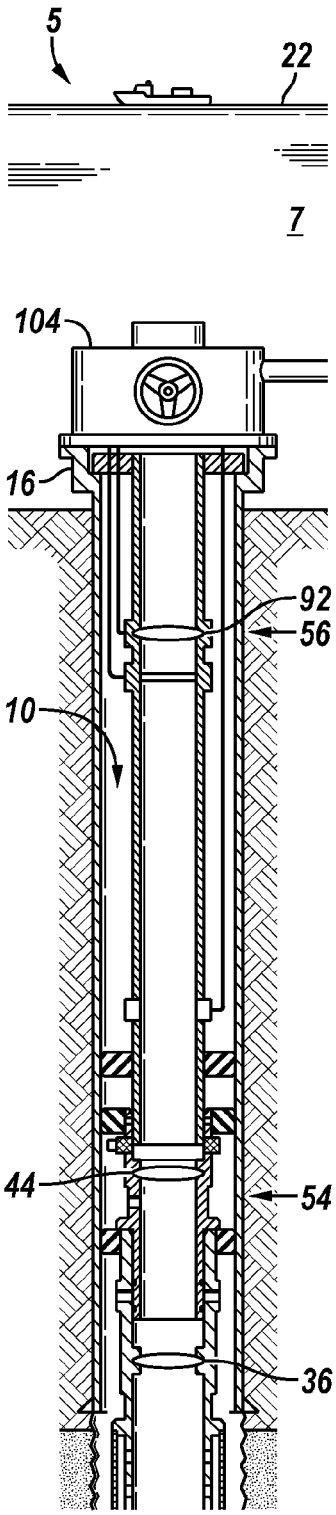
Figure 53:
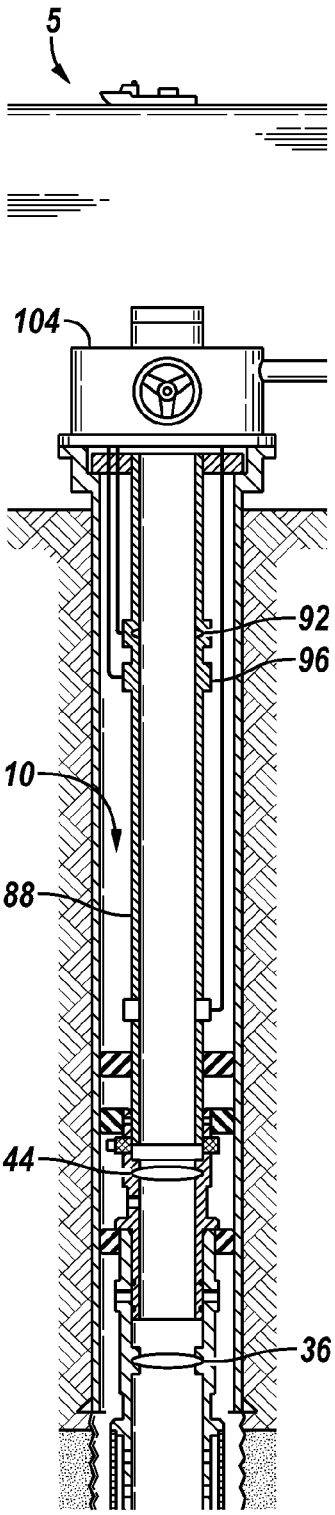
Figure 54:
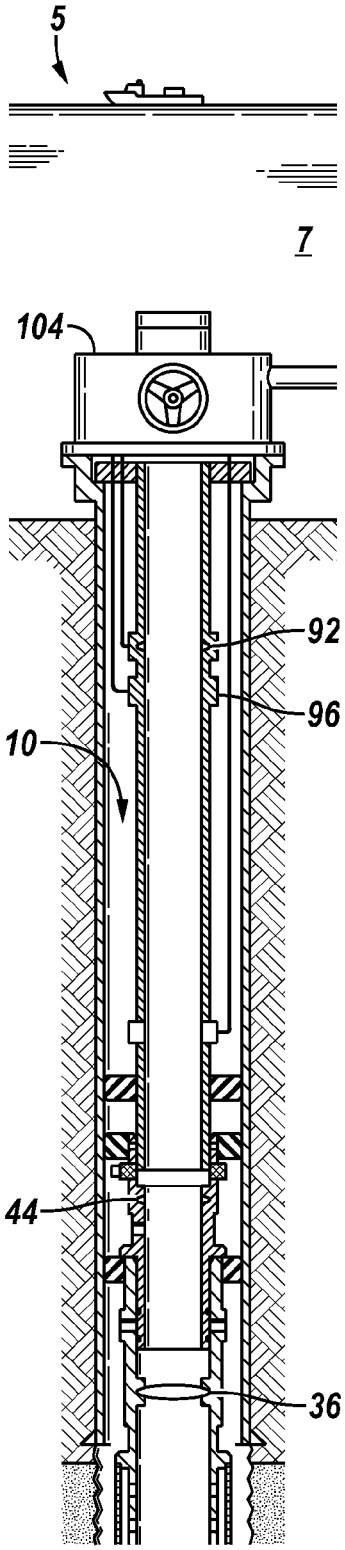
Figure 55:
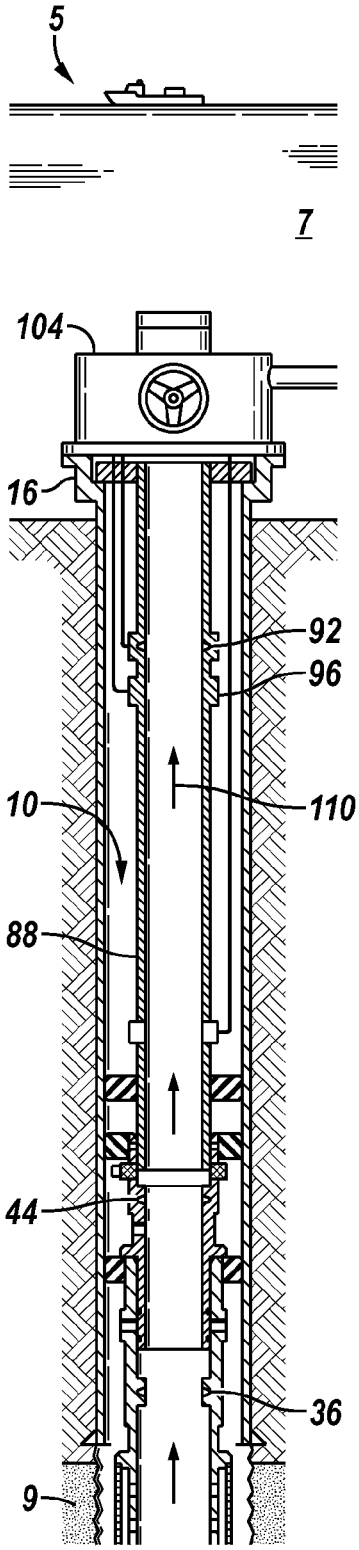

FIG. 52 illustrates a Christmas tree 104 landed on wellhead 16. Suspension plug 100 (FIG. 51) has been retrieved. Upper completion barrier valve 92 is opened in FIG. 53. A tubing pressure signal can be applied opening intermediate barrier valve 44 as shown in FIG. 54. Barrier valve 44 may be a dual trip saver FIV permitting a second application of pressure to open the valve if the first attempt fails. After intermediate barrier valve 44 is open, tubing pressure can be applied to open lower barrier valve 36 as illustrated in FIG. 55. FIG. 55 illustrates well 10 on production and producing fluid 110 from formation 9.

Referring now to FIGS. 56-68, an open water completion system is described in which dual barrier monitoring systems and methods in accordance to one or more embodiments are implemented. In accordance with an embodiment, there is monitoring between the barriers and the both lower barriers are opened after the installation of a Christmas tree 104.

Figure 56:
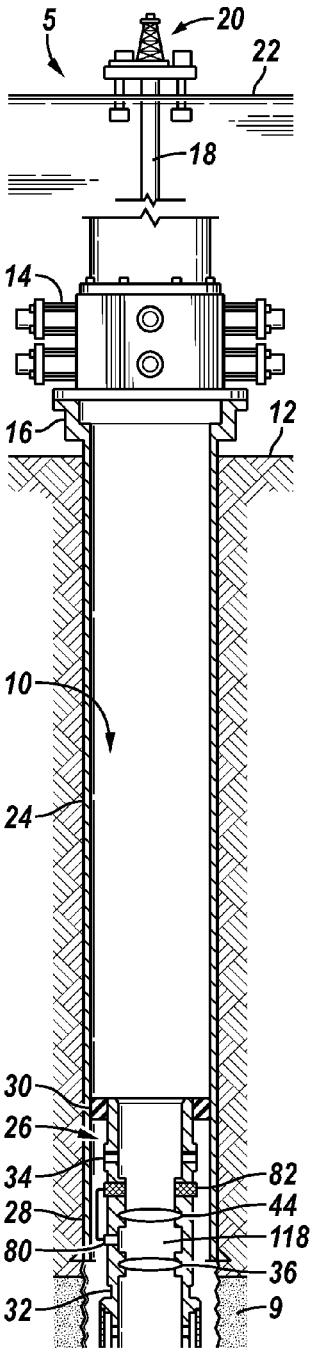
FIGS. 56-68 illustrate a dual barrier well completion system in accordance to one or more embodiments having two lower barriers that are opened after installation of a Christmas tree and monitoring between the barriers.

FIG. 56 illustrates an open water completion system, generally denoted by the numeral 5, having a subsea well or wellbore 10 drilled from a seabed 12 to an earthen formation 9. A blowout preventer (BOP) stack 14 has been landed on a wellhead 16 in the depicted well. A marine riser 18 extends from BOP stack 14 to a surface rig 20 located at water surface 22. Surface rig 20 is illustrated in FIG. 56 as a platform and marine riser 18 may extend for example one-thousand feet or more through water 7.

FIG. 56 illustrates a lower completion 26 (e.g. sand control completion) that has been run into the hole (RIH) and landed in a lower section 28 of casing 24 distal from wellhead 16.

Lower completion 26 is illustrated as a sand control completion including a gravel pack packer 30, tubular 32 (i.e., casing, liner), gravel pack port 34, and a lower formation isolation valve (FIV) type of barrier valve 36 and a second formation isolation valve 44 which may be referred to from time to time as an intermediate barrier valve 44. Lower completion 26 includes a sensor 80 in communication with an area 118 between lower barrier valve 36 and intermediate barrier valve 44. A communication device 82 is coupled with sensor 80 and located above intermediate barrier valve 44 which is located above lower barrier valve 36.

Figure 57:
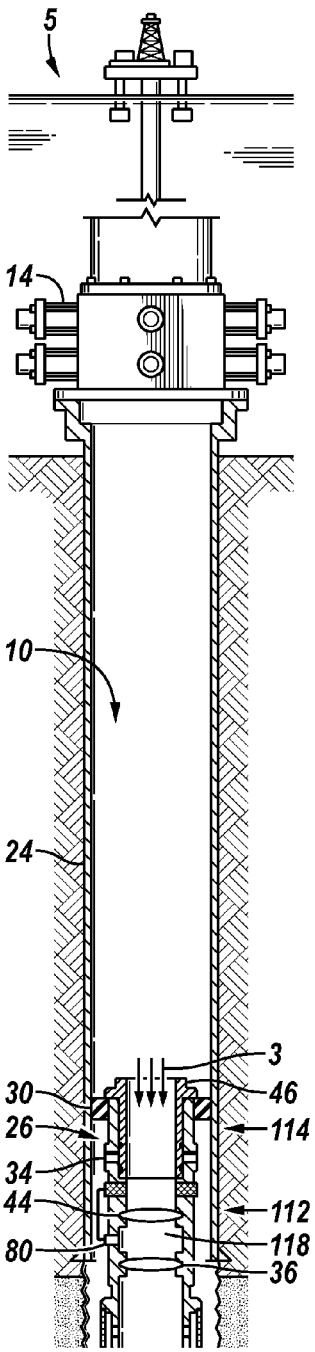

In FIG. 57 a straddle seal assembly 46, e.g. port closure sleeve (PCS), is illustrated landed in lower completion 26 and sealing gravel pack port 34. With gravel pack port 34 sealed a deep set barrier is formed by packer 30 and either of closed barrier valves 36, 44. For example, a lower deep set barrier 112 is formed by packer 30 and lower barrier valve 36 and an upper deep set barrier 114 is formed by packer 30 and upper or intermediate barrier valve 44. Pressure sensor 80 is in communication with the area 118 located between lower barrier valve 36 and intermediate barrier valve 44. Area 118 is the internal aria of lower completion 26 between closed barrier valve 36 and closed barrier valve 44 as illustrated in FIG. 57. Deep set barrier 114 is pressure tested as illustrated by the arrow 3.

Figure 58:
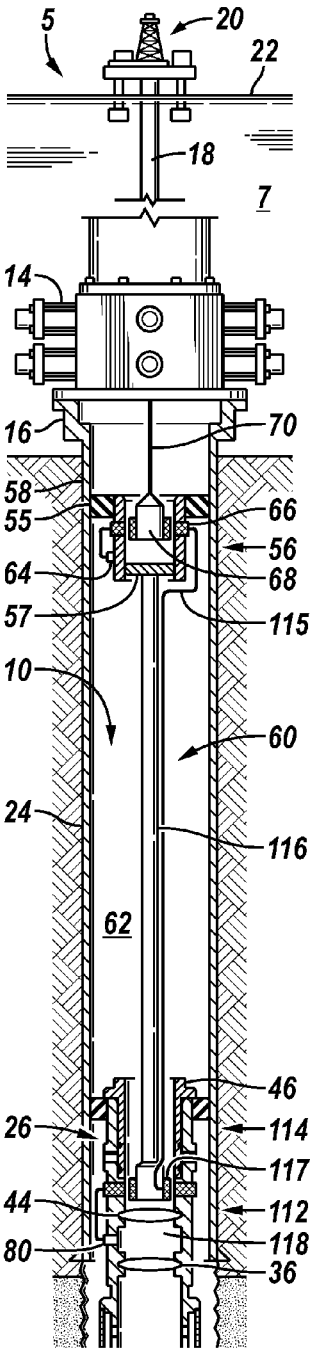

FIG. 58 illustrates a shallow set barrier 56 that has been RIH and landed in casing 24. Shallow set barrier 56 is landed at a location uphole and closer to wellhead 16 than the deep set barriers. For example, shallow set barrier 56 is set in the section 58 of the well in which the production completion may be landed. Shallow set barrier 56 is illustrated including a packer 55 and plug 57. Shallow set barrier 56 may be formed by other devices, such as and without limitation a valve such as a mechanical formation isolation type valve.

The open water completion system 5 includes a monitoring system 60 to at least measure and monitor pressure in area 62 between the shallow set barrier 56 and deep set barrier 114 to measure and monitor pressure in area 118 between lower and upper barriers 112, 114. Monitoring system 60 includes a shallow set sensor 64 and communication device 66 and deep set sensor 80 and communication device 82. Sensors 64 and 80 may monitor characteristics in addition to pressure, for example temperature and flow rate. In this embodiment, a wired connector 116 couples deep set sensor 80 to communication device 66. Wired connector 116 may be RIH with shallow set barrier 56. Wired connector 116 may be for example E-coil or wireline having a top coupler 115 connected to communication device 66 and at a bottom coupler 117 connected to communication device 82. Wired connector 116 may include a structural support, for example a pipe. Communication device 82 may be a wireless type transmitter, for example as previously described with reference to FIG. 13.

In FIG. 58 a communication coupler 68 is illustrated RIH from water surface 22 on a deployment 70 and operationally coupled with shallow set communication device 66 thereby connecting sensor 64 and sensor 80 with the surface controls, for example rig 20. Deployment 70 may be, for example, wireline or tubing. Any fluctuation in pressure over time could be indicative of a leak in the barriers. In accordance to embodiments, at least two barriers are independently testable, for example by pressure testing, and independently monitored.

Once two independently verifiable barriers are in place the well may be suspended for a period of time, for example six months or more, until additional completion components (e.g. Christmas tree) are installed. Three barriers are in-place in FIG. 58.

Figure 59:
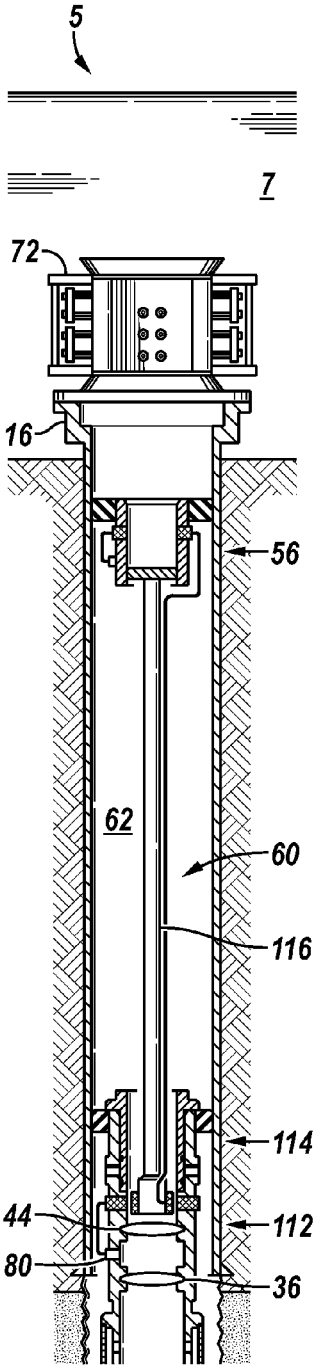
Figure 60:
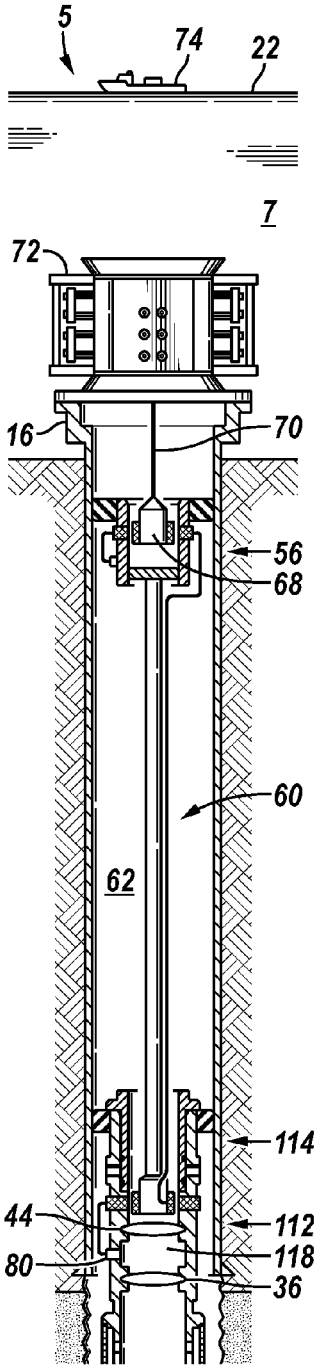
Figure 61:
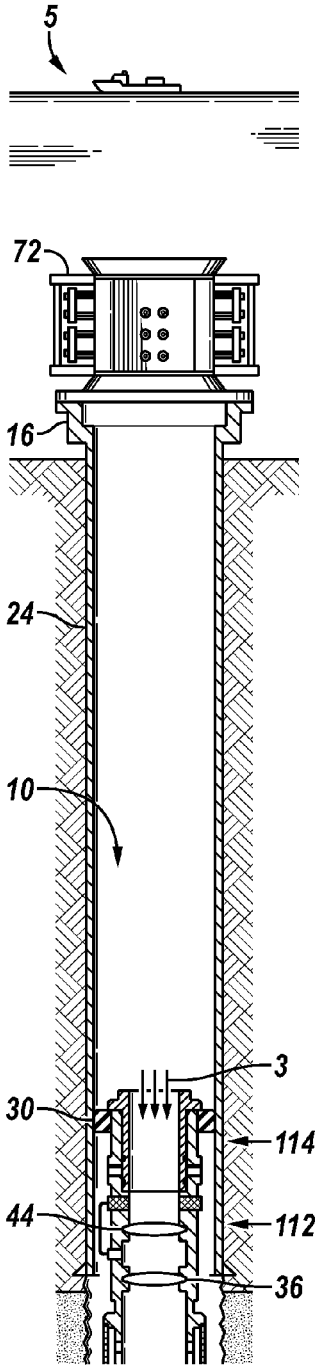

FIG. 59 illustrates the well suspended and two deep set barriers 112, 114 and shallow set barrier 56 in place. BOP stack 14 and marine riser 18 illustrated in FIG. 58 have been disconnected and removed from wellhead 16. A subsea or seabed isolation device (SID) 72, as shown in FIG. 59, may be connected to wellhead 16 in place of a BOP stack.

After the well has been suspended for a period of time the pressure in areas between the barriers is checked to determine if there is a leak. For example, in FIG. 60 a surface vessel 74 is moved on site and a communication coupler 68 is deployed on a deployment 70 (e.g. tubing, wireline) into the well and connected with monitoring system 60. Communication coupler 68 may be deployed through open water 7. At least the pressure in area 62 between shallow set barrier 56 and upper deep set barrier 114 is checked to determine if there is a leak. The pressure in area 118 between the deep set barriers 112, 114 can be checked via sensor 80. After checking the integrity of the barriers, shallow set barrier 56 is retrieved. Upper deep set barrier 114 is pressure tested as shown by arrows 3 in FIG. 61.

Figure 62:
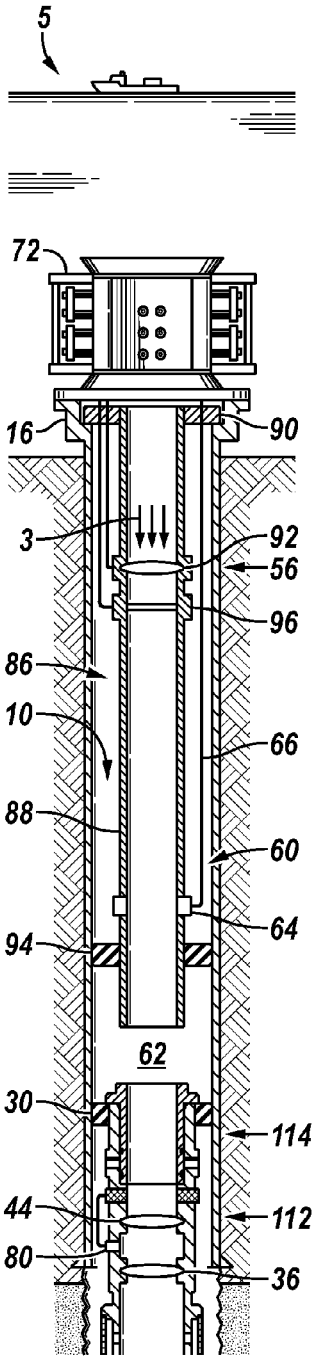

An upper completion 86, also referred to as a production completion, is RIH and landed as illustrated for example in FIG. 62 providing a shallow set barrier 56. Upper completion 86 can be RIH through SID 72, for example through an open water or intervention type riser or through open water 7. Upper completion 86 includes, for example, tubing 88 suspended from a tubing hanger 90 landed at wellhead 16, and a barrier valve 92, e.g. formation isolation valve, and a production packer 94. Shallow set barrier 56 is formed by barrier valve 92 and production packer 94 and is located in the upper section 58 of the well and can be tested independent of deep set barriers. Barrier valve 92 is illustrated in FIG. 62 as a surface controlled formation isolation valve (SFIV). Production packer 94 may be located at a lower end of tubing 88 and landed above deep set barriers 112, 114.

Upper completion 86 includes a surface controlled subsurface safety valve (SCSSV) 96 located proximate barrier valve 92. Monitoring system 60 may be incorporated with upper completion 86. For example, sensor 64 may be integrated with tubing 88 to monitor pressure in area 62 between shallow set barrier 56 and deep set barrier 114. Sensor 64 may sense pressure in tubing 88 bore and or the tubing-casing annulus. Sensor 64 may be connected to the surface receiver via communication device 66 illustrated as a cable in this example. Shallow set barrier 56 is illustrated, by arrows 3, being pressure tested.

Figure 63:
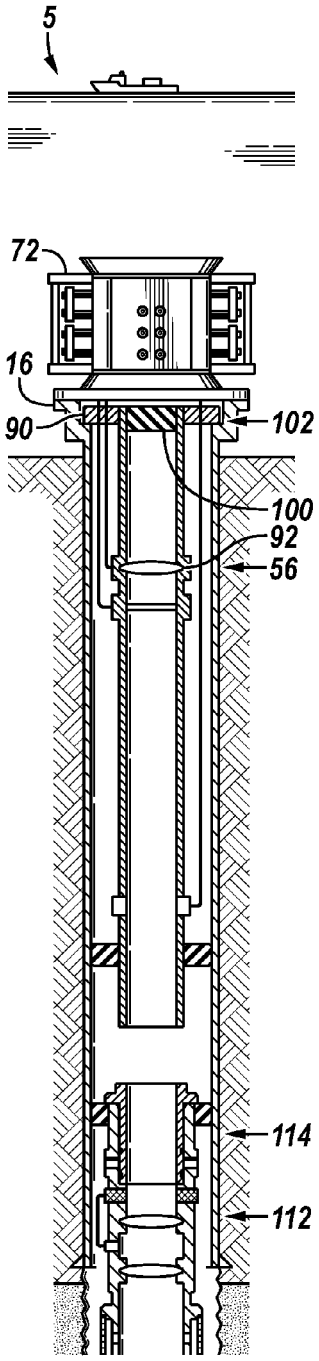
Figure 64:
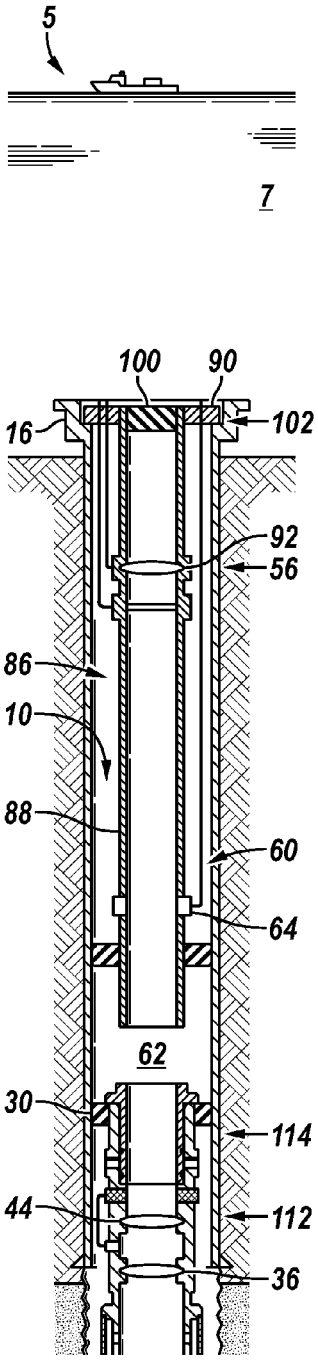

A suspension plug 100 may be landed in tubing hanger 90 as depicted in FIG. 63 providing an additional shallow set barrier 102. Four barriers 102, 56, 114, 112 are in place in FIG. 63. SID 72 may be removed and the well suspended, as illustrated for example in FIG. 64.

Figure 65:
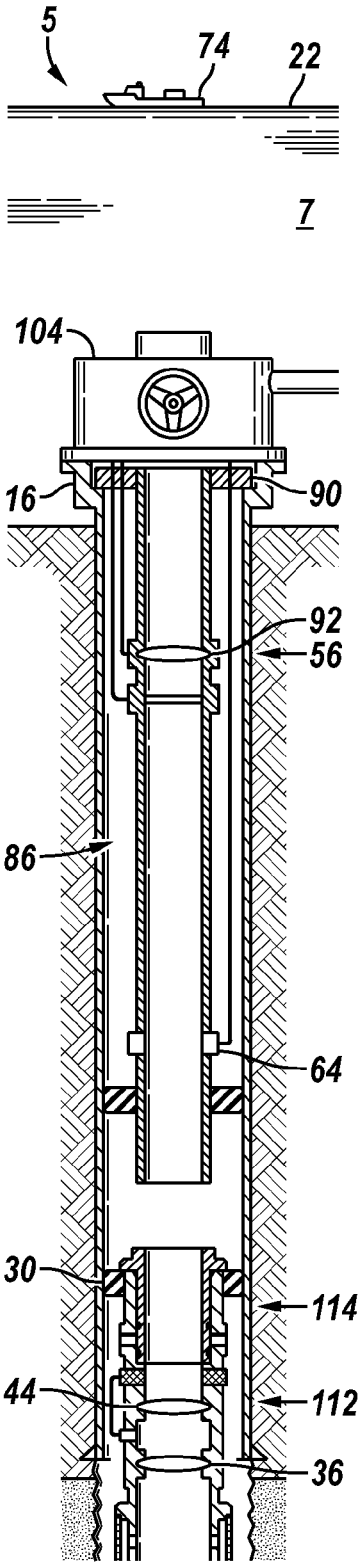
Figure 66:
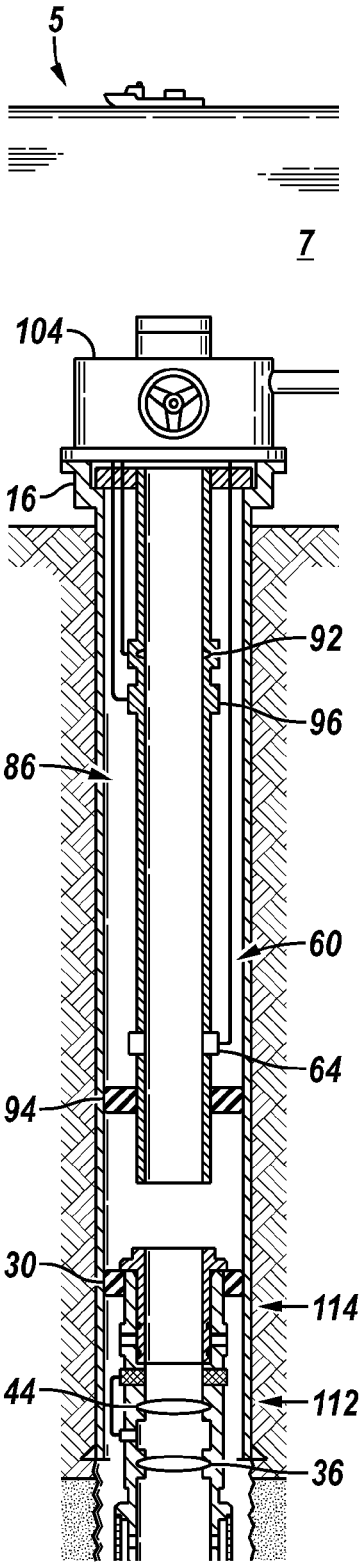

FIG. 65 illustrates a Christmas tree 104 landed on wellhead 16. Christmas tree 104 may be landed and installed through open water 7. Suspension plug 100 (FIG. 64) has been retrieved. In FIG. 66 upper completion barrier valve 92 and subsurface safety valve 96 have been opened.

Figure 67:
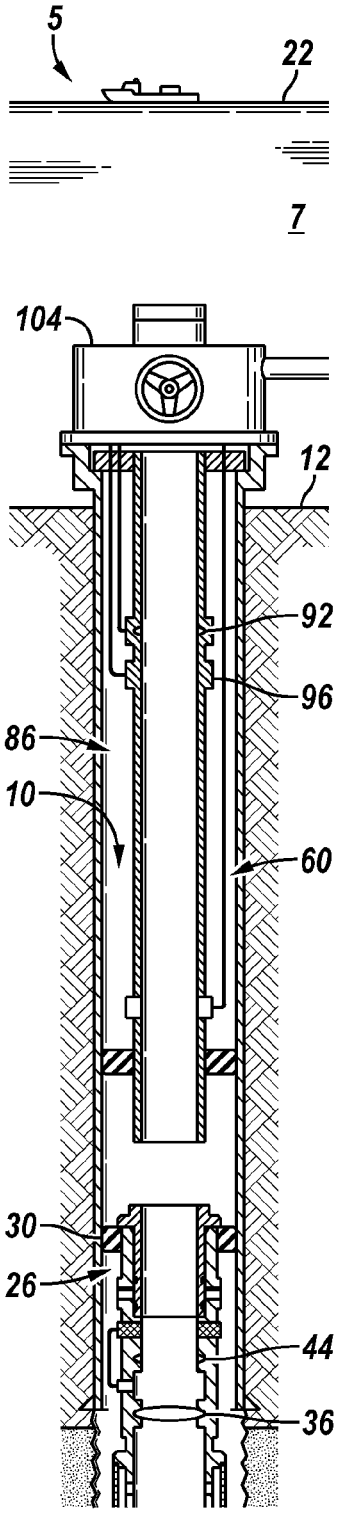
Figure 68:
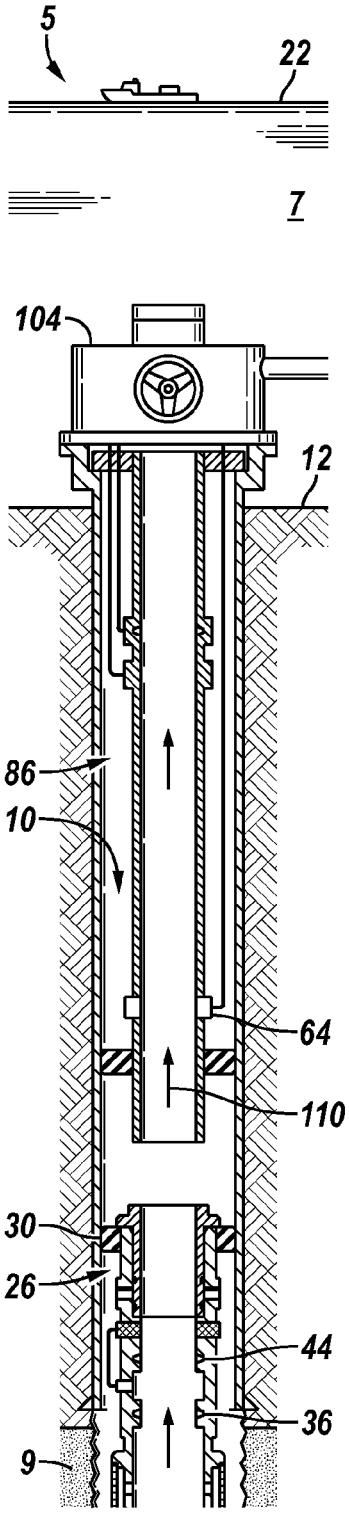

In FIG. 67 intermediate barrier valve 44 is illustrated open after applying a tubing pressure signal. FIG. 68 illustrates lower barrier valve 36 open after a tubing pressure signal was applied placing well 10 on production permitting fluid 110 to flow. In accordance with some embodiments, intermediate FIV barrier valve 44 and lower FIV barrier valve 36 may be opened at the same time.

Figure 69:
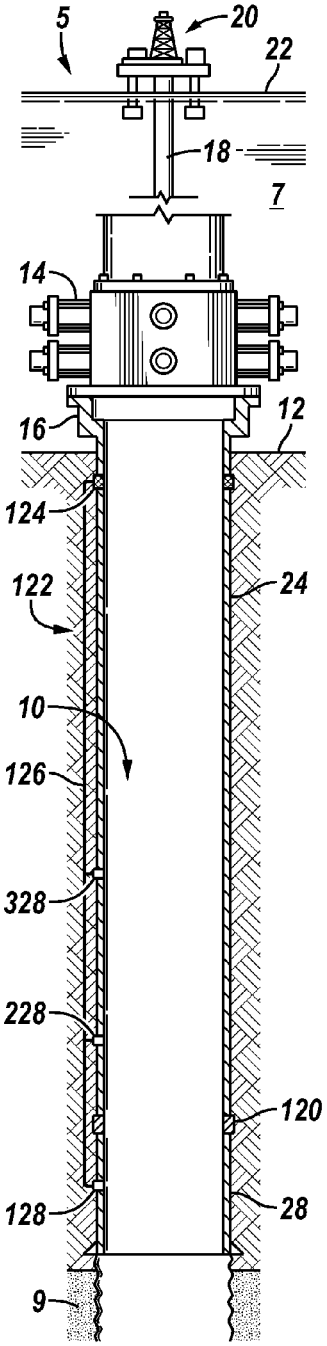
FIGS. 69-89 illustrate a dual barrier well completion system in accordance to one or more embodiments having a monitoring system installed behind the casing and monitoring between the barriers.

Referring now to FIGS. 69 to 89, in some embodiments the space between the barriers may be monitored with sensors and inductive couplers positioned behind the casing. In FIG. 69 a well 10 is drilled and casing 24 installed. Casing 24 may include one or more indexing casing coupling (ICC) 120 locators and a communication and sensing system, generally denoted by the numeral 122, installed behind casing 24. The behind casing communication system 122 includes a primary inductive coupler 124 or station 124 located uphole, for example, closer to wellhead 16 than to formation 9, for connecting with a service inductive coupler positioned in the well. Primary inductive coupler 124 is connected via an electrical conductor 126 to one or more sensors and secondary inductive couplers located behind casing 24 and downhole from primary inductive coupler 124. For example, in FIG. 69 primary inductive coupler 124 is connected to spaced apart sensors 128, 228, 328. In the illustrated embodiment, sensors 128, 228, 328 read at least pressure inside of casing 24 (i.e., in well 10). Communication system 122 may also include sensors that measure for example pressure outside of casing 24 (e.g. the B-annulus). Sensors 128, 228, 328, etc. may be WellNet (Schlumberger Limited) type sensors for example. FIG. 69 illustrates a BOP stack 14, e.g. drilling BOP, connected to wellhead 16 at seabed 12 and a marine riser 18 extending between BOP stack 14 and rig 20 located at water surface 22.

Figure 70:
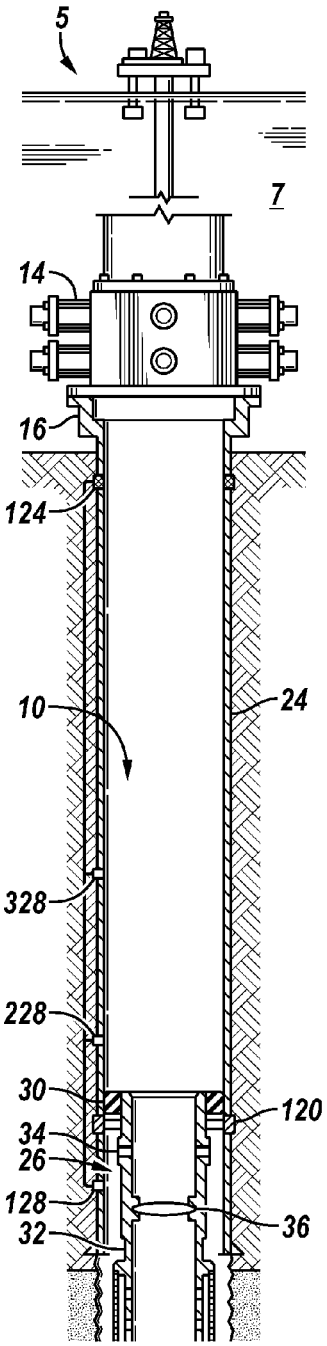
Figure 71:
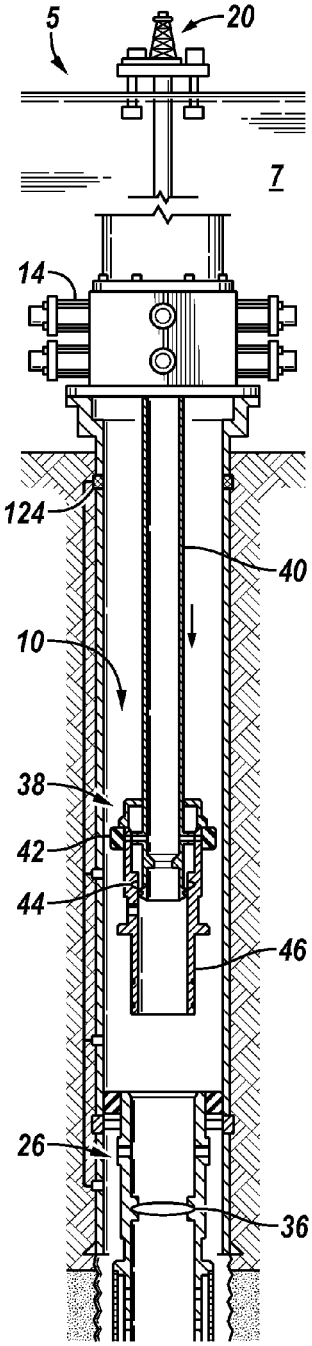

In FIG. 70 a lower completion 26 is RIH and landed in lower section 28 of casing 24 and well 10. Lower completion 26 is set with packer 30 engaging casing 24. ICC 120 may be utilized to locate and set packer 30 in the desired position. Sensor 128 is located below packer 30 and may be utilized for example to monitor the reservoir pressure and temperature. FIG. 71 illustrates intermediate completion 38 being RIH on a deployment tool 40 with the intermediate barrier valve 44, for example a dual trip saver FIV, in the open position. In accordance with some embodiments, deployment tool 40 includes a service inductive coupler 130 (FIG. 72) in communication with a surface receiver, represented by rig 20, via communication line 132.

Figure 72:
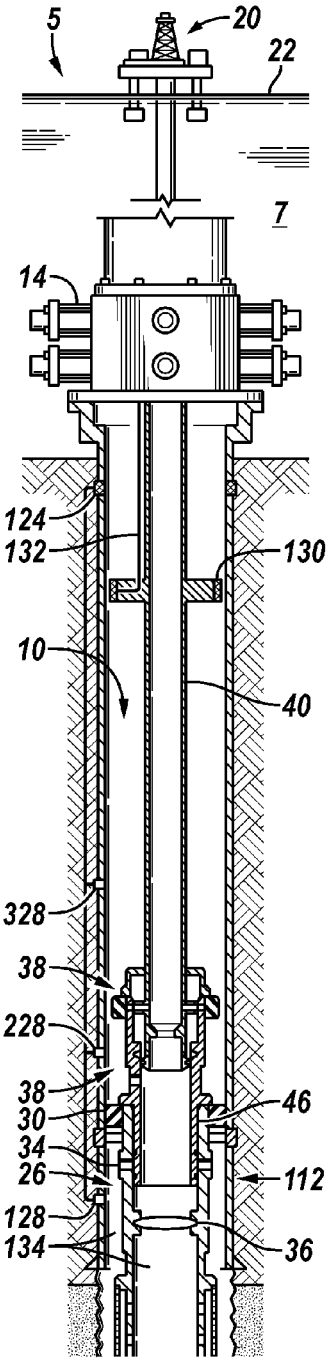
Figure 73:
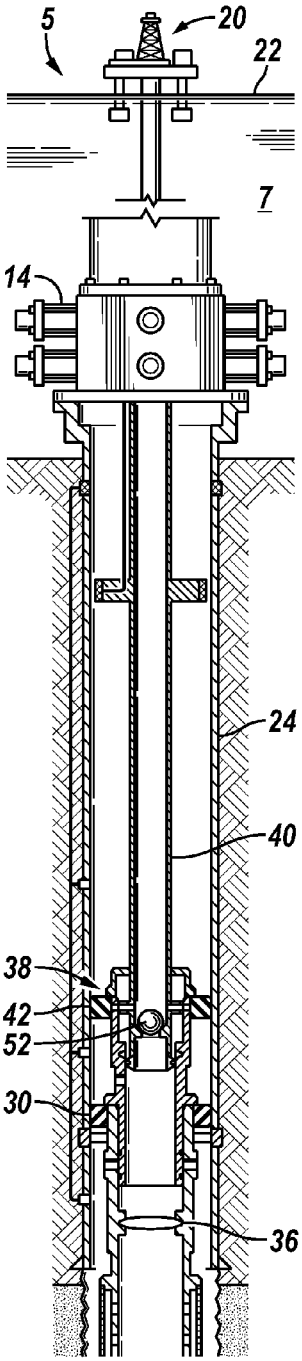

In FIG. 72 intermediate completion 38 is landed on, or mated with, the lower completion such that gravel pack port 34 is sealed for example by straddle seal assembly 46. Packer 30 and barrier valve 36 form a lower deep set barrier 112 with gravel pack port 34 sealed. Behind casing sensor 128 is set to monitor at least pressure, i.e. reservoir pressure, in the area 134 below lower deep set barrier 112. Lower deep set barrier 112 can be pressure tested to ensure sealing integrity.

Figure 74:
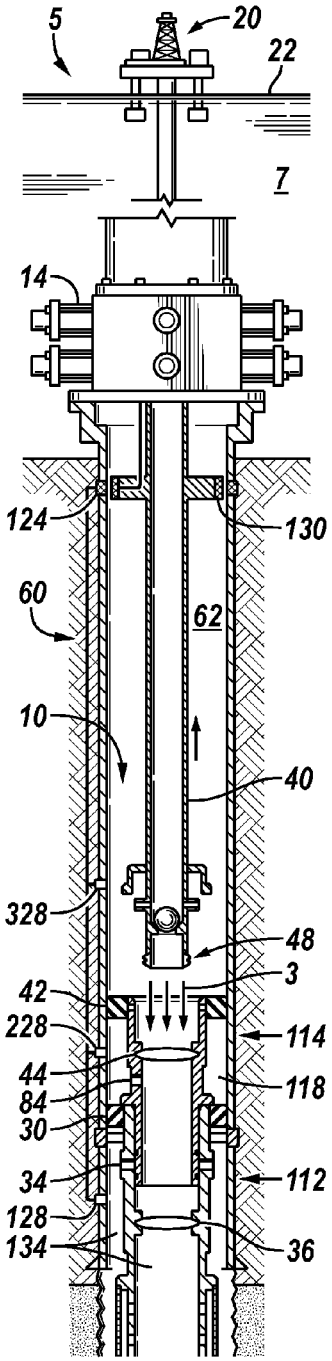

A ball 52 (FIG. 73) is dropped and fluid can be pumped through deployment tool 40 to set intermediate packer 42 in sealing engagement with casing 24. In FIG. 74 deployment tool 40 is retrieved to a position coupling male service inductive coupler 130 with primary inductive coupler 124. Shifting tool 48 closes intermediate barrier valve 44 as deployment tool 40 is raised. Intermediate packer 42 and barrier valve 44 form an upper deep set barrier 114.

Still referring to FIG. 74, upper deep set barrier 114 is pressure tested as illustrated by the arrows 3. Monitoring system 60 provides for pressure monitoring in well 10 and between barriers 112 and 114 during pressure testing. Male service inductive coupler 130 is communicatively coupled with primary inductive coupler 124 thereby coupling the surface receiver, e.g. rig 20, with sensors 128, 228, 328. Sensor 128 is in sensing communication with area 134 below lower deep set barrier 112 and sensor 228 is in sensing communication with area 118 between lower deep set barrier 112 and upper deep set barrier 114. Sensor 328 is in sensing communication with area 62 above upper set barrier 114.

Figure 75:
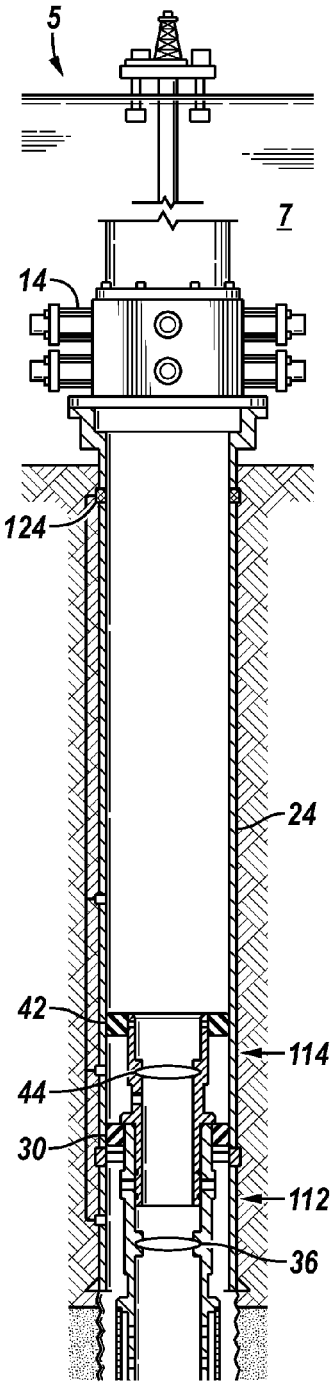
Figure 76:
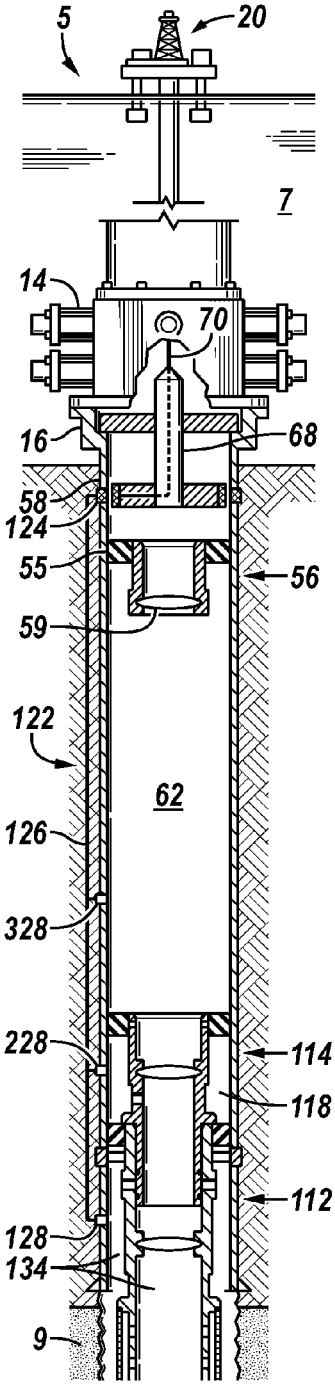
Figure 77:
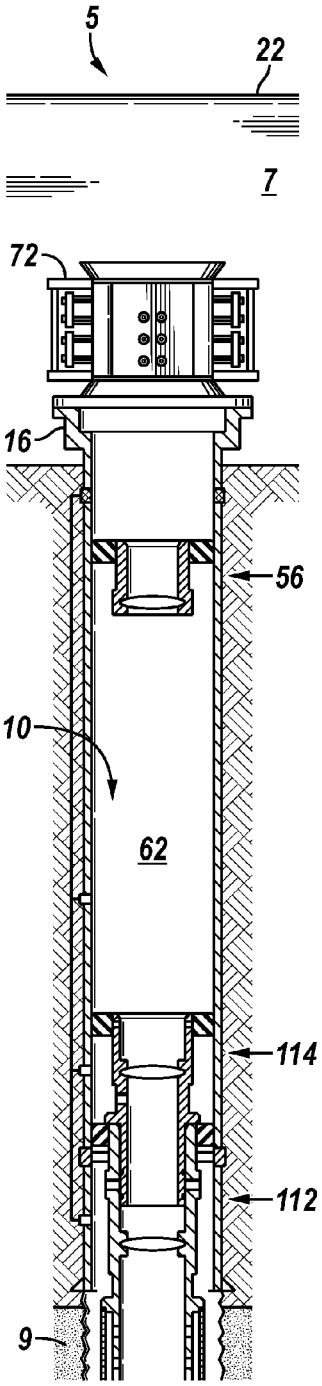

FIG. 75 illustrates the well after the deployment tool has been retrieved and with two barriers 112, 114 in place. Lower deep set barrier 112 and upper deep set barrier 114 are each independently tested and each may be monitored independently. In FIG. 76 an operator comes back and RIH and installs a shallow set barrier 56, for example including a plug or packer 55 and mechanical formation isolation barrier valve 59, in upper completion section 58. A communication coupler 68, for example a male service inductive coupler, is RIH and mated with primary inductive coupler 124 and at least pressure is checked between the barriers. For example, sensor 128 monitors pressure in area 134 below lower deep set barrier 112, sensor 228 monitors pressure in area 118 between lower deep set barrier 112 and upper deep set barrier 114, and sensor 328 monitors pressure in area 62 between shallow set barrier 56 and upper deep set barrier 114. With the installation of shallow set barrier 56, the well has three barriers in place and may be suspended. When suspended the BOP stack 14 and marine riser may be removed. FIG. 77 illustrates the well suspended and with a subsea isolation device 72 connected to wellhead 16.

Figure 78:
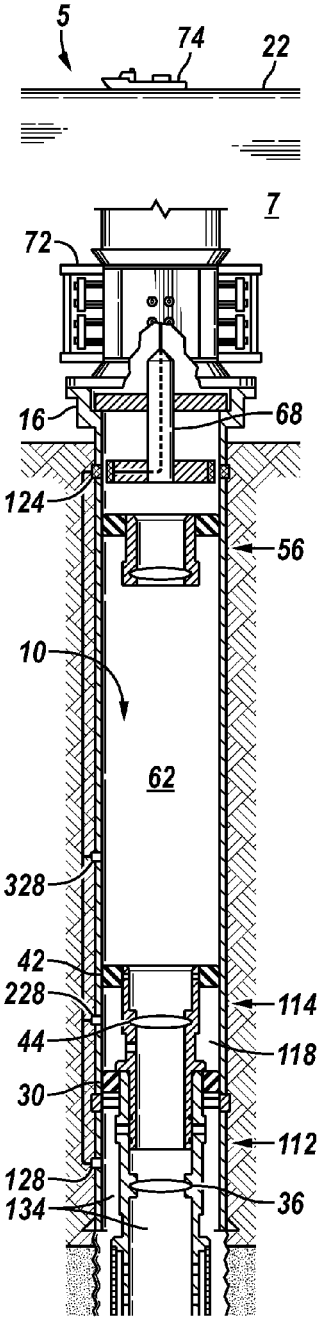
Figure 79:
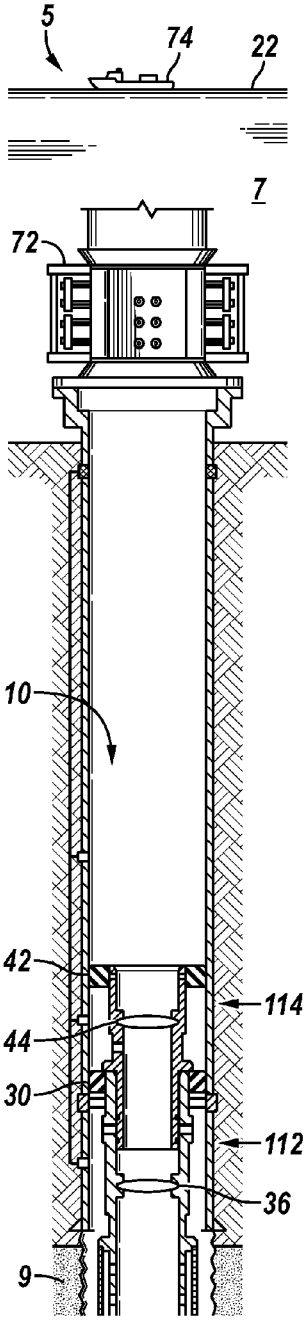

After the well has been suspended for a period of time an operator, e.g. vessel 74, comes back to check the pressure integrity of the barriers as illustrated in FIG. 78. A communication coupler 68 is RIH and mated with primary inductive coupler 124 and the pressure in area 62 between shallow set barrier 56 and upper deep set barrier 114 and the pressure in area 118 between upper deep set barrier 114 and lower deep set barrier 112 is checked. Confirming pressure integrity, shallow set barrier 56 is removed from the well as illustrated in FIG. 79. Two barriers 112, 114 remain in place.

Figure 80:
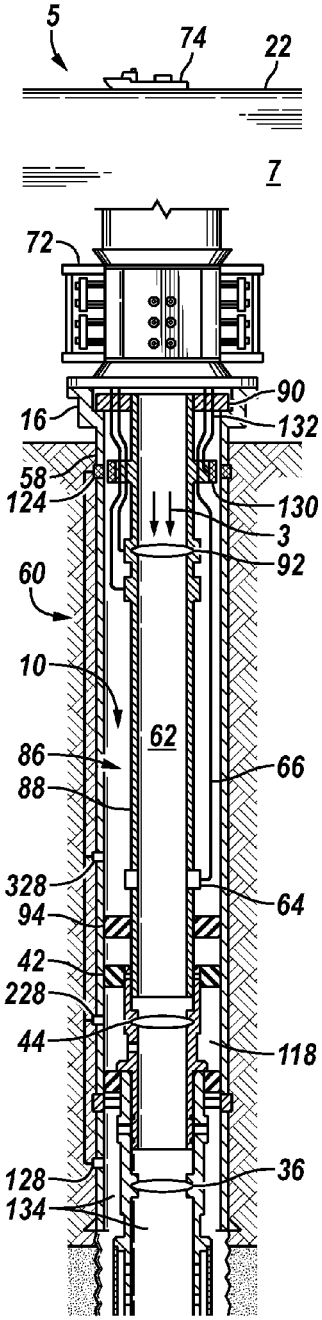

In FIG. 80 a production or upper completion 86 is RIH and tubing 88 is suspended from wellhead 16 by tubing hanger 90 and production packer 94 is set. Upper completion 86 includes a monitoring system 60 that includes male service inductive coupler 130 mated with primary inductive coupler 124 and sensor 64 in monitoring communication with area 62. Connection of service inductive coupler 130 with primary inductive coupler 124 provides monitoring communication between the surface receiver, for example vessel 74, and sensors 128, 228 and 328. Shallow set barrier 92 is pressure tested in FIG. 80 as shown be the arrows 3.

Figure 81:
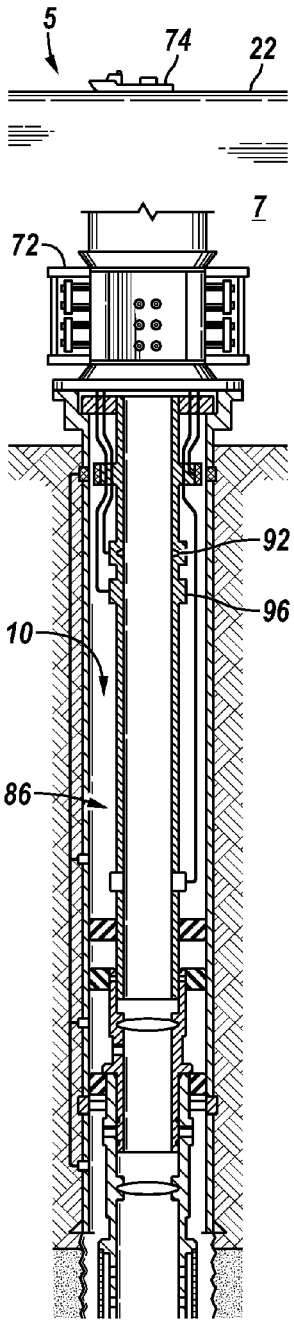
Figure 82:
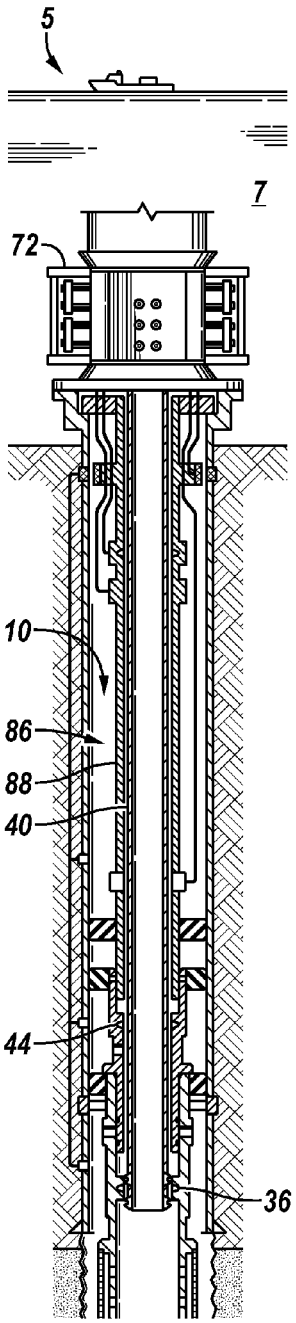
Figure 83:
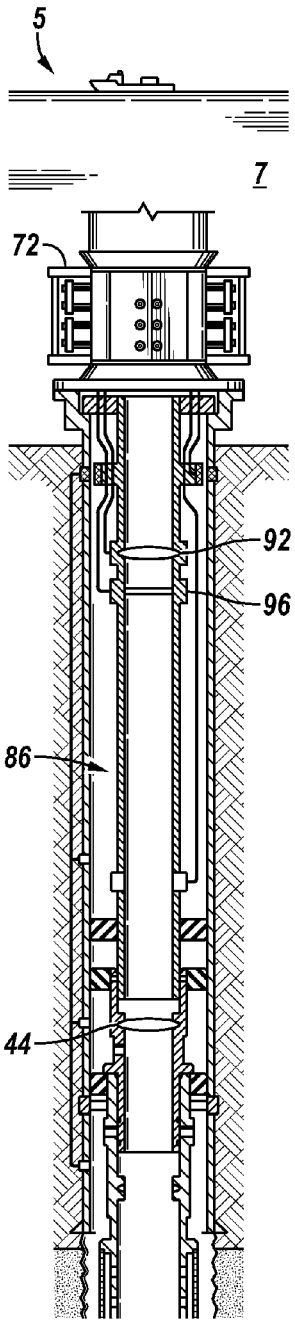

In FIG. 81 the upper completion barrier valve 92, e.g. surface controlled formation isolation valve, is opened. The subsurface safety valve 96 is also opened. In FIG. 82 a deployment tool 40 is RIH opening intermediate barrier valve 44 and lower barrier valve 36 as previously described for example with reference to FIG. 35. When deployment tool 40 is POOH, a shifting tool of the deployment tool shifts intermediate barrier 44 back to the closed position as illustrated in FIG. 83. Shallow barrier valve 92 and subsurface safety valve 96 are then actuated to the closed position.

Figure 84:
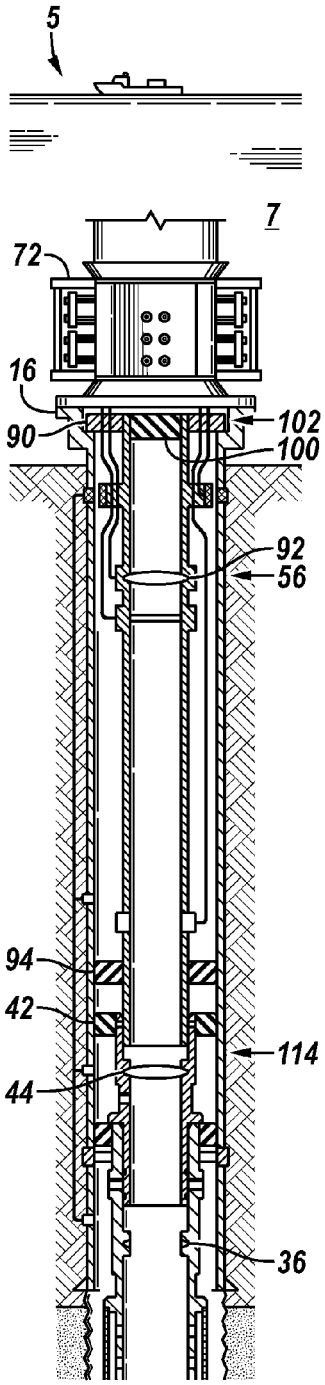

In FIG. 84 a suspension plug 100 is landed in tubing hanger 90 providing an additional shallow set barrier 102. Barrier 102, shallow set barrier 56, and intermediate or upper deep set barrier 114 are in place and the well is prepared to place in suspension. For example, SID 72 may be removed and the well may be suspended as previously described for example with reference to FIG. 17 or 51.

Figure 85:
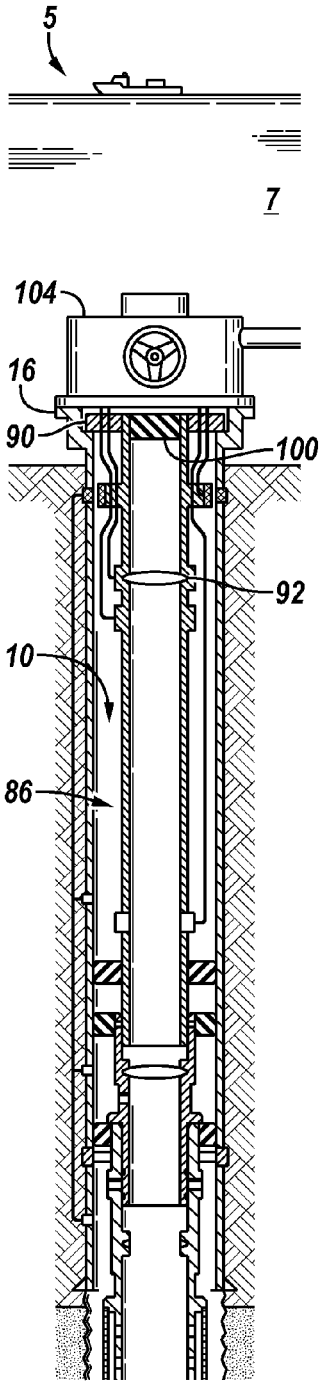
Figure 86:
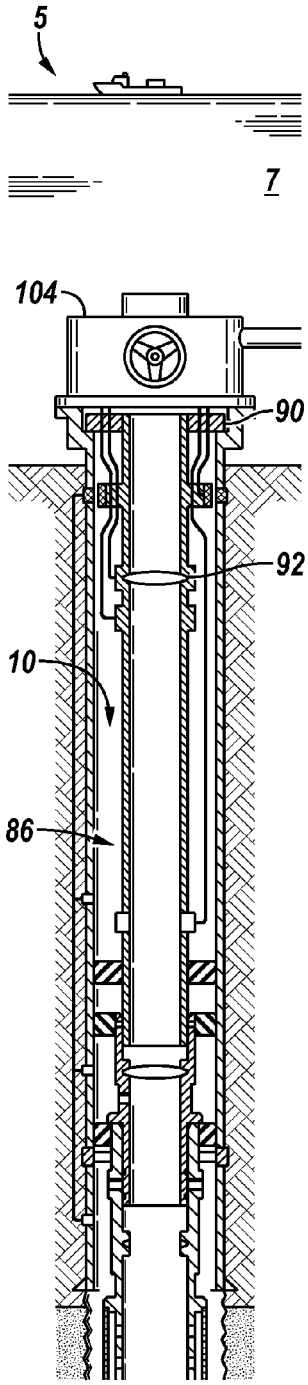
Figure 87:
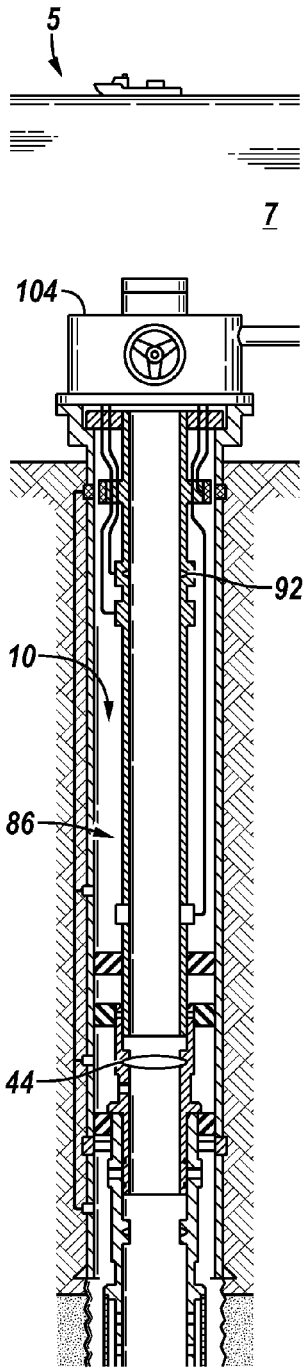
Figure 88:
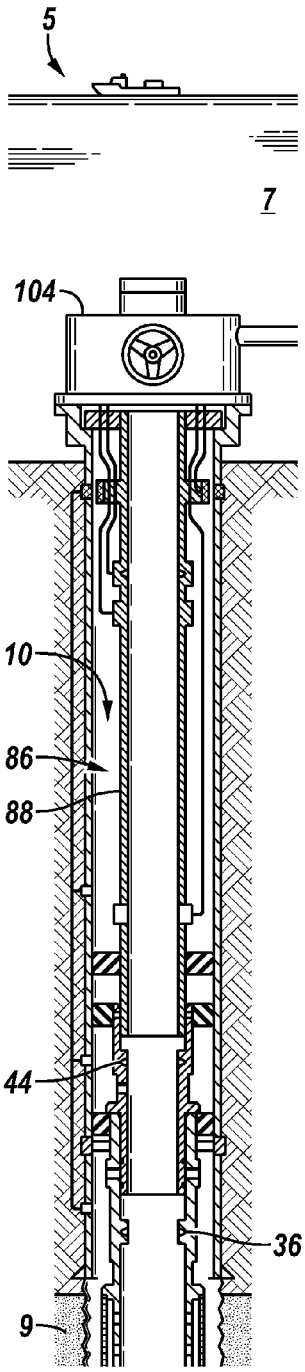
Figure 89:
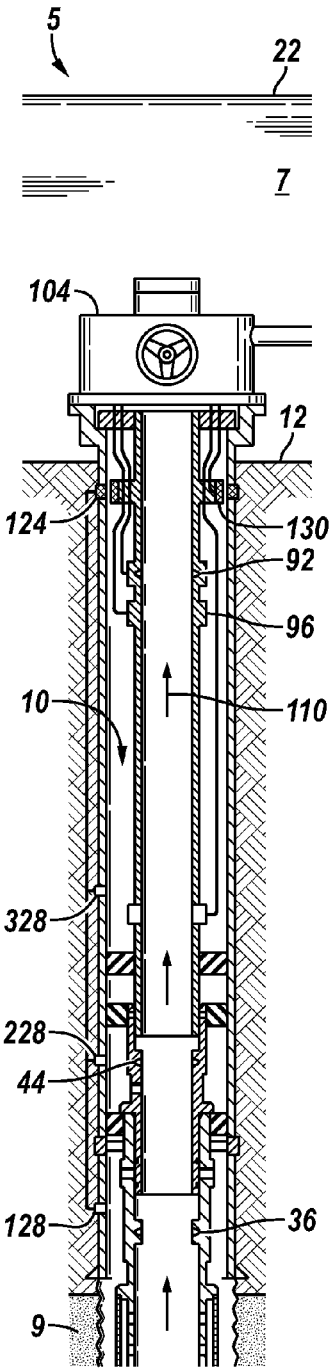

With reference to FIGS. 85 to 89, the well is placed on production. In FIG. 85 a Christmas tree 104 is landed on wellhead 16. Suspension plug 100 (FIG. 85) is retrieved through Christmas tree 104 as illustrated in FIG. 86. Upper barrier valve 92 is operated to the open position as illustrated in FIG. 87. Tubing 88 pressure can then be applied to open intermediate barrier valve 44 as shown in FIG. 88. With barrier valves 92, 44 and 36 opened, well 10 can produce formation fluid 110 as illustrated in FIG. 89. Sensor 228 which was used for monitoring the lower barrier, e.g. FIG. 76, can be used to monitor the reservoir 9 pressure and temperature via open communication port 84 (FIG. 74). Similarly, sensor 328 which was utilized to monitor the upper deep set barrier, e.g. FIG. 76, can be utilized to monitor the A-annulus. Sensor 128 may be utilized for example for permanent reservoir 9 monitoring.

Referring now to FIGS. 90 to 103, an embodiment of an open water barrier completion and monitoring system and method is described. In some embodiments of an open water completion system 5 a gravel pack system may be run as part of a lower completion. Lower completion 136 includes at least two packers 30, 138, two barrier valves 44, 36 and a sensor 80 to measure pressure outside of lower completion 136 and inside of casing 24. In accordance to one or more embodiments, sensor 80 includes a communication device 82, illustrated as a female inductive coupler. Intermediate barrier valve 44 is positioned between upper packer 30 and lower packer 138. Lower barrier valve 36 is located below lower packer 138. In the depicted embodiments, upper packer 30 seals with the casing and includes slips 144 to engage casing 24 and provide mechanical support. Lower packer 138 does not have slips and will provide a seal but not mechanical support. During gravel packing operations lower packer 138 is not set, hence, gravel packing fluid and slurry can be pumped between casing 24 and lower packer 138.

Figure 90:
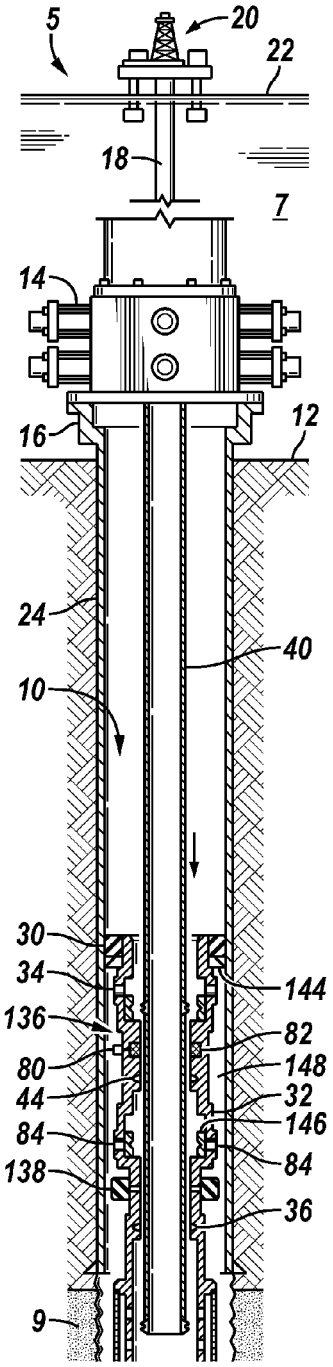
FIGS. 90-103 illustrate a dual barrier well completion system in accordance to one or more embodiments including a lower completion with two packers and two barrier valves and monitoring between the barriers.

FIG. 90 illustrates the well during gravel packing Upper packer 30 is set in casing 24 to provide an annular seal and support lower completion 136. Lower packer 138 has not been set. A deployment tool 40 (e.g. service tool) is illustrated RIH and deployed through lower completion 136. Gravel pack port 34, located between upper packer 30 and barrier valve 44, is open in FIG. 90. A port 84 through tubular 32 is closed by a sleeve 146.

Gravel pack slurry is pumped from the interior of lower completion 136 through gravel pack ports 34 to the exterior, i.e. annulus, 148 of lower completion 136. The slurry can then flow between casing 24 and lower packer 138 toward formation 9. This gravel pack operation may occur with the service tool deployed through the interior of the gravel pack assembly.

Figure 91:
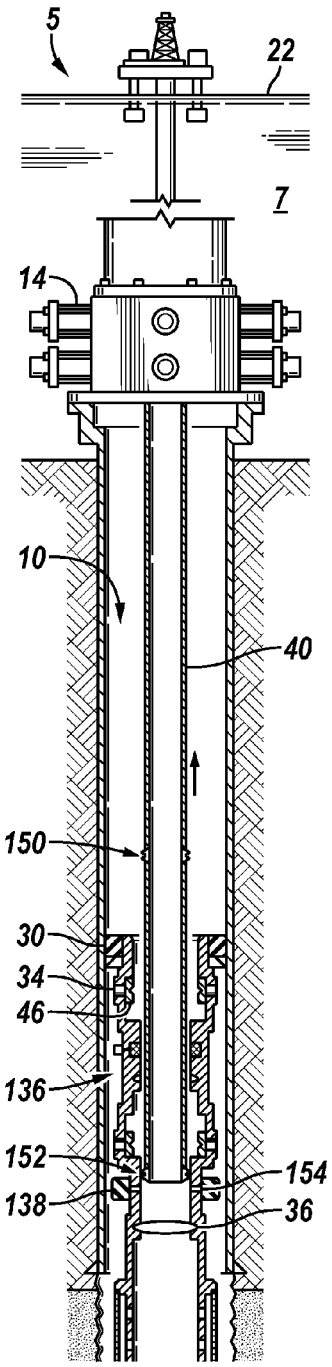

When the gravel pack operation is completed, service tool 40 may be picked up as illustrated in FIG. 91 and in the process the service tool may shift the lower FIV barrier valve 36 closed and open a pressure communication port 154 on lower packer 138. In accordance to an embodiment, PCS shifting tool 150 closes gravel pack port 34 with port closure sleeve 46, e.g. straddle seal assembly, and shifting tool 152 opens pressure communication port 154 of lower packer 138.

Figure 92:
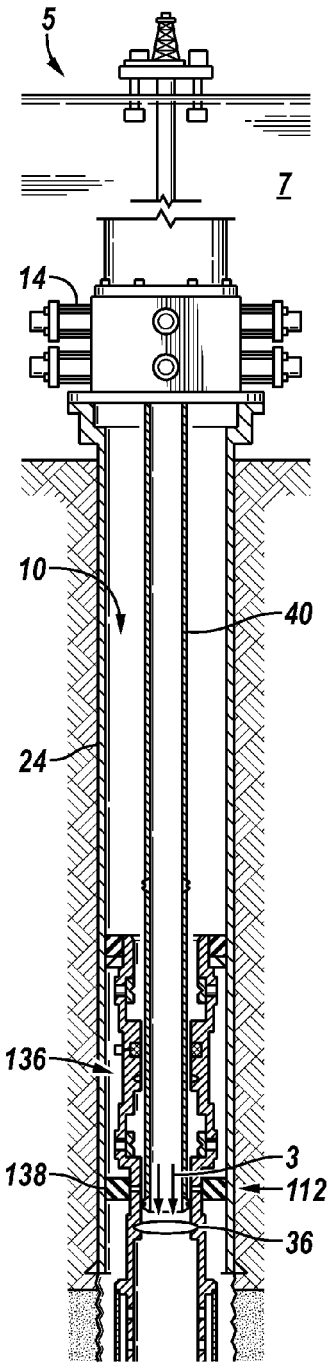

Referring to FIG. 92, pressure may then be raised as illustrated by arrows 3 in the interior of the gravel pack completion 136 assembly to test the seal of lower FIV barrier valve 36 and to set lower packer 138 via the opened pressure communication port 154 (FIG. 91). Lower barrier valve 36 and set lower packer 138 provide a lower deep set barrier 112. Lower deep set barrier 112 may be pressure tested.

Figure 93:
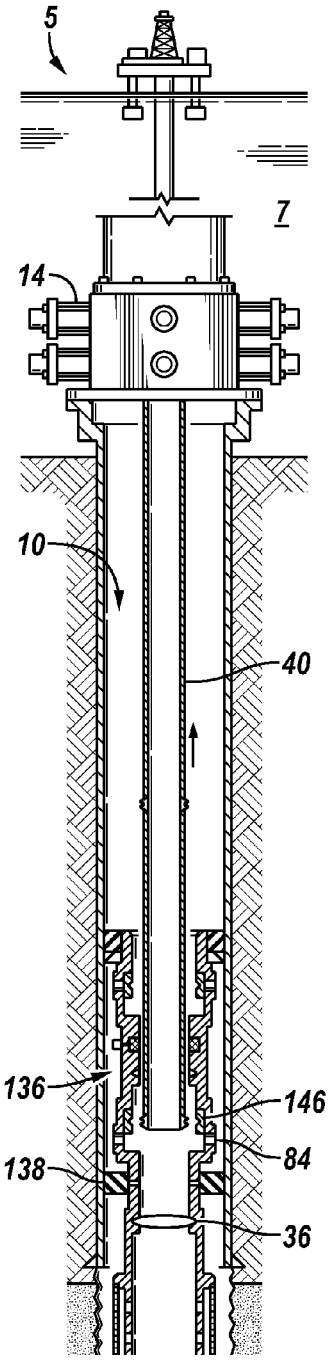
Figure 94:
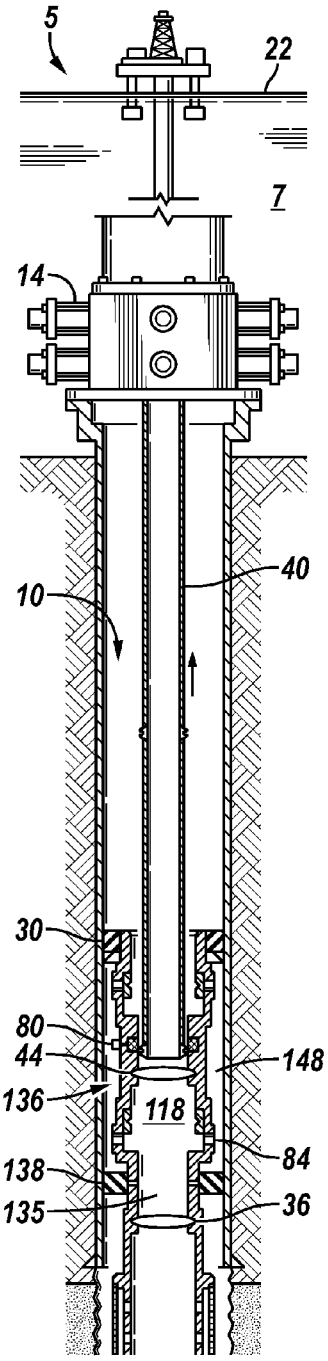

Deployment tool 40 may be picked up further as shown in FIG. 93 moving sleeve 146 and opening port 84. As deployment tool 40 is further picked up, as illustrated in FIG. 94, intermediate barrier valve 44 is closed leaving two barriers in place. Intermediate barrier valve 44 may be pressure tested.

Opening of port 84 provides communication between the interior 135 of lower completion 136 between barrier valves 36, 44 and exterior 148 between upper packer 30 and lower packer 138. This area is also referred to as the area 118 between the lower deep set barrier and the upper deep set barrier. Sensor 80 is in communication with area 118.

Figure 95:
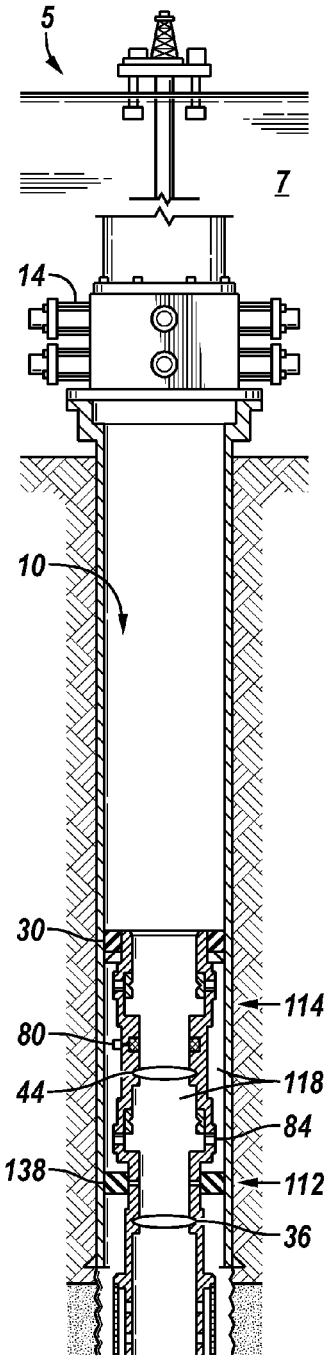

FIG. 95 shows well 10 with lower deep set barrier 112 and upper deep set barrier 114 in place. Upper deep set barrier 114 is formed by packer 30 and intermediate barrier valve 44. Sensor 80 is in monitoring communication with area 118 between lower deep set barrier 112 and upper deep set barrier 114.

Figure 96:
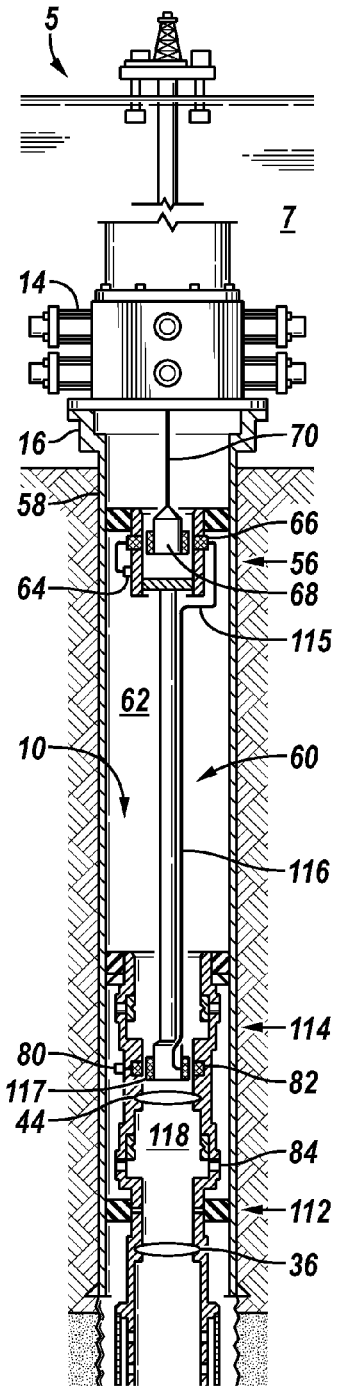

In FIG. 96 a shallow set barrier 56 is installed in the upper completion section 58 of the well providing three barriers. In this example, shallow set barrier 56 includes shallow set sensor 64 for measuring pressure in area 62 between shallow set barrier 56 and deep set barrier 114. As previously described for example with reference to FIG. 45, monitoring system 60 may include a wired connector 116 coupling deep set sensor 80 with the shallow set communication device 66 which is shown as an inductive coupler or wet connect. Wired connector 116 may be a wire, E-coil, cable or the like and connector 116 may include or may not include a structural support member such as pipe. A top coupler 115 is connected to shallow set communication device 66 and lower coupler 117, e.g. male induction coupler, is connected with deep set communication device 82. A communication coupler 68 is shown RIH and mated with shallow set communication device 66 thereby connecting the surface receiver, e.g. rig 20, with sensor 64 and sensor 80.

Figure 97:
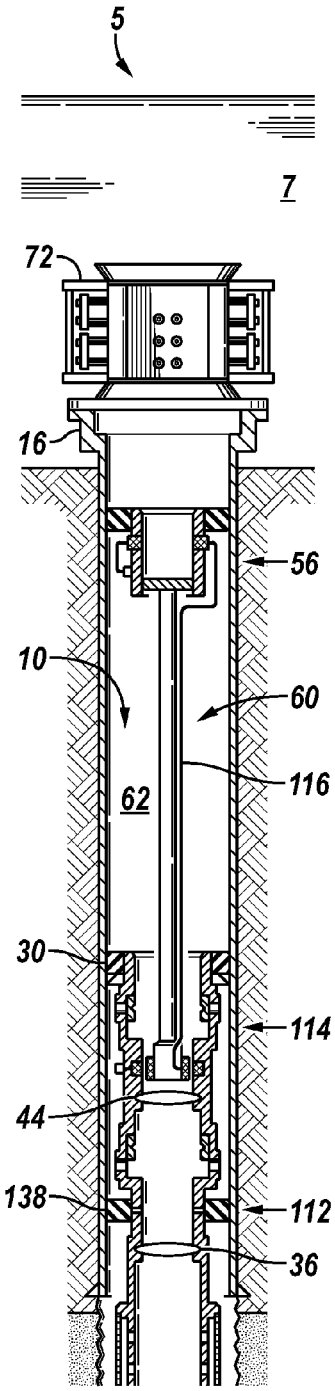
Figure 98:
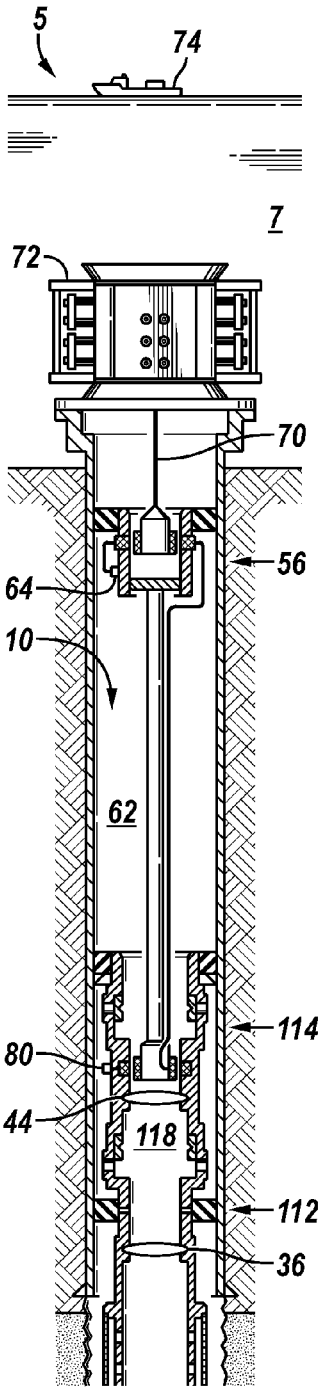
Figure 99:
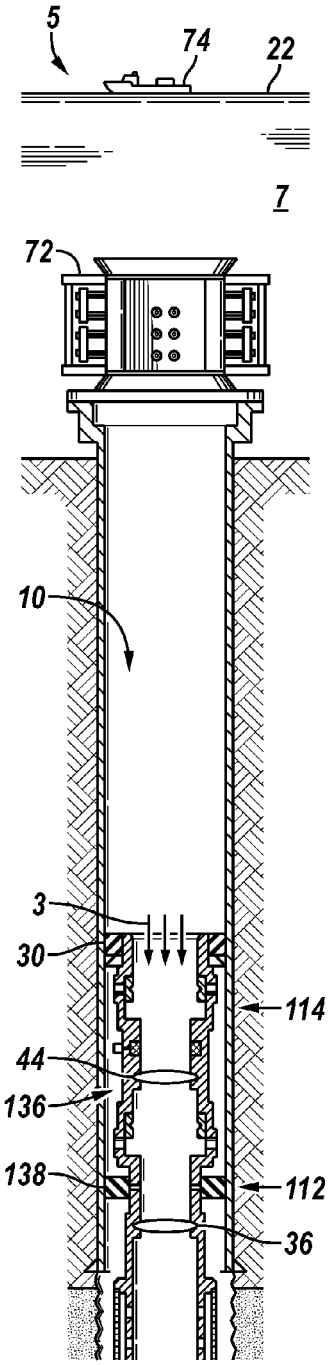

FIG. 97 illustrates the well suspended with three barriers in place. BOP stack 14 (FIG. 96) is removed and replaced with a subsea or seabed isolation device 72. The integrity of barriers 56, 114, 112 may be checked periodically. At FIG. 98 a smaller vessel 74 is moved on site to check the integrity of the barriers. It is not necessary to deploy a rig. As described for example with reference to FIG. 96, a communication coupler 68 is deployed for example through open water 7 and SID 72 and connected with communication device 66 of monitoring system 60. The integrity of the barriers can be checked by monitoring the pressure in area 62 via sensor 64 and area 118 via sensor 80. After checking the integrity of the barriers, shallow set barrier 56 is retrieved leaving two barriers 112, 114 in place as shown in FIG. 99. Upper deep set barrier 114 is pressure tested as shown by arrows 3 in FIG. 99.

Figure 100:
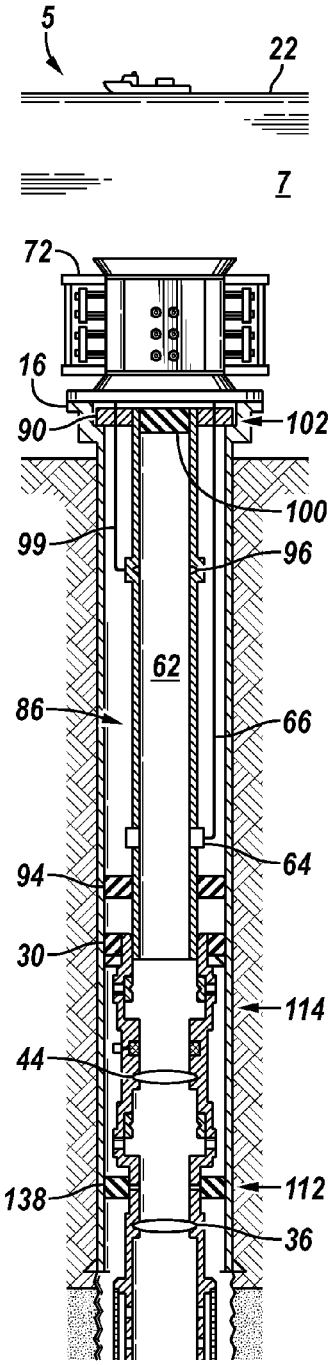
Figure 101:
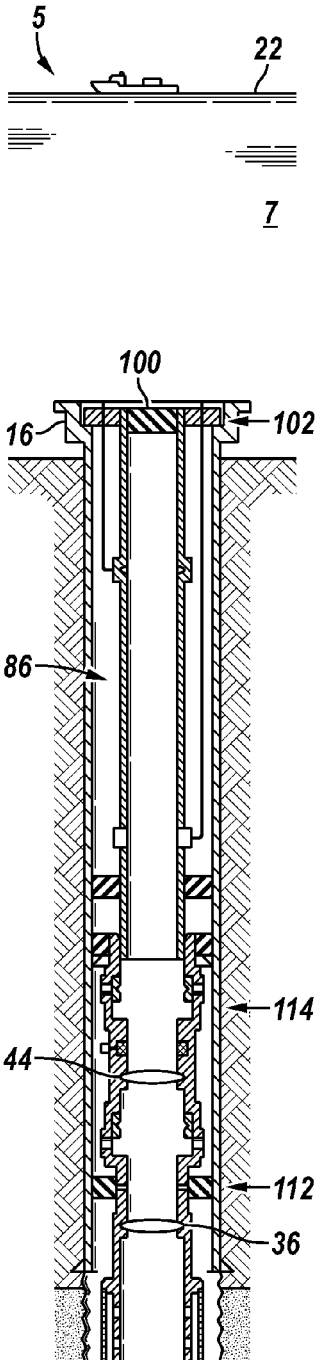

When the well is ready, an upper completion 86 may be RIH and installed as shown in FIG. 100. For example, upper completion 86 may include a tubing 88, production packer 94, a surface controlled subsurface safety valve 96. Tubing 88 is suspended from a tubing hanger 90. A suspension plug 100 is coupled with tubing hanger 90 to form a shallow set barrier 102. A sensor 64 is in communication with the area 62 between shallow set barrier 102 and intermediate barrier 114. Once upper completion 86 is installed, SID 72 can be removed as illustrated in FIG. 101 leaving three barriers 102, 114, 112 in place.

Figure 102:
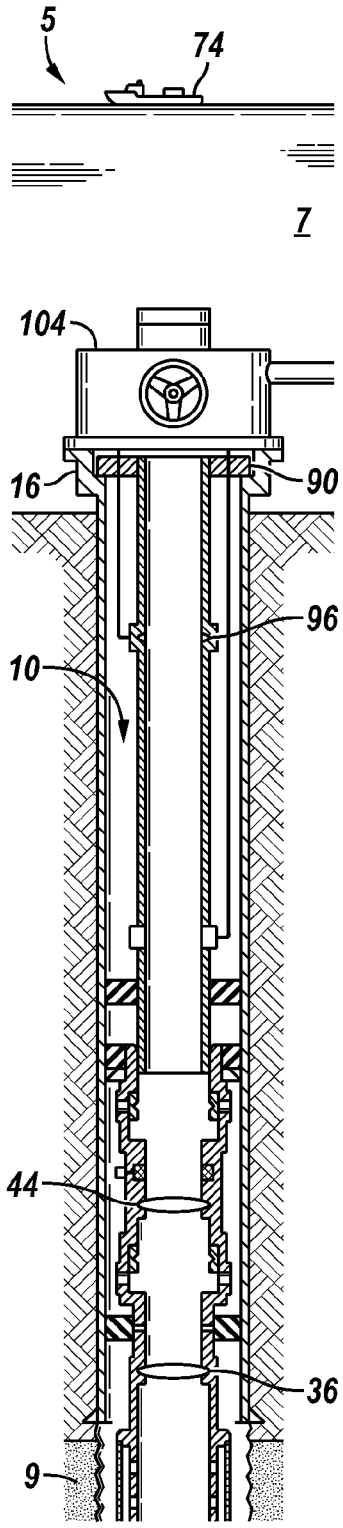
Figure 103:
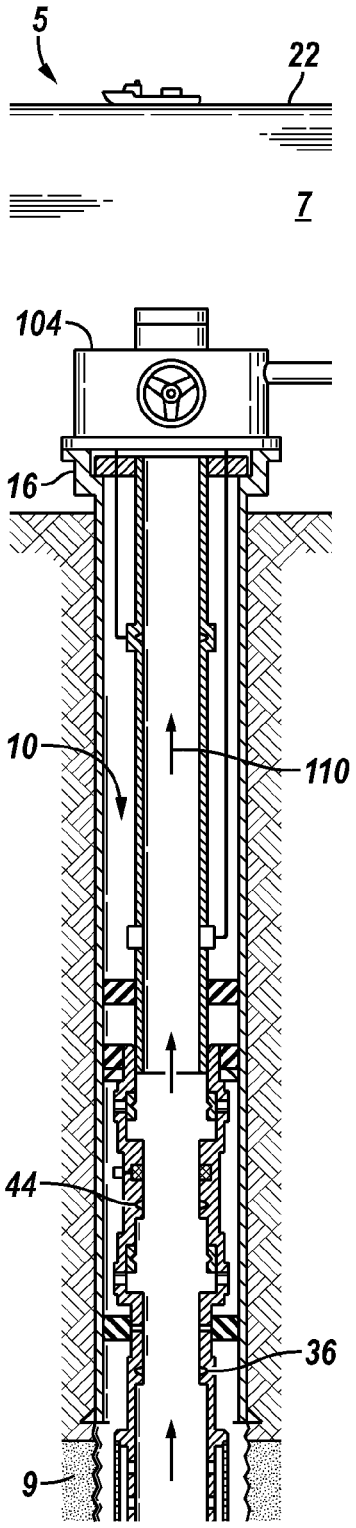

In FIG. 102 a Christmas tree 104 is installed and the suspension plug is removed. In FIG. 103 tubing pressure has been applied to open barrier valves 36, 44. Formation fluid 110 can then be produced.

Referring now to FIGS. 104-117, in some embodiments, prior to the installation of the lower completion (e.g. gravel pack assembly) or the upper completion, a female inductive coupler and at least two pressure or temperature gauges may be installed behind the casing. Deploying the shallow set plug below the primary behind casing female inductive coupler, but above the behind casing pressure/temperature gauge, allows the behind casing pressure/temperature gauge to monitor conditions between the shallow set barrier, e.g. plug, and the upper deep set FIV valve, to determine integrity and well conditions. Once the shallow set plug is set, the gauges may have power and communication supplied to them by deploying a service inductive coupler portion, for example on wireline, to provide power and communication from the surface, and to communicate through induction principles, with the female inductive coupler and gauges deployed behind the casing.

Figure 104:
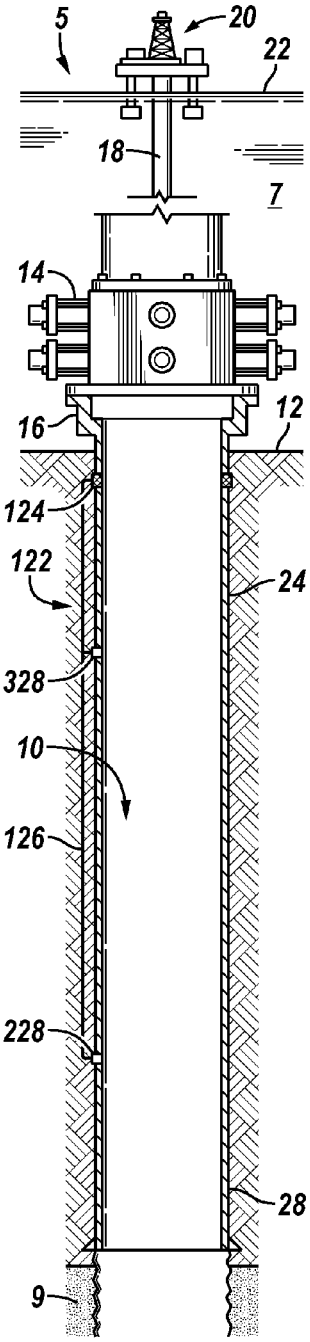
FIGS. 104-117 illustrate a dual barrier well completion system in accordance to one or more embodiments including a lower completion with two packers and two barrier valves, a behind the casing monitoring system and monitoring between the barriers.

In FIG. 104 a well 10 is drilled and casing 24 installed. Casing 24 may include one or more indexing casing coupling locators and a communication and sensing system, generally denoted by the numeral 122, installed behind casing 24. The behind casing communication system 122 includes a primary inductive coupler 124 or station 124 located uphole, for example in the upper completion section closer to wellhead 16 than to formation 9, for connecting with a service inductive coupler positioned in the well. Primary inductive coupler 124 is connected via an electrical conductor 126 to one or more sensors and secondary inductive couplers located behind casing 24 and downhole from primary inductive coupler 124. For example, in FIG. 104 primary inductive coupler 124 is connected to spaced apart sensors 228, 328. In the illustrated embodiment, sensors 228, 328 read at least pressure inside of casing 24 (i.e., in well 10). Communication system 122 may also include sensors that measure for example pressure outside of casing 24 (e.g. the B-annulus). Sensors 228, 328, etc. may be WellNet (Schlumberger Limited) type sensors for example. A BOP stack 14, e.g. drilling BOP, is depicted connected to wellhead 16 at seabed 12 and a marine riser 18 extending between BOP stack 14 and rig 20 located at water surface 22.

Figure 105:
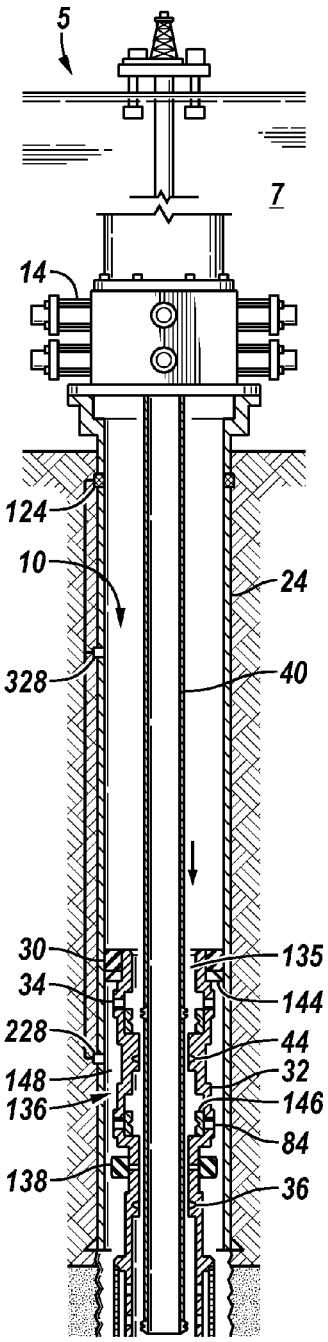

FIG. 105 illustrates a lower completion 136 installed in the well and gravel packing the well. The depicted lower completion 136 includes at least two packers 30, 138, and two barrier valves 44, 36. Lower completion 136 is landed in the well with sensor 228 located between upper packer 30 and lower packer 138. Intermediate barrier valve 44 is positioned between upper packer 30 and lower packer 138. Lower barrier valve 36 is located below lower packer 138. In the depicted embodiments, upper packer 30 seals with the casing and includes slips 144 to engage casing 24 and provide mechanical support for lower completion 136. Lower packer 138 does not have slips and will provide a seal but not mechanical support.

A deployment tool 40 (e.g. service tool) is RIH and deployed through lower completion 136. Gravel pack port 34, located between upper packer 30 and barrier valve 44 is open. A port 84 through tubular 32 is closed in FIG. 105 by sleeve 146. Gravel packing slurry can be pumped from interior 135 of the lower completion through gravel pack port 34 to exterior 148 (e.g. annulus) between completion 136 and casing 24. The slurry can then flow between casing 24 and lower packer 138 toward formation 9.

Figure 106:
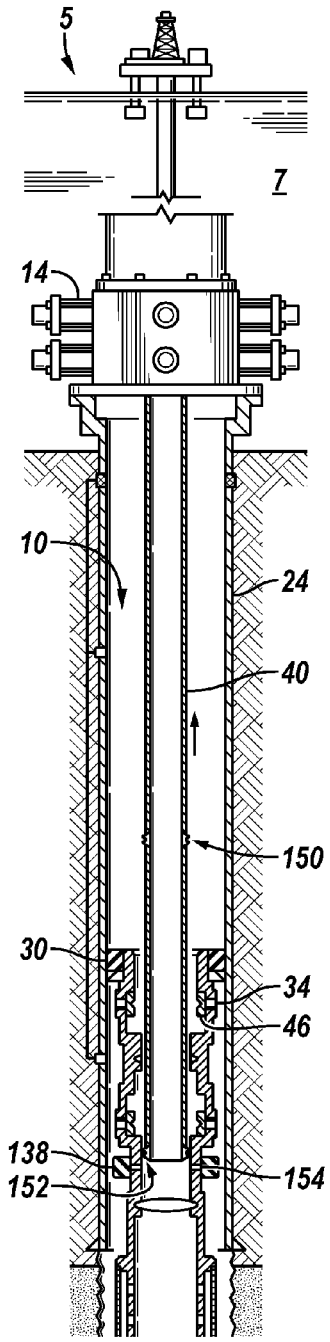

When the gravel pack operation is completed, service tool 40 may be picked up as illustrated in FIG. 106. As the service tool is picked up the lower FIV barrier valve 36 is shifted closed and pressure communication port 154 of lower packer 138 is opened. In accordance to an embodiment PCS shifting tool 150 closes gravel pack port 34 with port closure sleeve 46, e.g. straddle seal assembly, and shifting tool 152 opens pressure communication port 154 of lower packer 138.

Figure 107:
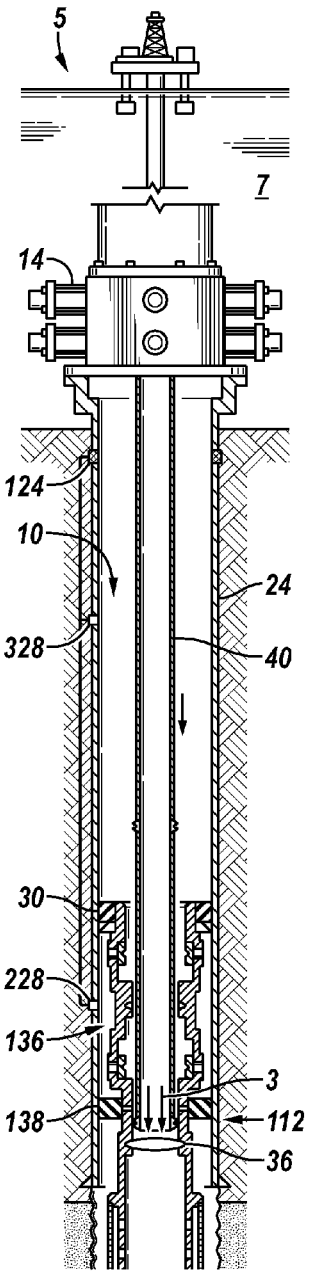

Referring to FIG. 107 pressure may then be raised as illustrated by arrows 3 in the interior of the gravel pack completion 136 assembly to test the seal of lower FIV barrier valve 36 and to set lower packer 138 via the opened pressure communication port 154 (FIG. 106). Lower barrier valve 36 and set lower packer 138 provide a lower deep set barrier 112. Lower deep set barrier 112 may be pressure tested. Service tool 40 may include a service inductive coupler, for example as previously described with reference to FIGS. 72-74, that is connectable with behind casing sensors 228, 328 via primary inductive coupler 124.

Figure 108:
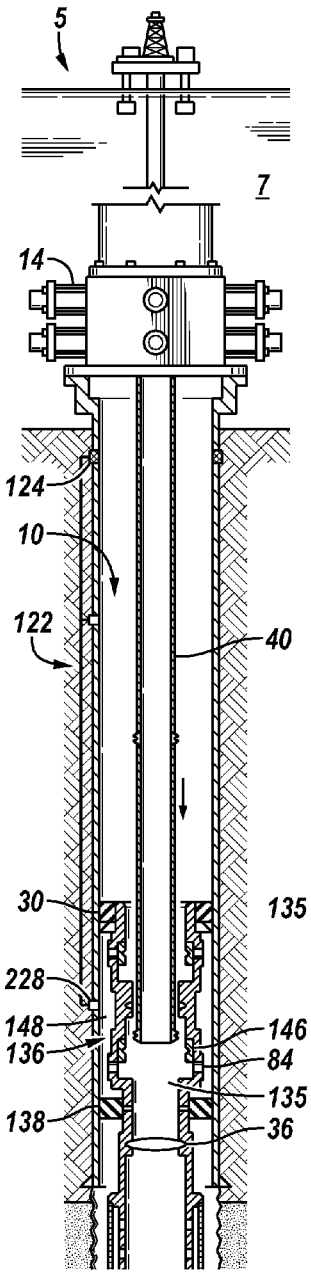
Figure 109:
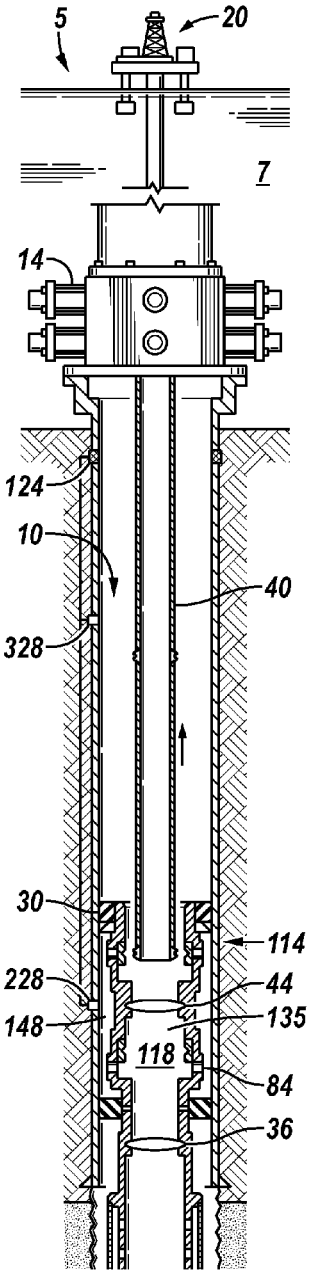

Deployment tool 40 may be picked up as shown in FIG. 108 moving sleeve 146 and opening port 84. Opening port 84 provides communication between the interior 135 of completion 136 and exterior 148 between upper packer 30 and lower packer 138. As deployment tool 40 is further picked up, as illustrated in FIG. 109, intermediate barrier valve 44 is closed leaving two barriers in place. Intermediate barrier valve 44 may be pressure tested.

Barrier 114 is formed by closed barrier valve 44 and upper packer 30. Opening of port 84 provides communication between the interior 135 of lower completion 136 between barrier valves 36, 44 and exterior 148 between upper packer 30 and lower packer 138. This area is also referred to as area 118 between lower deep set barrier 112 and upper deep set barrier 114. Behind casing sensor 228 is in sensing and monitoring communication with area 118.

Figure 110:
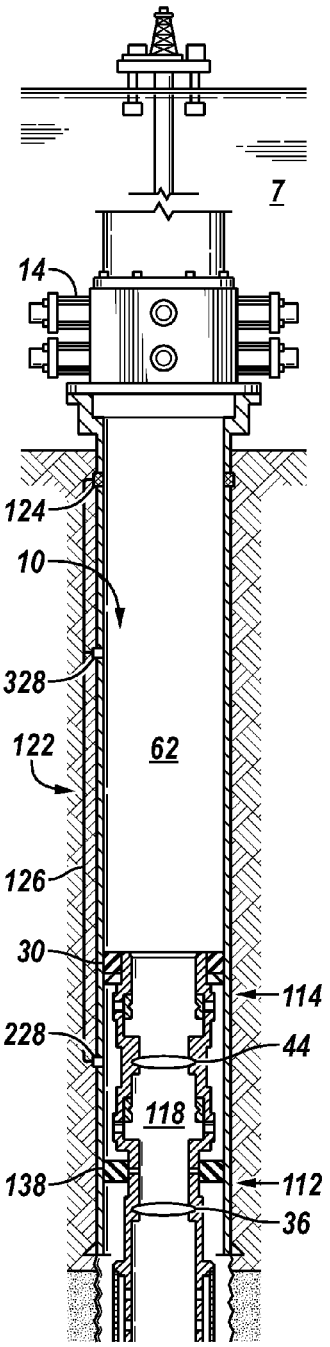

FIG. 110 illustrates well 10 after service tool 40 has been pulled out of the hole leaving two barriers 112, 114 in place. Each of barriers 112, 114 may have been independently tested to verify seal integrity. Sensor 228 is in monitoring communication with area 118 between deep set barriers 112, 114 and sensor 328 is in monitoring communication with area 62 above the deep set barriers. Behind casing monitoring system 122 provides for continuous and periodic pressure monitoring of barriers 112, 114.

Figure 111:
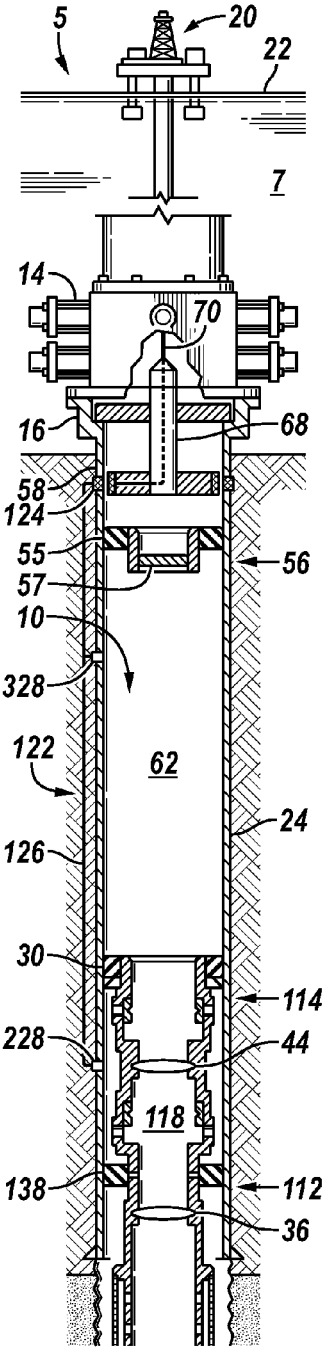

In FIG. 111 a shallow set barrier 56, for example including a packer 55 and plug 57, is installed in the well uphole from deep set barriers 114, 112 in the production completion section 58. A communication coupler 68, for example a male service inductive coupler, is RIH and mated with primary inductive coupler 124 and at least pressure is checked between the barriers. For example, sensor 228 monitors pressure in area 118 between lower deep set barrier 112 and upper deep set barrier 114, and sensor 328 monitors pressure in area 62 between shallow set barrier 56 and upper deep set barrier 114. Additional sensors may be included, for example, to monitor pressure below lower deep set barrier 112.

Figure 112:
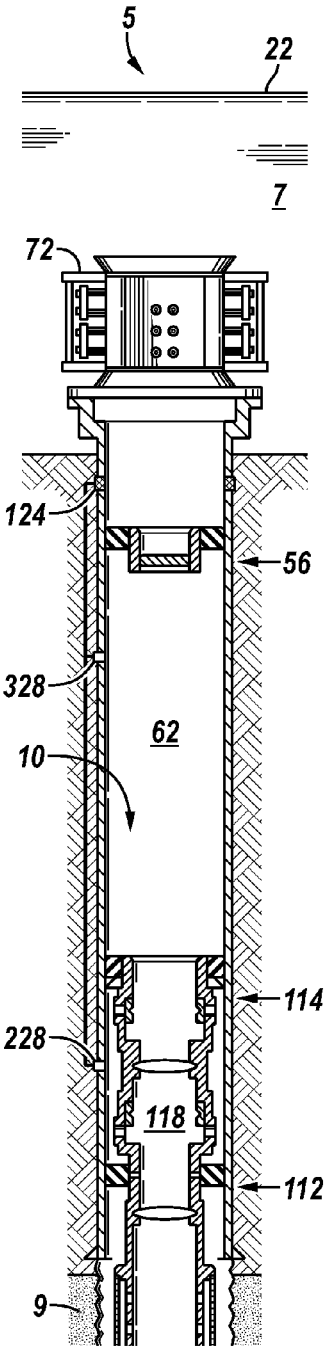
Figure 113:
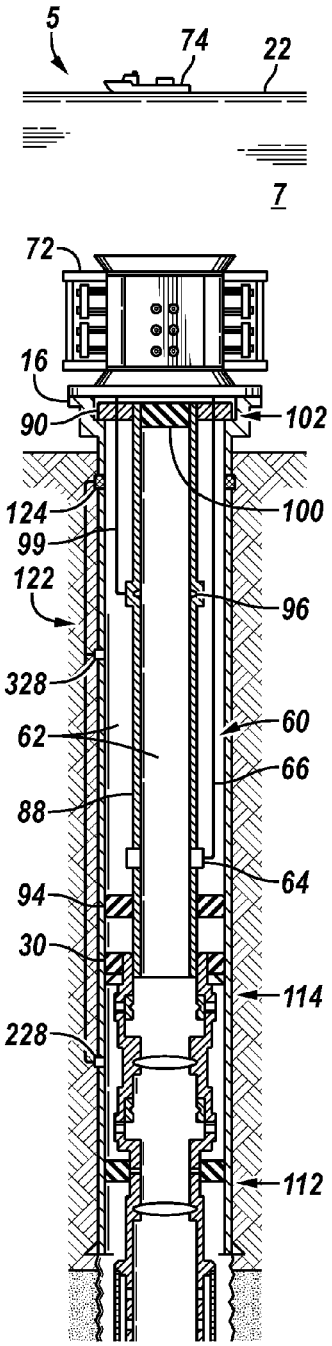

With the installation of shallow set barrier 56, the well has three barriers in place and may be suspended. BOP stack 14 and marine riser may be removed. FIG. 112 illustrates the well suspended and with a subsea isolation device 72 connected to wellhead 16 in place of the BOP stack.

After the well has been suspended for a period of time an operator may come back to check the pressure integrity of the barriers for example as previously described with reference to FIG. 78. Confirming pressure integrity, shallow set barrier 56 is removed from the well and a production completion 86 may be run-in-hole and installed as illustrated for example in FIG. 113. For example, upper completion 86 may include a tubing 88, production packer 94, a surface controlled subsurface safety valve 96. Tubing 88 is suspended from a tubing hanger 90. A suspension plug 100 is coupled with tubing hanger 90 to form a shallow set barrier 102. A sensor 64 is in communication with area 62, for example tubing bore area, between shallow set barrier 102 and intermediate barrier 114. Behind casing sensor 328 is in communication with area 62, for example tubing-casing annulus section, between shallow set barrier 102 and barrier 114.

Figure 117:
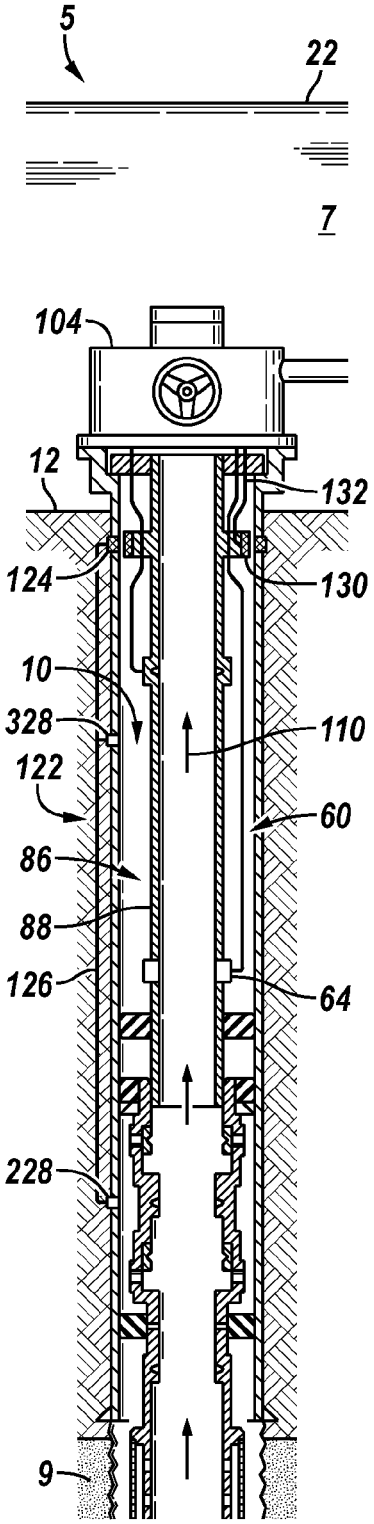

As illustrated for example in FIG. 117 and as previously described with reference to FIGS. 80-89, upper completion 86 may include a coupler 130 to couple behind casing monitoring system 122 with the surface receiver. For example, with reference to FIGS. 117 and 80-89, coupler 130 may be a male service induction coupler incorporated with upper completion 86. Connection of service inductive coupler 130 with primary inductive coupler 124 provides monitoring communication between the surface receiver, for example subsurface station or surface vessel, and sensors 228 and 328.

Figure 114:
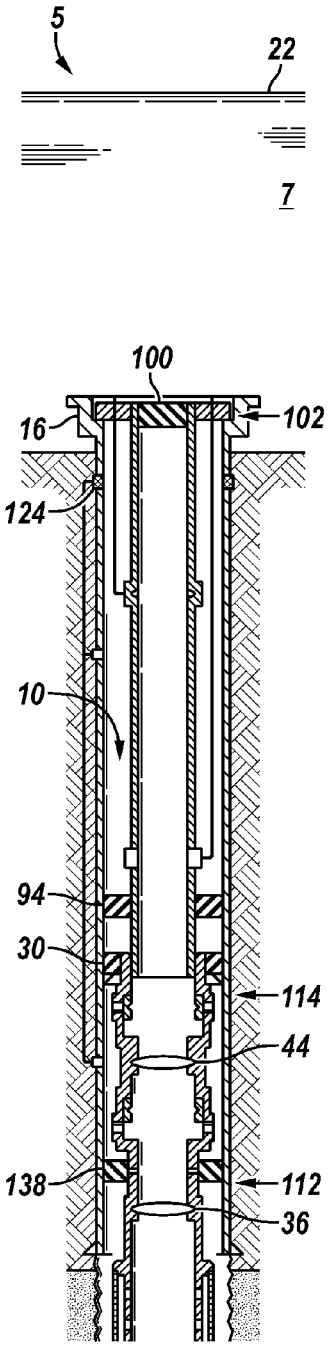
Figure 115:
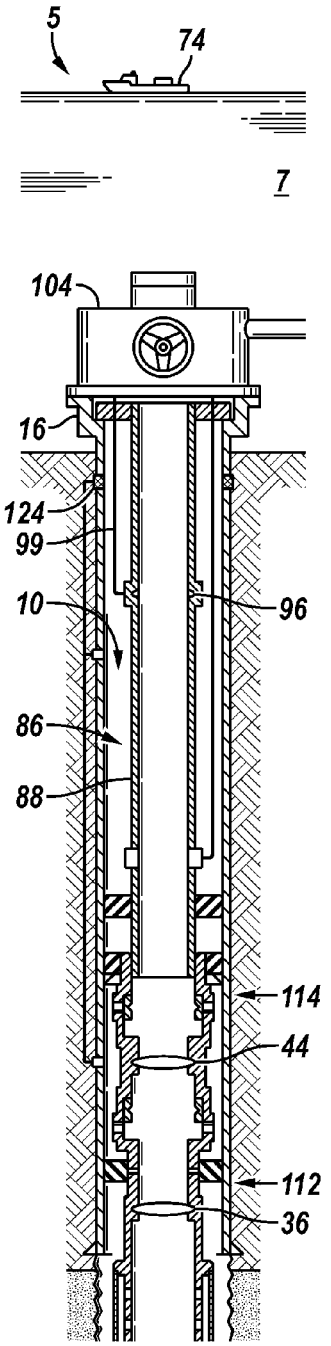
Figure 116:
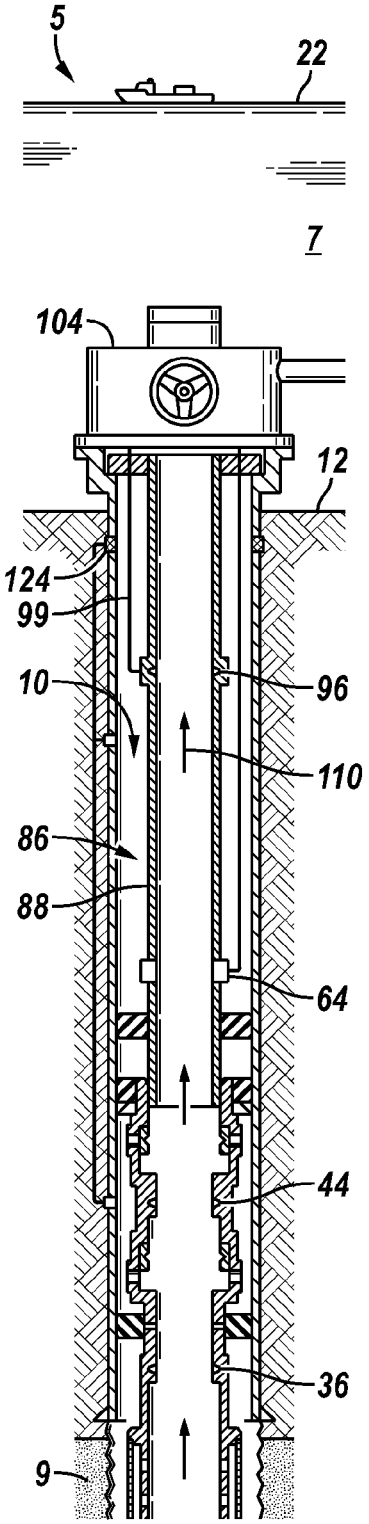

Once upper completion 86 is installed, SID 72 can be removed as illustrated in FIG. 114 leaving three barriers 102, 114, 112 in place. The well can be suspended as illustrated in FIG. 114 until it is desired to place the well on production. In FIG. 115 a Christmas tree 104 is installed and the suspension plug is removed. In FIG. 116 tubing pressure has been applied to open barrier valves 36, 44 and place the well on production. Formation fluid 110 can then be produced.

Figure 118:
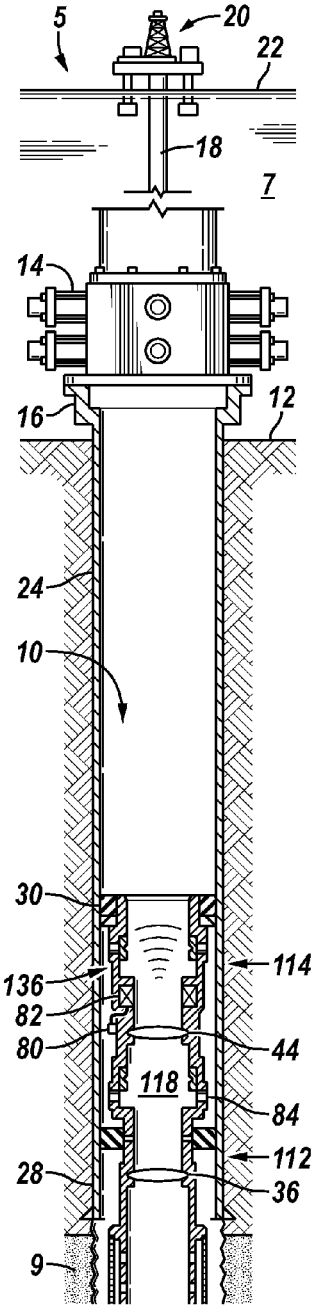
FIGS. 118-120 illustrate a dual barrier well completion system in accordance to one or more embodiments including wireless communication of data gauged between the barriers and a lower completion with two packers and two barrier valves.
Figure 119:
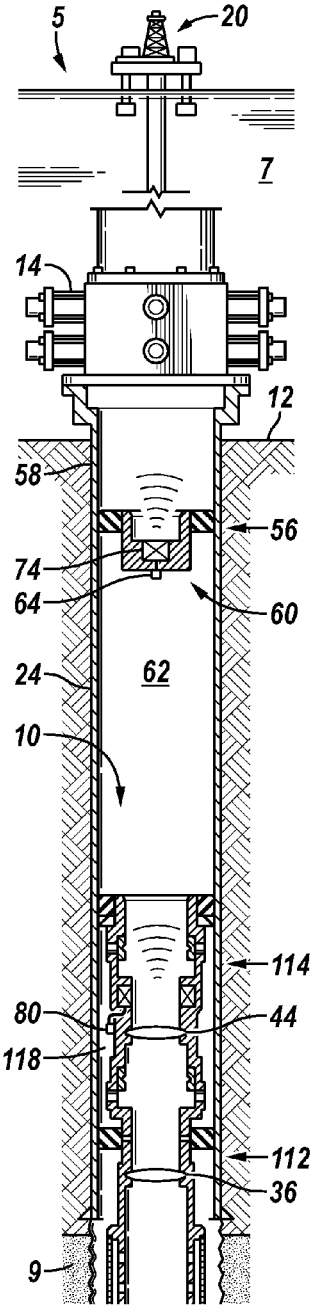
Figure 120:
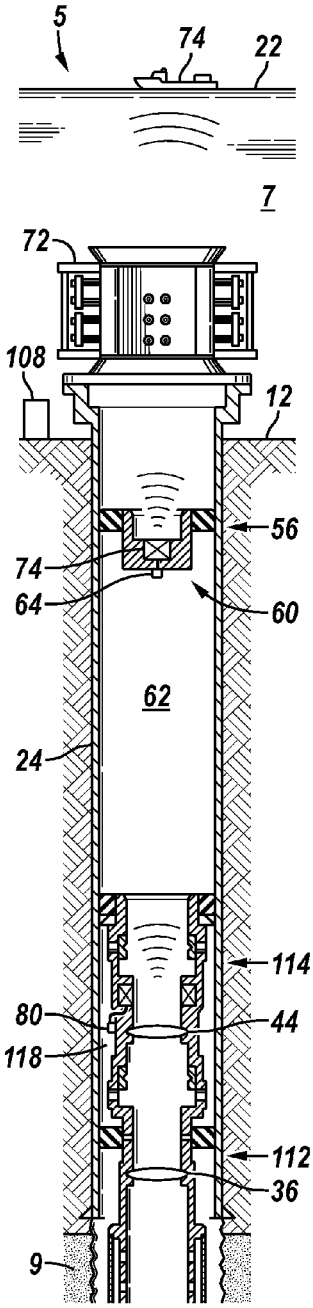

Referring now to FIGS. 118 to 120, in some embodiments the monitoring of the well integrity may occur by providing an acoustic signal transmitter assembly in a gravel pack assembly for example. The deep set acoustic signal transmitter assembly may include a battery, electronics and pressure/temperature gauge for reading conditions between the barriers. In these embodiments, the shallow set barrier may include a receiver and transmitter device that is suitable to receive the signal from the lower deployed, e.g. deep set, acoustic signal transmitter. The shallow set transmitter is also suitable to transmit an acoustic signal to the surface, which may be monitored by a surface vessel. Acoustic signals may be, for instance, tube wave type signals.

Referring first to FIG. 118 a lower completion 136 is illustrated in installed in well 10. Lower completion 136 can be installed in the well as previously described with reference to FIGS. 90 to 95. Sensor 80 of lower completion 136 is in communication with area 118 between lower deep set barrier 112, i.e. FIV barrier valve 36, and upper deep set barrier 114, e.g. FIV barrier valve 44. As previously described, sensor 80 may be measuring the pressure in the annulus outside of the lower completion which is in communication with the interior of the lower completion through the port 84. The integrity of lower deep set barrier 112 can be monitored and confirmed via deep set sensor 80.

In accordance with one or more embodiments, sensor 80 includes a communication device 82. For example, sensor 80 may be an assembly including the gauging elements and communication elements. In this example, communication device 82 is a wireless telemetry transmitter module and may include a local power source, e.g. battery.

Communication device 82 may transmit for example via wireless data transfer or tube wave in the casing fluid column to a surface receiver, for example rig 20 or seabed station 108 (FIG. 120). In accordance to some embodiments, communication device 82 wirelessly transmits the data to shallow set communication device such as described with reference to FIGS. 11, 13, and 120.

A shallow set barrier 56 is depicted in FIG. 119 installed in the well in the upper completion section 58. In this example, shallow set barrier 56 includes a sensor 64 and communication device 78, which may be assembled together in a module. Sensor 64 is in monitoring communication with area 62 between shallow set barrier 56 and upper deep set barrier 114. Communication device 78 may include electronics and a stand along power source. Communication device 78 is configured to wirelessly transmit data from sensor 64 and sensor 80 to a surface receiver, for example rig 20 in FIG. 119, and vessel 74 or seabed station 108 in FIG. 120. Three barriers 56, 114, 112 are in place and the well may be suspended for example as illustrated in FIG. 120. Suspended open water completion system 5 may be continuously or periodically monitored as illustrated for example in FIG. 120. Sensor 64 may sense pressure as well as other characteristics in area 62. Communication device 78 can transmit sensor 80 data wirelessly to the surface receiver. Fluctuation in pressure for example can indicate a leak in upper deep set barrier 114. Sensor 80 gauges pressure in area 118 and communication device 82 can wirelessly transmit the sensor 80 data to shallow set communication device 78 and transmitted to the surface receiver. Fluctuations in pressure in area 118 can indicate a leak in lower deep set barrier 112 for example.

The foregoing outlines features of several embodiments of dual barrier open water completion systems so that those skilled in the art may better understand the aspects of the disclosure. Those skilled in the art should appreciate that they may readily use the disclosure as a basis for designing or modifying other processes and structures for carrying out the same purposes and/or achieving the same advantages of the embodiments introduced herein. Those skilled in the art should also realize that such equivalent constructions do not depart from the spirit and scope of the disclosure, and that they may make various changes, substitutions and alterations herein without departing from the spirit and scope of the disclosure. The scope of the invention should be determined only by the language of the claims that follow. The term "comprising" within the claims is intended to mean "including at least" such that the recited listing of elements in a claim are an open group. The terms "a," "an" and other singular terms are intended to include the plural forms thereof unless specifically excluded.

What is claimed is:

1. A well completion system, comprising:

a shallow set barrier (56) installed in an upper section (58) of a well (10) extending down from a wellhead (16) to a formation (9);

a deep set barrier (54, 114) installed in a lower section (28) of the well, the lower section located below a production completion when it is installed in the upper section;

a first sensor (64, 328) disposed to gauge a pressure in a first area (62) between the deep set barrier and the shallow set barrier; and a communication device (62, 78, 124) coupled with the first sensor to communicate the gauged pressure wherein the deep set barrier is formed by a lower completion (138) comprising:

an upper packer (30) installed in the lower section of the well, a lower packer (138) installed below the upper packer;

an intermediate barrier valve (44) located between the upper packer and the lower packer, the intermediate barrier valve and the upper packer forming an upper deep set barrier (114); and a lower barrier valve (36) located below the lower packer, the lower barrier valve and the lower packer forming a lower deep set barrier (112).

2. The well completion system of claim 1, further comprising a subsea isolation device (72) connected to the wellhead.

3. The well completion system of claim 1, wherein the well is suspended.

4. The well completion system of claim 1, wherein the first sensor and the communication device are located behind a casing (24) installed in the well.

5. The well completion of claim 1, wherein a production completion (86) is installed in the upper section, and further comprising:

an additional shallow set barrier (102) installed above the shallow set barrier.

6. The well completion of claim 1, wherein the deep set barrier comprises an upper deep set barrier (114) and a lower deep set barrier (112).

7. The well completion of claim 6, comprising a second sensor (80, 228) disposed to gauge pressure in a second area (118) between the upper deep set barrier and the lower deep set barrier.

8. The well completion of claim 6, wherein the second sensor is coupled to the communication device; and the first sensor, the second sensor, and the communication device are located behind a casing installed in the well.

9. The well completion of claim 1, wherein the deep set barrier comprises:

a lower deep set barrier (112) including a lower barrier valve (36) and a lower packer (30 or 138); and an upper deep set barrier (114) including an intermediate barrier valve (44) and an intermediate packer (42 or 30).

10. The well completion of claim 9, wherein the intermediate barrier valve is a dual trip saver formation isolation valve.

11. The well completion of claim 1, further comprising a second sensor (80, 228) disposed to gauge a second pressure in a second area (118) between the upper deep set barrier and the lower deep set barrier.

12. The well completion of claim 1, further comprising:

a second sensor (80, 228) disposed to gauge a second pressure in an area exterior (146) of the lower completion between the upper packer and the lower packer; and a port (84) providing pressure communication between the area exterior and an interior (135) of the lower completion between the lower barrier valve and the intermediate barrier valve.

13. A well comprising:

a casing (24) extending down from a wellhead (16) toward a formation (9);

a subsea isolation device (72) connected at the wellhead;

an upper deep set barrier (114) comprising an intermediate packer (42 or 30) and an intermediate barrier valve (44) installed in a lower section (28) of the casing;

a lower completion (26 or 138) installed in the lower section and providing a lower deep set barrier (114) comprising a lower packer (30 or 138) and a lower barrier valve (36);

a gravel pack port (34) formed through the lower completion between the lower barrier valve and the lower packer and providing communication between an interior (135) of the lower completion and an exterior (146);

a device (46) sealing the gravel pack port;

a first sensor (64, 328) gauging pressure in a first area (62) between the shallow set barrier and the upper deep set barrier; and a second sensor (80, 228) gauging pressure in a second area (118) between the upper deep set barrier valve and the lower deep set barrier valve.

14. The well of claim 13, wherein the first sensor and the second sensor are located behind the casing.

15. The well of claim 13, wherein the intermediate packer comprises slips (144) engaging the casing and the lower packer does not include slips.

* * * * *